US005238707A

United States Patent [19]

Weder et al.

[11] Patent Number: 5,238,707

[45] Date of Patent: Aug. 24, 1993

[54] METHOD OF REDUCING STATIC-CHARGE ON EASTER GRASS

[75] Inventors: Donald E. Weder; E. H. Weder; Howard M. Ruth, all of Highland; Michael J. King, Staunton, all of Ill.; Franklin J. Craig, Valley Park, Mo.; Larry J. Jones, Highland; Kenton D. Badgley, Alton, both of Ill.; Harry J. Snider, deceased, late of Phoenix, Ariz.; Laura L. Snider, legal representative, Rochelle, Ill.; S. Owen Dye, Highland, Ill.; Clay R. Wiedner, Trenton, Ill.; Bill C. Weder, Highland, Ill.; Robert L. Langenberg, San Jose, Calif.

[73] Assignee: Highland Manufacturing and Sales, Highland, Ill.

[21] Appl. No.: 985,529

[22] Filed: Dec. 3, 1992

Related U.S. Application Data

[60] Continuation of Ser. No. 833,236, Feb. 10, 1992, abandoned, which is a continuation of Ser. No. 699,401, May 13, 1991, abandoned, which is a division of Ser. No. 428,249, Oct. 27, 1989, Pat. No. 5,038,975, which is a division of Ser. No. 163,596, Mar. 3, 1988, Pat. No. 4,893,757, which is a division of Ser. No. 916,892, Oct. 8, 1986, Pat. No. 4,776,521, which is a division of Ser. No. 640,517, Aug. 13, 1984, Pat. No. 4,646,388.

[51] Int. Cl.[5] ..... B05D 7/00

[52] U.S. Cl. ..... 427/212; 427/242; 427/248.1; 428/378

[58] Field of Search ..... 427/212, 642, 248.1; 428/378

[56] References Cited

U.S. PATENT DOCUMENTS 4,045,949 9/1977 Paton et al. ..... 428/372 X
4,255,487 3/1981 Sanders ..... 427/122 X

*Primary Examiner*—Michael Lusigan
*Attorney, Agent, or Firm*—Dunlap, Codding & Lee

[57] ABSTRACT

A method for treating Easter grass to a substantially reduced static charge on the Easter grass by coating a substantial portion of the Easter grass with an anti-static compound.

8 Claims, 12 Drawing Sheets

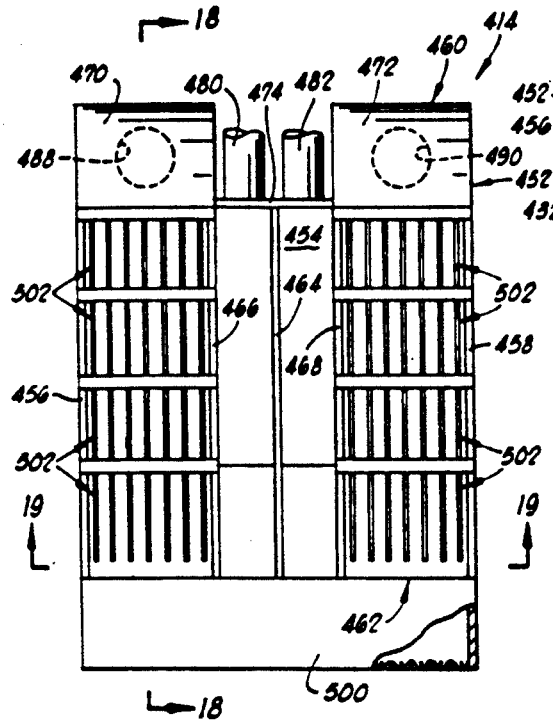
FIG. 17
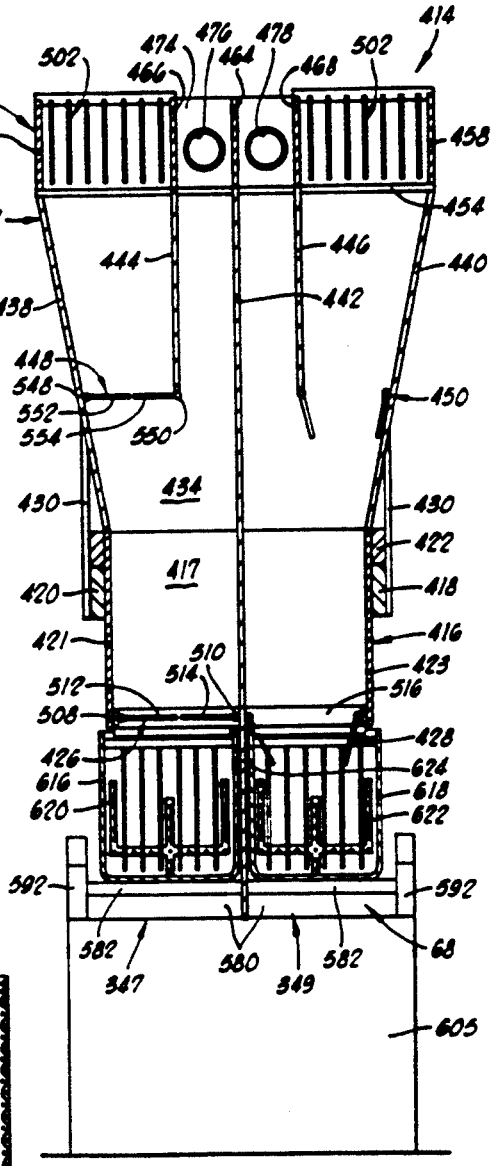
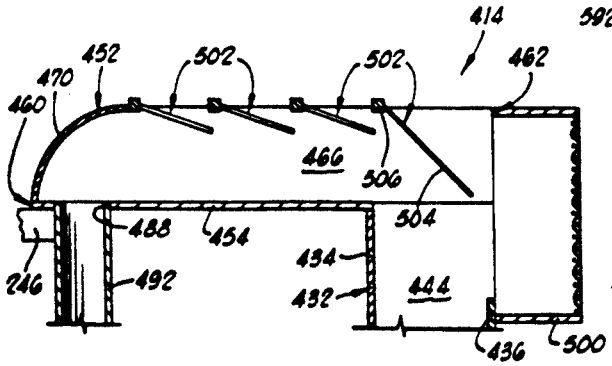
FIG. 18
FIG. 19

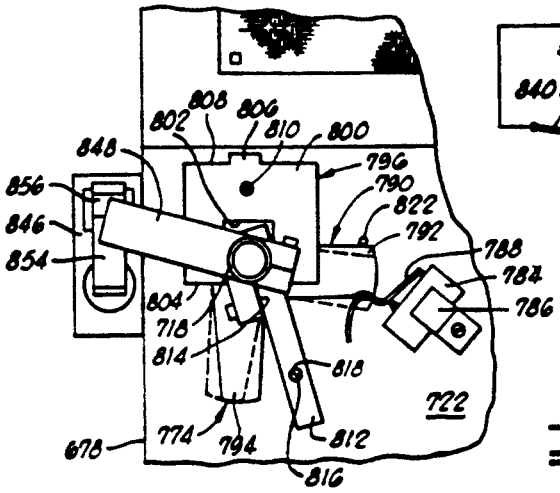
FIG. 28
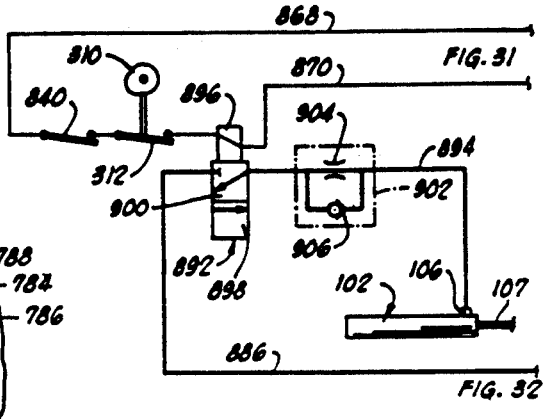
FIG. 31
FIG. 32
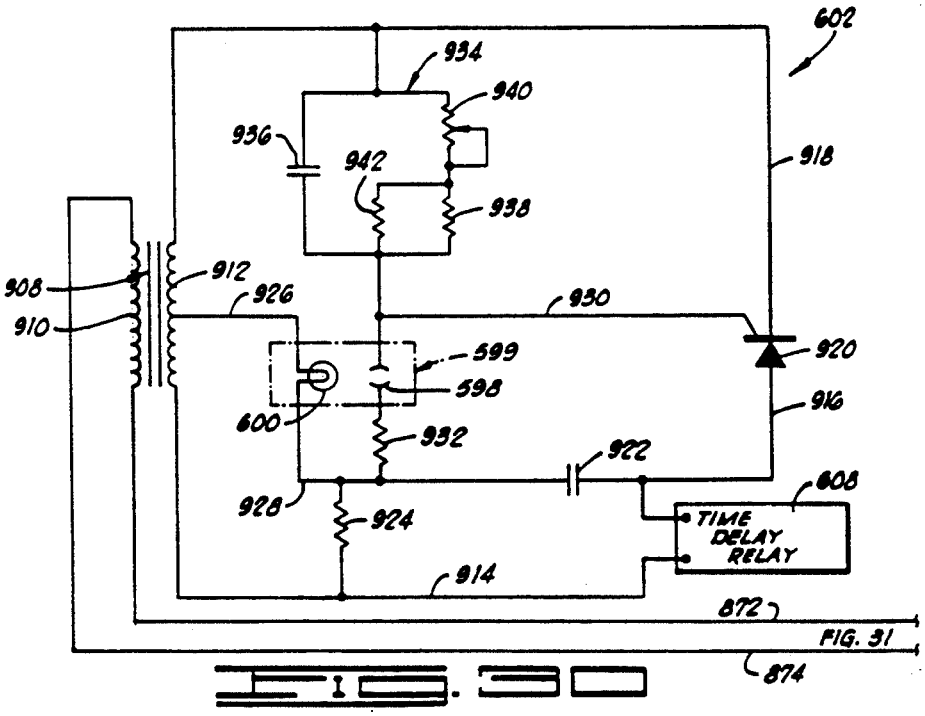
FIG. 30

METHOD OF REDUCING STATIC-CHARGE ON EASTER GRASS

This is a continuation of copending application Ser. No. 07/833,236 filed on Feb. 10, 1992, now abandoned; which is a continuation of U.S. Ser. No. 07/699,401, filed May 13, 1991, now abandoned; which is a divisional of Ser. No. 428,249, filed Oct. 27, 1989, now U.S. Pat. No. 5,038,975; which is a divisional of Ser. No. 163,596, filed Mar. 3, 1988, now U.S. Pat. No. 4,893,757; which is a divisional of Ser. No. 416,892, filed Oct. 8, 1986, now U.S. Pat. No. 4,776,521; which is a divisional of Ser. No. 640,517, filed Aug. 13, 1984, now U.S. Pat. No. 4,646,388.

BACKGROUND OF THE INVENTION

Field of the Invention

The present invention generally contemplates a system for disintegrating bales of filamentary material and producing weighed charges of the material following disintegration of the bales. The present system particularly is adapted for disintegrating bales of Easter grass and Easter grass-like material and for production of charges that can be bagged for sale to consumers.

BRIEF DESCRIPTION OF THE DRAWINGS

FIG. 15 is a fragmentary view of the filament precipitation tower illustrating a portion of the deflector assembly.

FIG. 16 is a plan view in partial cutaway of the filament separation assembly.

FIG. 17 is a plan view in partial cutaway of the scale tower disposed above the scales used to weigh the charges of filamentary material.

FIG. 18 is a cross section of the scale tower taken along 18—18 of FIG. 17.

FIG. 19 is a cross section of the scale tower taken along line 19—19 of FIG. 17 and illustrating the positioning of the scale tower above the scales of the apparatus.

FIG. 28 is a front elevational view of the gate discharge completion assembly shown in FIG. 27.

FIGS. 29, 30, 31, 32, 33 and 34 are circuit diagrams schematically illustrating the electric-pneumatic control system of the apparatus.

DESCRIPTION OF THE PREFERRED EMBODIMENT

Figure 1:
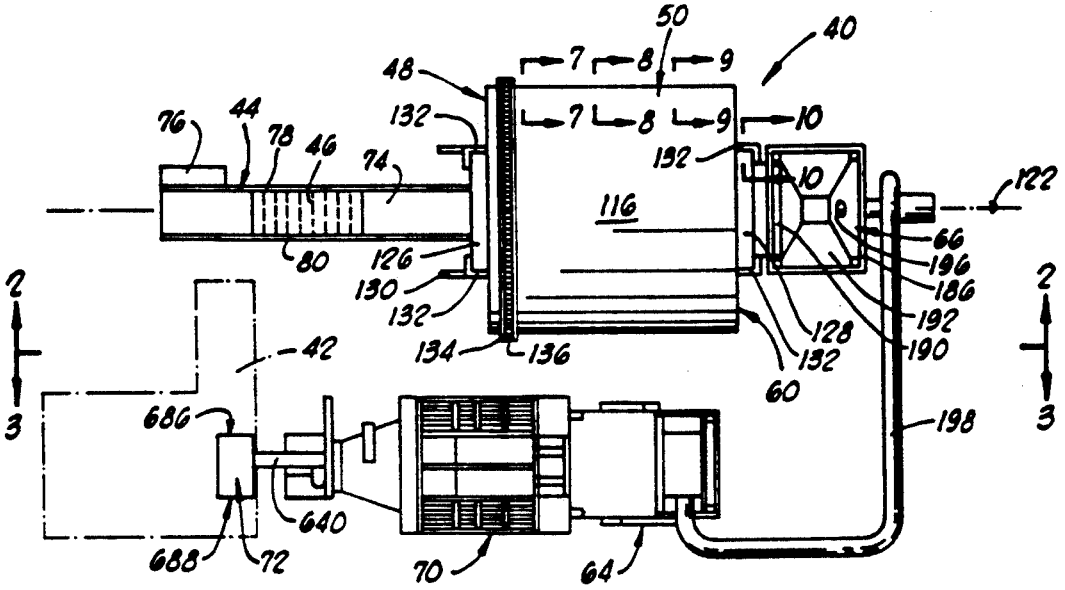
FIG. 1 is a plan view of an apparatus for producing weighted charges of loosely aggregated filamentary material from compacted bales of the material constructed in accordance with the present invention.
Figure 2:
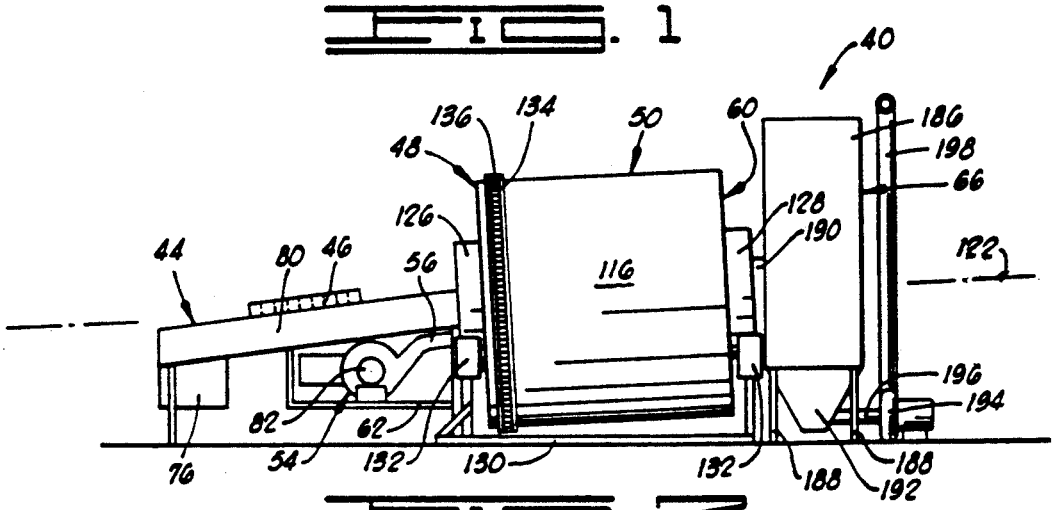
FIG. 2 is an elevational view of a portion of the apparatus of FIG. 1 taken along line 2—2 of FIG. 1.
Figure 3:
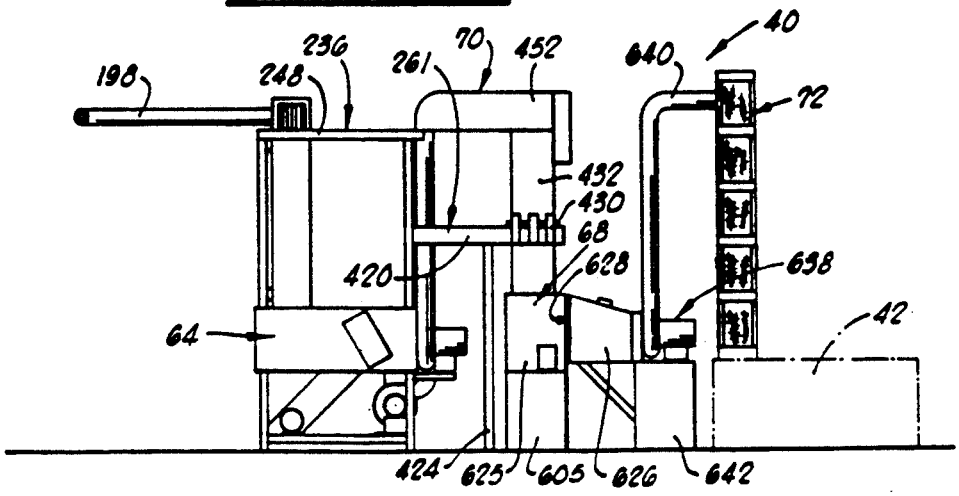
FIG. 3 is an elevational view of a portion of the apparatus of FIG. 1 taken along line 3—3 of FIG. 1.

Referring now to the drawings in general, and to FIGS. 1-3 in particular, shown therein and designated by the general reference numeral 40 is an apparatus for producing weighed charges of loosely aggregated filamentary material from compacted bales of the material. The apparatus 40 is particularly adapted for use in separating bales of the material commonly referred to as Easter grass into charges having a preselected weight appropriate for consumer sales and preferably it is used with an automatic bagging machine, indicated in phantom line at 42 in FIGS. 1 and 3, which receives the charges and places them in bags for such sales. The bagging machine 42, which is not part of the invention, may be of any type capable of receiving the charges and bagging them in response to a control signal that is produced by the apparatus 40 as will be discussed below. Alternatively, the charges may be discharged onto a moving belt or like conveyor for hand bagging by personnel stationed along such conveyor.

The apparatus 40 is comprised of a series of major components which are functionally organized into assemblies that each perform a specific operation on the filamentary material. These operations are carried out sequentially and the operation of the components that comprise the assemblies is automatically coordinated by an electric-pneumatic control system so that the components of the apparatus 40 coact to produce the individual charges derived from the bales at a substantially constant rate that facilitates bagging. Because of this coordination, it will be useful to provide an overview of the apparatus 40 before discussing the detailed construction of each of the major components thereof. Similarly, it will be useful to first consider the mechanical structure of the apparatus 40 as a preliminary to the discussion of the control system by means of which the operation of the components of the apparatus 40 is coordinated.

Figure 5:
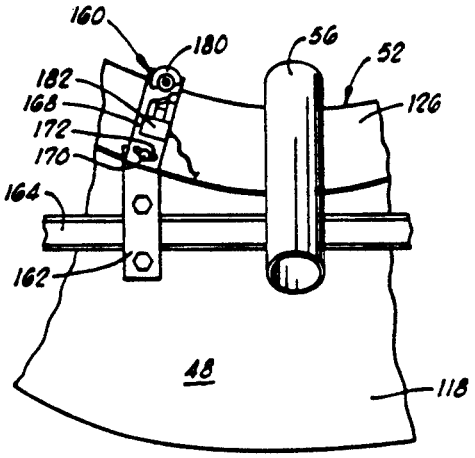
FIG. 5 is a fragmentary elevational view of the input end of the drum showing the mounting of the controller for the conveyor by means of which bales are introduced into the drum.

In the preferred embodiment, the apparatus 40 comprises an electrically operated belt conveyor 44 upon which bales 46 of compacted material can be placed for feeding the bales 46 into the input end 48 of a rotatable drum 50, the drum 50 having a circular input port 52 (see FIG. 5) formed in the input end 48 for this purpose. The drum 50 and the conveyor 44 are two components of a bale disintegration assembly (not numerically designated in the drawings), the drum 50 receiving portions of the bales 46 from the conveyor 44 and breaking such portions into loose tufts of filaments which rain down across the interior of the drum. The bale disintegration assembly further comprises a drum air blower 54, having an outlet 56 that discharges into the input port 52 of the drum 50 as shown in FIG. 5, that blows the tufts from the drum 50 via a circular output port 58 (partially shown in FIG. 10) formed in an output end 60 (FIGS. 1 and 2) of the drum 50. Thus, material that is placed on the conveyor 44 of the bale disintegration assembly in the form of bales exits the drum 50 of such assembly as a stream of loosely tufted material. The drum air blower 54 can be conveniently mounted on a framework 62 disposed on the underside of the belt conveyor 44 as shown in FIG. 2.

The bale disintegration assembly, in turn, forms a part of a bale reduction assembly (not numerically designated in the drawings) which further comprises a filament separation assembly 64 that receives the tufts of filaments produced by the drum 50 and separates the tufts into individual filaments which can be accumulated on scales as will be discussed below. For this separation to be effective, it will at times be necessary for the filamentary material to be treated with a conventional anti-static compound to prevent the filaments from clinging together due to electrostatic forces. A convenient location within the apparatus 40 for such treatment to take place is immediately downstream of the drum 50 and the apparatus 40 includes a filament treatment chamber 66 adjacent the output end of the drum 50 for carrying out such treatment.

Once the separate filaments have been produced by the filament separation assembly 64, the filaments are transported to a scale assembly 68 upon which the filaments accumulate into the charges the apparatus 40 is constructed to produce. Such transport is effected by a stream forming assembly 70 which is constructed to permit the filaments to rain down on scales of which the scale assembly 68 is comprised. Each time a charge accumulates on one of these scales, a discharge assembly (not numerically designated in the drawings) is triggered into operation to discharge the charge from such scale. Preferably, the weighed charges of filamentary material are discharged from the scales into a charge storage magazine 72 which is constructed to receive the charges at irregular intervals and discharge the weighed charges at a substantially constant rate. When the apparatus 40 is used with a bagger, the control signal that operates the bagger is produced by the magazine 72 each time a charge is discharged from the magazine.

Turning now to the specific construction of the components of the apparatus 40 and beginning with the conveyor 44, the conveyor 44 is of conventional construction comprising an endless belt 74 that is supported on an incline, as indicated by the drawing of the conveyor 44 in FIG. 2, so that bales 46 placed on the end of the belt 74 remote from the drum 50 will travel up the incline and drop from an upper end (not shown) of the belt 74 that is extended into the input port 52 of the drum 50. Motive power for the belt 74 is provided by a conventional electric motor (not shown) that drives the belt 74 through a conventional drive train (not shown) located within a housing 76 on one side of the belt 74 and at the end of the conveyor 44 remote from the drum 50. Sidewalls, 78 and 80, are provided on both sides of the conveyor 44 to contain the bale 46 as the bale 46 moves up the belt 74 to the drum 50.

As shown in FIG. 2, the framework 62 that supports the drum air blower 54 is mounted below the belt 74 at the end of the conveyor 44 adjacent the drum 50 so that the drum air blower outlet 56 can be inserted into the drum 50 by moving the conveyor 44 into position to transport bales 46 of the filamentary material into the drum 50. The drum air blower 54 is of conventional construction, the drum air blower being a centrifugal blower having a motor 82 that turns a rotor 84 (FIG. 4) disposed within a casing 86 so that air is drawn into an inlet 88 disposed coaxially with the motor 82 and discharged through the blower outlet 56.

Figure 4:
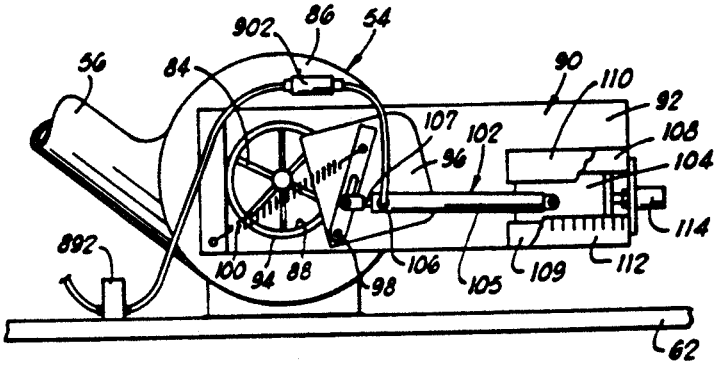
FIG. 4 is an elevational view in partial cutaway of the drum air blower used to discharge filamentary material from the drum of the apparatus shown in FIG. 1.

The drum air blower 54 is provided with a damper assembly 90 that has been particularly illustrated in FIG. 4. As shown in such Figure, the damper assembly 90 comprises a base plate 92 which is mounted on the casing 86 of the blower 54 and has a hole 94 formed therethrough to align with the inlet 88 of the blower 54. A damper 96 is pivotally mounted on the base plate 92 via a bolt 98 and a spring 100 is connected between the base plate 92 and the damper 96 to bias the damper 96 toward a position in which the damper 96 will overlay the inlet 88 of the blower 54. Since such overlaying of the inlet 88 will block the flow of air through the blower 54, and since filamentary material is discharged from the drum 50 by a stream of air passed through the drum 50 by the blower 54 as has been noted above, the damper assembly 90 provides a means for disabling the discharge of filamentary material from the drum 50. The purpose of such disablement will become clear below.

The damper assembly 90 is further comprised of a pneumatic actuating cylinder 102 connected between the damper 96 and a slide 104 mounted on the base plate 92 so that, when the slide 104 is fixed in position, the damper 96 can be held in a position that will open the inlet 88 of the blower 54 via compressed air introduced into a port 106 opening into the end of the barrel 105 of the pneumatic actuating cylinder 102 nearest the damper 96. The compressed air drives the piston (not shown) of the pneumatic actuating cylinder 102 toward the end of the barrel remote from the damper 96 to retract the pneumatic actuating cylinder piston rod 107 to which the damper 96 is connected in a conventional manner. The slide 104 is guided for sliding movement along the longitudinal axis of the pneumatic actuating cylinder 102 by guides 108, 109, mounted on the base plate 92 alongside the upper and lower sides of the slide 104 and retaining strips 110, 112 are attached to the guides 108, 109 to partially overlay the slide 104 and thereby hold the slide 104 against the base plate 92. A conventional screw adjustment 114 is mounted on the base plate 92 and connects to the end of the slide 104 remote from the pneumatic actuating cylinder 102 to hold the slide 104 in position against the force the spring 100 exerts on the slide 104 via the damper 96 and pneumatic actuating cylinder 102 and thereby provides an adjustment on the position of the damper 96 when the damper 96 is being held open by compressed air introduced into the pneumatic actuating cylinder 102. The retaining strip 112 conveniently can be graduated to provide for setting the quantity of air blown through the drum 50 when the damper is positioned to open the blower inlet 88. The pneumatic actuating cylinder 102 is controlled by the electric-pneumatic control system and the portion of this system associated with the operation of the pneumatic actuating cylinder 102 has been shown in FIG. 29 wherein the pneumatic actuating cylinder 102 has been schematically illustrated for a discussion of the control system to be given below.

Turning now to the drum 50, such drum is generally tubular in form, the drum 50 having a substantially tubular wall portion 116 extending between the ends 48, 60 of the drum 50. Bulkheads, 118 and 120 that are partially shown in FIGS. 5–10, are provided at the ends 48 and 60 respectively of the drum 50 to partially close the ends of the drum. As can be particularly seen in FIGS. 6 and 10, the input and output ports, 52 and 58 respectively, are circular holes formed through the bulkheads 118 and 120 respectively. In order that filamentary material can build up in the drum 50 to be blown therefrom by drum air blower 54 as has been described, the ports 52 and 58 are centered on the axis of the drum wall portion 116, such axis being shown at 122 in FIGS. 1 and 2, and the ports 52, 58 are constructed on a diameter less than the diameter of the interior wall 124 of the wall portion 116. Extending about the ports 52, 58, on the exterior sides of the bulkheads 118, 120, the drum is provided with support rings 126, 128 respectively by means of which the drum 50 is supported for rotation about the drum axis. For reasons that will become clear below, the preferred material for the construction of the drum 50 is wood, the wall portion 116 comprising a plurality of staves (not shown) arranged in a circle to extend the length of the drum 50.

To provide for the described support of the drum 50, the apparatus 40 comprises a metal base frame 130 schematically shown in FIGS. 1 and 2. At each end of the base frame 130 and at both sides thereof, the base frame 130 is provided with a bearing assembly 132 that includes a roller (not shown) that engages one of the support rings 126, 128 so that each ring is supported by two rollers at each end of the drum 50. The positioning of the bearing assemblies 132, and the support of the rings 126, 128 via the rollers therein, thus positions the drum 50 for rotation about the axis 122.

For reasons to be discussed below, it is desirable that the drum 50 be disposed on a slant with the output end 60 thereof slightly higher than the input end 48 thereof and one way of achieving this disposition of the drum 50 has been illustrated in the drawings. That is, the bearing assemblies 132 of the output end 60 of the drum 50 are placed slightly higher than the bearing assemblies 132 at the input end 48 of the drum 50 as shown in FIG. 2. (The drum slant has been exaggerated in FIG. 2. In one preferred embodiment of the drum 50 in which the drum is approximately eight feet long, the output end 60 of the drum 50 is only four inches higher than the input end 48 thereof.) A track 134 is formed circumferentially about the wall portion 116 of the drum 50 near the input end 48 thereof to receive a chain 136 that is used to rotate the drum 50 about its axis in a conventional manner. That is, the chain 136 is engaged by a sprocket (not shown) on the shaft of an electric motor (not shown) mounted on the base frame 130 in a conventional manner so that the drum 50 can be rotated by operating such motor.

Figure 7:
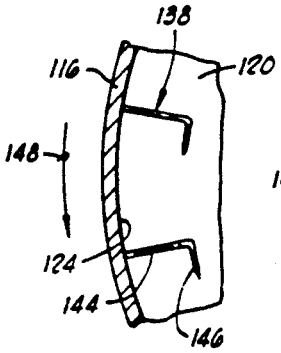
FIG. 7 is a fragmentary view in cross section of the drum wall illustrating the shape of one type of spike mounted on the interior of the drum wall.
Figure 8:
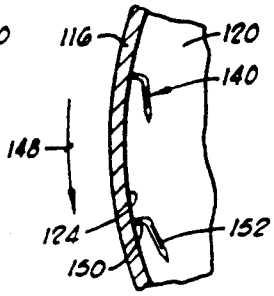
FIG. 8 is a fragmentary view in cross section of the drum wall showing another type of spike mounted on the interior of the drum wall.
Figure 9:
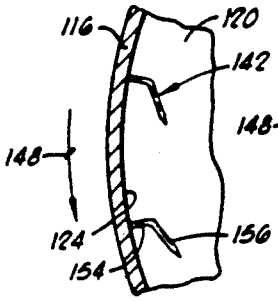
FIG. 9 is a fragmentary view in cross section of the drum wall showing yet a third type of spike mounted on the interior of the drum wall.

Turning now to FIGS. 7–9, shown therein are spikes with which the drum 50 is provided to disintegrate bales that are introduced into the input port 52 of the drum 50 as the drum 50 rotates. These spikes, which extend inwardly from the interior wall 124, are conveniently provided and fixed to the drum wall portion 116 by driving straight steel spikes having appropriate lengths through the wall portion 116 and then bending such steel spikes to the shapes that have been shown in FIGS. 7–9. Such manner of providing and fixing the spikes is facilitated by the wooden construction of the drum 50 that has been noted above. As shown in FIGS. 7–9, the spikes are divided into three groups: a first group partially shown in FIG. 7 in which the spikes are designated by the reference numeral 138; a second group partially shown in FIG. 8 in which the spikes are designated by the reference numeral 140; and a third group partially shown in FIG. 9 in which the spikes are designated by the reference numeral 142. As indicated by the section lines in FIG. 1 illustrating the locations in the drum 50 at which the sectional views in FIGS. 7–9 are taken, the spikes 138 are positioned in portions of the drum 50 adjacent the input end 48 thereof, the spikes 140 are positioned in medial portions of the drum 50, and the spikes 142 are positioned in portions of the drum 50 adjacent the output end 60 thereof. (For clarity of illustration, only selected ones of the spikes that would be visible along the section lines 7—7, 8—8 and 9—9 of FIG. 1 have been illustrated in the drawings. In one preferred embodiment of the drum 50, the drum 50 comprises two circumferentially extending rows of the spikes 138 followed by four circumferentially extending rows of the spikes 140 and then followed by four circumferentially extending rows of the spikes 142 from the input end 48 of the drum to the output end 60 thereof. The rows are equally spaced along the length of the drum 50 and each row is comprised of twenty-four spikes that are equally spaced along a circle extending circumferentially about the interior wall 124 of the drum 50.)

The shapes of the spikes 138–142 are selected to perform different operations on the filamentary material in different portions of the drum 50 and the shapes illustrated in FIGS. 7–9 are particularly suited to the disintegration of bales of the filamentary material commonly referred to as Easter grass that have been prepared by the method described in a copending application entitled "SYSTEM FOR BALING STRANDS OF MATERIAL AND A DENSER BALE OF STRANDS OF MATERIAL SO PRODUCED" assigned to the assignee of the present invention. As indicated by dashed lines in FIGS. 1 and 2, these bales of Easter grass are comprised of loosely interconnected flakes of compacted filaments having nearly equal thicknesses, to define an average thickness from which the thickness of a flake varies only slightly, and the flakes tend to separate as a bale moves off the end of the belt 74 of the conveyor 44. Thus, with such bales, there is a tendency for the flakes to drop one-by-one or, at most, in a group of several flakes, into the drum 50 as a bale 46 is advanced into the drum 50 by the conveyor 44.

The spikes 138 are each comprised of a shank portion 144 which extends radially inwardly from the drum wall portion 116 a distance that is approximately twice the average thickness of a flake and a hook portion 146 that makes an angle of approximately 90° with the shank portion 144 to extend from the shank portion 144 in the direction, indicated at 148 in FIGS. 7–10, that the drum rotates. The hook portions 146 can conveniently be of a length substantially equal to the average thickness of a flake. In the spikes 140, the shank portions 150 are made small in comparison to the average flake thickness so that the hook portions 152 of the spikes 140 will have free ends spaced from the wall 124 a distance that is small compared to the average thickness of a flake, a suitable distance of the free end of the hook portion 152 from the wall being about half the average flake thickness. As shown in FIG. 8, the hook portions 152 of the spikes 140 extend nearly parallel to the wall 124 of the drum 50. In the spikes 142, the shank portions 154 are again made small in comparison to with the average flake thickness and the hook portions 156 are canted at a relatively large angle; such as 30° to 50° approximately, to the wall 124. As is the case with the hook portions 146, a suitable length for the hook portions 156 is approximately the thickness of a flake of the filamentary material entering the drum 50.

These shapes enter into the disintegration of a bale in the following manner. When a flake enters the drum 50, it will tumble in portions of the drum in which the spikes 138 are located and, eventually, be impaled on the hook portion 146 of a spike 138. The flake is then lifted over the top of the drum to fall across the drum after passing over the drum axis. The impact of the fall, which will be to one side of the major flow of air through the drum because of the angling of the hook portion 146 with respect to the shank portion 144, will cause the flake to develop a less compacted structure than the structure of the flake as the flake enters the drum. This fluffing of the flake is enhanced by the slant of the drum axis that has been described above. That is, because of the higher elevation of the output end 60 of the drum 50 than the input end 48 thereof, the lifting and dropping of the flakes tends to move the flakes toward the input end 48 of the drum 50. Thus, so long as the flakes remain tightly packed, they tend to fall back into portions of the drum 50 adjacent the input end 48 thereof to be repeatedly lifted and dropped until a fluffy structure is achieved.

As the structure of the flakes loosens, the filamentary material they include begins to spill over into portions of the drum in which the spikes 140 are disposed. In such portion of the drum 50, the hook portions 152 of the spikes 140 will penetrate the fluffed flakes near the sides of the flakes so that, when the flakes are lifted to the top of the drum as the drum rotates, tufts of filamentary material will be torn from the major body of each flake and will be blown by the edges of the air stream through the drum 50 into the portions of the drum wherein the spikes 142 are disposed. In this latter portion of the drum, adjacent the output end 60 of the drum, the tufts are lifted to the top of the drum and, because of the relatively large angle between the hook portion 156 of each spike 142 and the wall 124 of the drum 50, dropped into central portions of the air stream through the drum 50. The dropping of the tufts of filaments into central portions of the air stream causes such tufts to be blown into the output port 58 of the drum 50.

Figure 10:
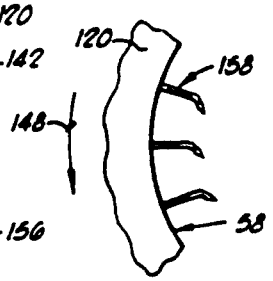
FIG. 10 is a fragmentary view of the interior of the drum at the output end thereof showing spikes extending into the output port of the drum.

Referring now to FIG. 10, the output port 58 is also provided with a plurality of spikes, each designated by the numeral 158, that extend inwardly toward the axis of the drum 50. The spikes 158, which can be slightly hooked at their free ends, snag larger tufts of filaments which will subsequently be torn from the spikes 158 by the air stream passing through the drum 50. The tearing of the larger tufts of filaments from the spikes 158 reduces the size of such tufts so that tufts of filaments leaving the drum 50 can be caused to have a selectable average size, via the lengths of the spikes 158, and a fluffy structure that is utilized in further reduction of the bales in the filament separation assembly 64 that will be discussed below.

Figure 6:
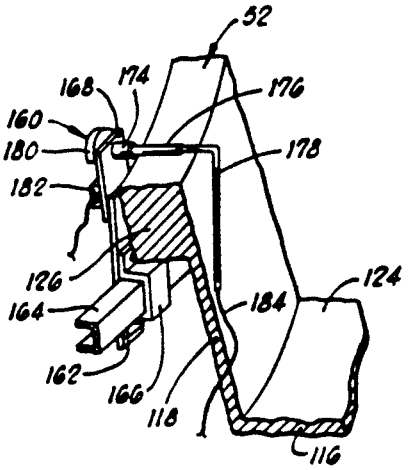
FIG. 6 is a fragmentary isometric view of the input end of the drum showing additional features of the conveyor controller.

One further aspect of the operation of the drum 50 in the disintegration of the bales 46 has been illustrated in FIGS. 5 and 6. It is not desirable that the quantity of filamentary material in the drum 50 be permitted to build to a level that might cause the spikes 138–142 to become clogged with filamentary material that might interfere with the actions of the spikes that have been described above. To prevent the excessive buildup of filamentary material in the drum 50, the apparatus 40 is comprised of a conveyor disabling assembly 160 that has been shown in FIGS. 5 and 6.

The conveyor disabling assembly 160 is comprised of a support plate 162 that is mounted on a brace 164, forming a portion of the base frame 130, that extends laterally across the input end 48 of the drum 50. To hold the plate 162 on the brace 164, a U-shaped clamp 166 is bolted to the support plate 162 and extends about the brace 164 as shown in FIG. 6. A wand support plate 168 is bolted to the support plate 162 via a bolt 170 that extends through an arcuate slot 172 formed through the plate 168 and the wand support plate 168 carries a bearing 174 at its upper end. A wand 176 is pivotally supported in the bearing 174 for pivotation about an axis parallel to the pivotation axis of the drum 50 and the wand is extended into the drum 50 through the drum input port 52. The wand 176 has a downturned portion 178 within the drum 50 so that, for a selectable depth of filamentary material within the drum 50, the downturned portion 178 of the wand 176 will be engaged by filamentary material within the drum and pivoted within the bearing 174 by movement of the filamentary material occasioned by the rotation of the drum. Such depth can be selected by the positioning of the support plate 162 along the brace 164, the positioning of the bolt 170 in the slot 172, and the angular position of the wand support plate 168 on the support plate 162. A cam 180 is mounted on the end of the wand disposed exteriorly of the drum 50 and a normally closed switch 182 is mounted on the wand support plate 168, below the cam 180, to be opened by the cam 180 when the wand 176 is pivoted through a selected angle corresponding to the selected depth of filamentary material within the drum 50. The switch 182 is serially connected to the motor that drives the conveyor 44 so that the conveyor 44 will be disabled whenever the material in the drum reaches the preselected depth to discontinue the feeding of filamentary material into the drum 50.

The conveyor disabling assembly 160 further comprises a cord 184 that is attached to the distal end of the downturned portion 178 of the wand 176 to prevent another source of clogging of the spikes 138–142 of the drum 50. The flakes that make up a bale 46 are held together by varying numbers of filaments so that, at times, individual flakes are dropped into the drum while, at other times, several flakes are held together as they enter the drum 50 long enough that such flakes are simultaneously dropped into the drum 50. When several flakes enter the drum simultaneously, the hooking of the conglomerate formed thereby by the spikes 138 tends to be retarded. That is, a conglomerate of several flakes will tend to roll around in the drum 50 near the input end 48 thereof until the tumbling of the conglomerate breaks the conglomerate into the separate flakes of which the conglomerate is comprised. When this occurs, the conversion of the flakes that make up the conglomerate into fluffed material that is engaged by the downturned portion 178 of the wand 176 is retarded so that additional flakes may enter the drum even though the quantity of material within the drum is sufficient to provide a depth of filamentary material within the drum that is greater than the preselected depth of material in the drum. Thus, by the time the conglomerate is broken down into separate flakes by tumbling of the conglomerate within portions of the drum adjacent the input end 48 thereof, a quantity of filamentary material can have been introduced into the drum 50 that will cause an excessive build up of fluffed filamentary material therein. The cord 184 prevents this excessive build up. That is, the position of the cord 184 is such to become tangled in a tumbling conglomerate of flakes and turn the wand 176 sufficiently as the drum rotates to operate the switch 182 and disable the conveyor 44. Once the conglomerate is broken up, the cord becomes disentangled and control of the depth of filamentary material within the drum 50 reverts to control by the wand 176 that has been previously described.

The construction of the filament treatment chamber 66 has been illustrated in FIGS. 1 and 2. Such chamber, which is located adjacent the output end 60 of the drum 50, is comprised of a large box 186 that is supported on legs 188 so that lower portions of the box 186 are aligned with the output port of the drum 50. A large hole (not shown), having a diameter slightly larger than the diameter of the drum output port, is formed in the side of the box 186 facing the drum 50 and a circular shroud 190 is mounted in the output port of the drum 50 to extend into such hole and channel the tufts of filamentary material produced by the drum into the chamber 66.

The box 186 is open to the atmosphere at its upper end so that the stream of air exiting drum 50 will be dissipated upon entering the chamber 66. Such dissipation permits the tufts of filaments produced by the drum 50 to settle toward the lower end of the box 186, which is also open, and into a hopper 192 mounted on the lower end of the box 186. An air blower 194, of the conventional centrifugal type, is positioned adjacent the chamber 66 and has an inlet 196 opening into the hopper 192 to draw the aggregates of filaments from the chamber 66. These tufts are transported to the filament separation assembly 64 via a conduit 198 attached to the outlet of the blower 194.

Figures 11, 12, 13:
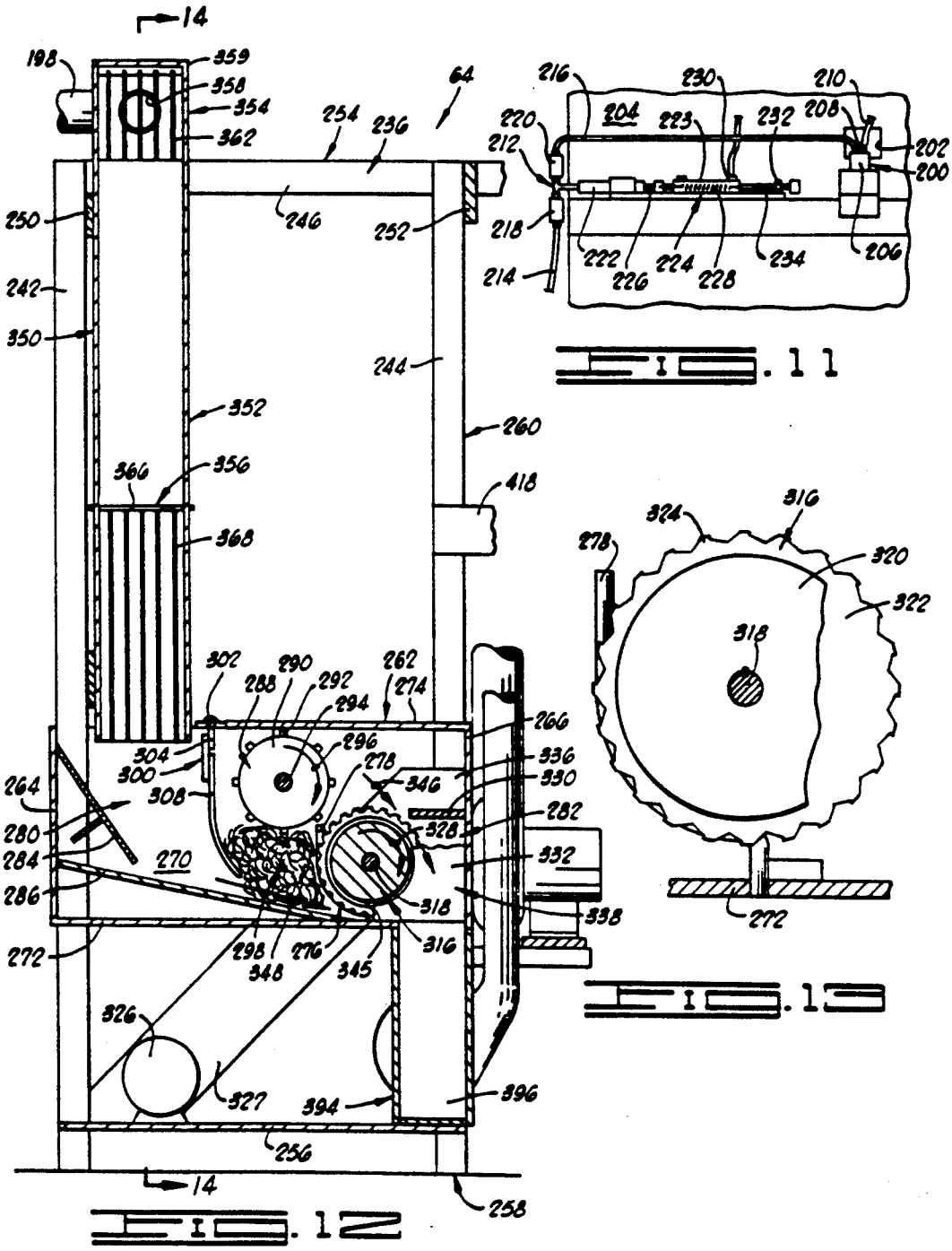
FIG. 11 is a fragmentary elevational view of one side of the filament treatment chamber illustrating the mechanism for injecting a mist of anti-static compound into the treatment chamber.
FIG. 12 is a cross section in side elevation and partial cutaway of the filament separation assembly taken along line 12—12 of FIG. 16.
FIG. 13 is an enlarged cross section in partial cutaway of the picker roll of the filament separation assembly.

Treatment of the filamentary material with an anti-static compound is carried out by a mist injection assembly 200 that has been illustrated in FIG. 11. A hole 202 is formed through the wall 204 of the box 186 opposite the wall of the box that faces the drum 50 and substantially on a level with the center of the drum output port. The mist injection assembly 200 comprises an anti-static compound reservoir 206 mounted on the wall 204 at the lower end of the hole 202 and a conventional atomizer 208 is mounted on the reservoir 206 to be operated with compressed air supplied on a conduit 210 so that the atomizer 208 will continually draw anti-static compound from the reservoir 206 and discharge such compound as a mist into the filament treatment chamber 66. The size of the atomizer 208 and the rate at which air is passed therethrough are selected so that the atomizer 208 will empty the reservoir 206 of a quantity of anti-static compound sufficient to treat one charge of filamentary material produced by the apparatus 40 in a time that is short compared to the time between the successive production of charges by the apparatus 40. Such selection permits the quantity of anti-static compound used to treat each charge of the filamentary material to be varied to meet existing weather conditions by varying the rate at which anti-static compound is introduced into the reservoir 206. To this end, a small, selectable quantity of anti-static compound is pumped into the reservoir 206 each time a charge of filamentary material is produced by the apparatus 40.

The present invention contemplates that the mist injection assembly 200 may comprise any pneumatically actuable pump that can be cycled by a pulse of air delivered to the pump and an example of such a pump, designated 212 in the drawings, has been illustrated in FIG. 11. The pump 212 is mounted on the wall 204 to draw anti-static compound from a supply reservoir (not shown) via a conduit 214 and discharge the compound into the reservoir 206 via a conduit 216 each time the pump 212 is caused to undergo one cycle of operation. The pump 212 is comprised of two check valves, 218 and 220, disposed between the conduits 214 and 216 to permit flow only in the direction from the supply reservoir to the reservoir 206, and a cylinder 222 that contains a sliding piston (not shown) and has one end fluidly communicating with the junction between check valves. Thus, each time the piston in the cylinder 222 is moved back and forth therein, a quantity of anti-static compound determined by the stroke of such piston is drawn from the supply reservoir and discharged into the reservoir 206. The pump 212 further comprises a pneumatic actuating cylinder 224 having a piston rod 226 that is connected to the piston in cylinder 222 and biased toward one end of the pneumatic actuating cylinder 224 by a spring 228. A port 230 opens into the end of the barrel 223 of the pneumatic actuating cylinder 224 so that each time a pulse of compressed air is introduced into the port 230, the piston rod 226 is driven a distance from the barrel 223 of the pneumatic actuating cylinder 224 and then returned to its initial position by the spring 228. The distance the piston rod 226 and, accordingly, the piston in the cylinder 222, moves, such distance determining the quantity of anti-static compound delivered to the reservoir 206 for each pump cycle, depends upon the relative locations of the cylinder 222 and the pneumatic actuating cylinder 224. This relative position is made variable by a screw adjustment formed between a bracket 232 and a rod 234 by means of which the barrel 223 of the pneumatic actuating cylinder 224 is secured to the wall 204 of the filament treatment chamber 66. As will be discussed below, the electric-pneumatic control system causes a pulse of compressed air to be delivered to the port 230 of the hydraulic actuating cylinder 224, which has been illustrated as part of the control system in FIG. 32, each time a charge of filamentary material is produced by the apparatus 40. Thus, the quantity of anti-static compound used to treat each charge of the filamentary material can be readily adjusted via the screw adjustment provided by the bracket 232 and rod 234.

The filament separation assembly 64, which receives the tufts of filaments produced by the drum 50 after treatment in the filament treatment chamber, is particularly shown in FIGS. 12–16 to which attention is now invited. The filament separation assembly 64 is preferably constructed within a supporting frame 236 comprised of four upright posts 238–244 arranged in a rectangle and connected together by planks 246–252 at the upper end 254 of the frame 236 and a shelf 256 near the lower end 258 of the frame 236. One side 260 of the frame 236 faces the scale assembly 68 and the planks 246 and 248 extend beyond the side 260 of the frame 236 as has been shown in FIG. 12 for the plank 246 and in FIG. 3 for the plank 248. Together with a prop 261 (FIG. 3), the planks 246 and 248 support the stream forming assembly 70 above the scale assembly 68 for a reason to be discussed below.

The filament separation assembly 64 comprises a picking chamber 262 mounted on the frame 236 a distance above the shelf 256, the picking chamber 262 having the general form of a rectangular box formed by walls including: an input end wall 264 extending between the posts 238 and 242 at the side of the frame opposite the side 260 that faces the scale assembly 68; an output end wall 266 extending between the posts 240 and 244 along the side 260 of the frame 236; a first side wall 268 extending between the posts 238 and 240; a second side wall 270 extending between the posts 242 and 244; a floor 272 that extends between the end walls, 264 and 266, and between the side walls, 268 and 270; and a cover 274 that extends side-to-side across portions of the picking chamber 262 adjacent the output end wall 266 so that portions of the picking chamber 262 adjacent the input end wall 264 are uncovered at the top of the picking chamber 262. As will be discussed below, the tufts of filamentary material produced by the drum 50 are introduced into the picking chamber 262 via such uncovered portions of the picking chamber 262 adjacent the input end wall 264.

Figure 14:
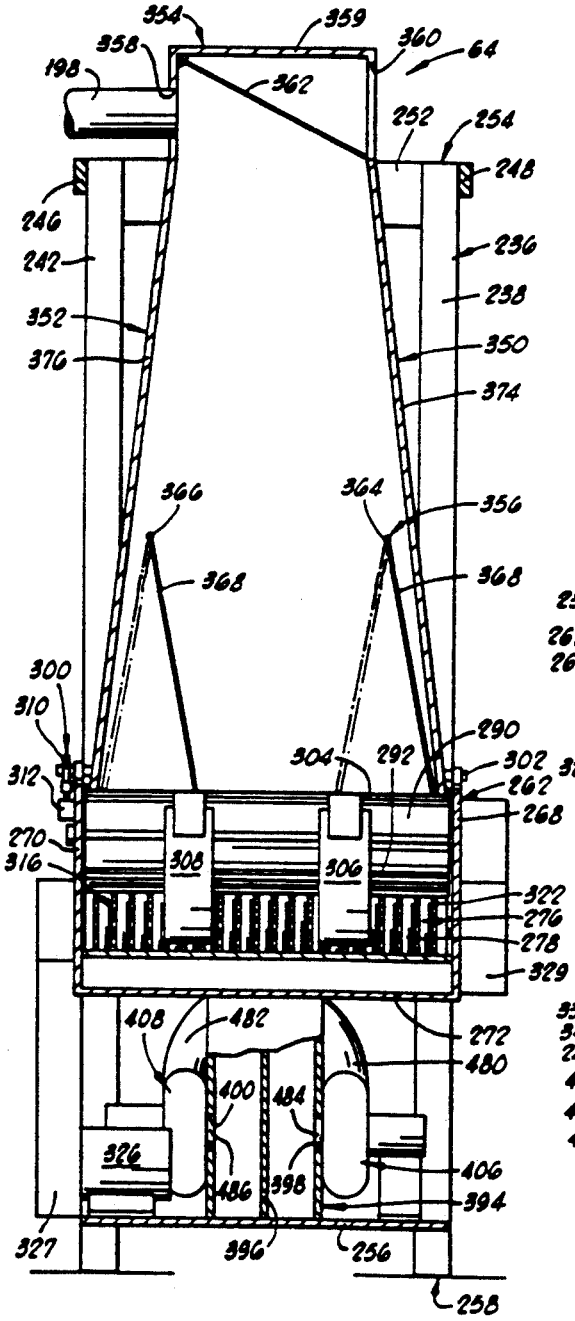
FIG. 14 is a cross section in partial cutaway of the filament separation assembly taken along line 14—14 of FIG. 12.
Figure 1:
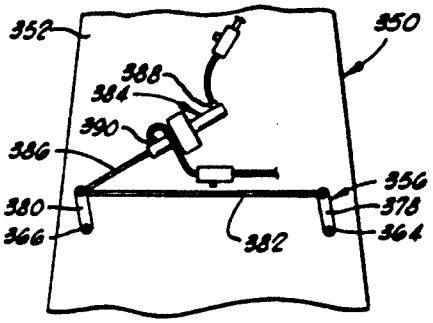
Figure 1:
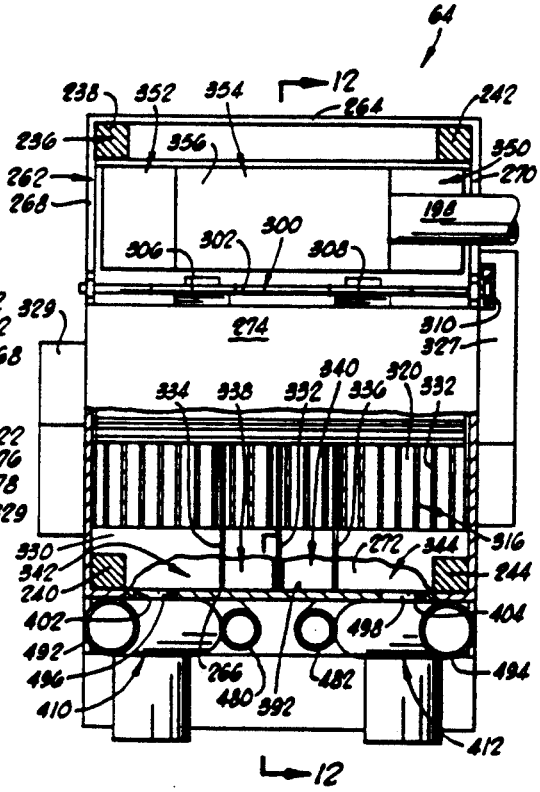

A comb 276, comprised of a row of parallel arcuate teeth 278 mounted in the floor 272 of the picking chamber 262 in a manner shown in FIG. 13, extends across the picking chamber 262 between the side walls 268, 270 as shown in FIG. 14. (In order to illustrate the manner in which the comb 276 is formed, the teeth 278 and the separation of the teeth have not been drawn to scale in the Figures. The picking chamber 262 will generally comprise many more teeth 278, made with smaller diameter stock, than has been shown in the drawings. In such row, the teeth 278 are equally spaced for a purpose to be discussed below.)

As shown in FIG. 12, the comb 276 divides the picking chamber into two portions; an input portion 280 extending generally between the input end wall 264 and the comb 276; and an output portion 282 extending generally between the comb 276 and the output end wall 266. Within the input portion 280 of the picking chamber 262, canted shelves 284 and 286 are positioned below the opening into the top of the picking chamber 262 formed by the construction of the cover 274 that has been described so that tufts of filamentary material falling into the picking chamber 262 will gravitate along the shelves 284 and 286 to the comb 276.

A paddle wheel 288 is mounted within the input portion 280 of the picking chamber 262 to extend between the side walls 268, 270 parallel to the comb 276 and above portions of the shelf 286 adjacent the comb 276. The paddle wheel 288 is comprised of a cylindrical body portion 290 having a plurality of ribs 292 mounted on the periphery thereof to extend the length of the paddle wheel 288 and the body member 290 is mounted on a central shaft 294 that is supported by conventional hearings (not shown) mounted on the side walls 268, 270 so that the paddle wheel can be rotated about an axis that extends axially through the body member 290 thereof parallel to the comb 276. In operation, the paddle wheel is rotated in the direction 296 shown in FIG. 12 so that the ribs 292 sweep along the top of the comb 276 to cause the filamentary material to form a tumbling supply roll 298 along the comb 276 from which individual filaments can be drawn as will be discussed below.

Between the paddle wheel 288 and the input end wall 264, the picking chamber 262 is provided with a supply roll sensor assembly 300 that, together with the damper assembly 90, constitutes a drum discharge disabling assembly that senses the size of the supply roll 298 and disables the discharge of filamentary material from the drum 50 when the supply roll reaches a preselected size. The assembly 300 comprises a rod 302 that is pivotally supported above open top portions of the picking chamber 262 (via pillow blocks, not numerically designated in the drawings, that are mounted on upper edges of the side walls) to support a plank 304 from which curved sensor plates 306, 308 are suspended to engage the supply roll 298. A cam 310 is mounted on one end of the rod 302 adjacent the second side wall 270 of the picking chamber 262 and a normally closed switch 312 is mounted on the second side wall 270 to be opened by the cam 310 when the supply roll 298 grows to the preselected size. The cam 310 and switch 312 have been schematically illustrated in FIG. 29 and will be discussed below in conjunction with a general discussion of the electric-pneumatic control system of the apparatus 40.

In the output portion 282 of the picking chamber 262, the filament separation assembly 64 includes a picker roll 316 which includes a shaft 318 that extends parallel to the comb 276 and is rotatably supported on the side walls 268, 270 of the picking chamber 262 via conventional bearings (not shown). As shown in FIGS. 13 and 16, the picker roll 316 is further comprised of a series of circular spacer discs 320 interspersed with a series of toothed wheels 322 that provide the picker roll with a large number of teeth 324 (FIG. 13) disposed on the circular periphery of the picker roll 316. Each spacer disc 320 is slightly thicker than the diameter of a comb tooth 278 and is aligned with a comb tooth 278 so that the wheels 322 are interspersed with the comb teeth 278. The diameter of each wheel 322 is chosen so that the teeth 324 thereon will extend slightly through the comb 276 as shown in FIG. 13 and teeth 324 are uniformly distributed about the wheel 322 so that the teeth are uniformly distributed on the picker roll 316. A motor 326 is mounted on the shelf 256 and a conventional belt drive (not shown), located in a guard 327 mounted on the second side wall 270, connects the shaft of the motor 326 to the shaft 318 of the picker roll 316 to turn the picker roll 316 in the direction 328 when the motor 326 is operated. As can be seen in FIG. 12, such turning of the picker roll 316 will cause the teeth 324 thereof to engage filaments of which the supply roll 298 is formed and pull such filaments through the comb 276 into the output portion 282 of the picking chamber 262. A second conventional belt drive (not shown), disposed in a guard 329 on the first side wall 268, connects the shaft 294 of the paddle wheel 288 to the shaft 318 of the picker roll 316 to cause the paddle wheel 288 to turn in the direction 296 as discussed above. During the operation of the apparatus 40, the filament separation assembly 64 is operated intermittently as will be discussed below in conjunction with a general discussion of the apparatus 40 control system. To facilitate this discussion, the motor 326 has been represented schematically in FIG. 33.

As shown in FIGS. 12 and 16, a shelf 330, divided into four parts by vertical partitions 332–336, is mounted on the end wall 266 of the picking chamber 262 and extends between the side walls 268, 270 to form two first output compartments 338 and 340 and two second output compartments 342 and 344 at the output end wall 266 of the picking chamber 262. (Selected ones of the spacer discs 320 are provided with circumferential grooves 345 to receive portions of the partitions as shown for the disc that receives portions of the partition 332 in FIG. 12.) One pair of first and second output compartments, compartments 338 and 342, form a first plenum that provides a source of filaments for a first scale 347, shown in FIG. 19, of the scale assembly 68 and the other pair of first and second output compartments, compartments 340 and 344, form a second plenum that similarly provides a source of filaments for a second scale 349, also shown in FIG. 19, of the scale assembly 68 as will be discussed below. As can be seen in FIG. 12 for the compartment 338, the sides of the compartments facing the picker roll 316 are open to the picker roll 316 and the picker roll 316 is positioned so that the teeth 324 thereof pass closely adjacent the shelf 330 and into the compartments after passing through the comb 276. As will be discussed below, air and filaments are drawn from the compartments by the stream forming assembly 70 for transport of the filaments to the scale assembly 68 and the positioning of the shelf 330 relative to the picker roll 316 defines an air flow path 346 that is restricted to cause a high velocity air flow across the top of the picker roll 316 as the picker roll enters the output compartments 338–344. Such high velocity air stream flow serves to strip filaments from the teeth 324 of the picker roll as the teeth 324 enter the output compartments 338–344. Similarly, the picker roll 316 is positioned a short distance above the picking chamber floor 272 to define an air flow path 348 that is restricted as such path passes under the picker roll 316 and into the output compartments 338–344. The air flow path 348 serves to pull the supply roll 298 tightly against the comb 276 to cause efficient transfer of filaments from the supply roll 298 to the teeth 324 of the picker roll.

As is shown in FIG. 16, the compartments 338–344 into which the output portion 282 of the picking chamber 262 is divided are not all of the same length along the picker roll 316. Rather, the two plenums which the compartments comprise, a first plenum extending form the partition 332 to the end of the picker roll 316 adjacent the first side wall 268 and a second plenum extending from the partition 332 to the end of the picker roll 316 adjacent the second side wall 270, are of equal length because of the central positioning of the partition 332 between the two plenums but the two compartments of each plenum are caused to be of unequal lengths via the positioning of the partitions 334 and 336 shown in FIG. 16. The purpose for making the two compartments in each plenum of unequal length will be discussed below. However, the construction of the two plenums to have equal lengths, in conjunction with the equal spacing of the teeth 278 of the comb 276 and the interspersing of the teeth 278 of the comb 276 with the toothed wheels 322 as shown in FIG. 14 provides a utility which can conveniently be considered at this point. Because of the equal spacing of the wheels 322, the rate at which filaments are drawn into the first plenum to one side of the partition 332 will be the same as the rate at which filaments are drawn into the second plenum to the other side of the partition 332 if the supply roll 298 is uniformly distributed along the comb 276 from the first side wall 268 to the second side wall 270 of the picking chamber 262. On the other hand, the rates at which filaments are drawn into the two plenums can be biased to favor one or the other plenums by causing the supply roll 298 to be concentrated adjacent one or the other of the two side walls 268 or 270. The present invention contemplates such biasing of the flow rates into the two plenums by providing a supply roll concentration assembly 350 that concentrates the supply roll in portions of the input portion 280 of the picking chamber 262 adjacent a selected one of the ends of the picker roll 316. The supply roll concentration assembly, which is illustrated in FIGS. 12 and 14–16, is comprised of: a filament precipitation tower 352 having the general form of a trapezoidal box disposed above the open topped portion of the picking chamber 262 adjacent the input end wall 264 thereof; a filament distribution assembly 354 at the top of the filament precipitation tower; and a deflection assembly 356 mounted on medial portions of the filament precipitation tower. The filament distribution assembly comprises a box-like portion 359 disposed at the top of the filament precipitation tower and having an open lower end so that tufts of filaments introduced into the filament distribution assembly can fall therefrom into the filament precipitation tower 352. At one side of the filament distribution assembly, the box-like portion thereof has a hole 358 that receives the conduit 198 from the blower 194 that draws the tufts of filaments produced by the drum 50 from the filament treatment chamber 66 that the tufts enter when blown from the drum 50. The opposite side of the box-like portion of the filament distribution assembly 354 is open, as indicated by the opening designated 360 in FIG. 14, to permit the air stream that carries the tufts of filaments from the filament treatment chamber to escape from the filament distribution assembly 354. Extending across the box-like portion 359 of the filament distribution assembly, from above the hole 358 to the lower end of the opening 360 is a tuft distributing comb 362 formed of a plurality of parallel rods as shown in FIG. 12 so that the tufts of filaments injected into the filament distribution assembly 354 by the blower 194 will be caught by the comb 362 and will be deflected from the comb 362 into the filament precipitation chamber 352.

The lower end of the filament precipitation chamber 352 extends substantially the width of the input portion 280 of the picking chamber 262 and the height of the filament precipitation chamber 252 is selected such that the downward deflection of tufts of filaments by the comb 362 and subsequent wafting of the tufts of filaments as the tufts drop into the picking chamber 262 will result in a substantially uniform distribution of falling tufts across the width of the picking chamber 262 in the absence of any provision that would concentrate the falling tufts to one or the other side of the filament precipitation chamber 352. Such concentration is effected by the deflection assembly 356 as will now be explained.

As shown in FIGS. 12, 14 and 15, the deflection assembly 356 comprises a first deflector comprised of a shaft 364 pivotally mounted on the filament precipitation tower 352 to extend parallel to the side walls 268, 270 of the picking chamber 262 and a second deflector similarly comprised of a pivotally mounted shaft 366. A plurality of rods 368 extend downwardly from each of the shafts 364, 366, as shown in FIGS. 12 and 14, to form two parallel combs that extend downwardly from the shafts 364 and 366 toward the picking chamber 262. A deflector pneumatic actuating cylinder 384, shown in FIG. 15, is mounted on the filament precipitation tower 352 to pivot the two combs formed on the shafts 364, 366 within the filament precipitation tower 352 between the positions shown in solid and dashed lines and thereby cause falling aggregates to be deflected toward one or the other side walls 268, 270 of the picking chamber 262 to concentrate the supply roll 298 at one or the other end of the picker roll 316. In particular, the deflector comprising the shaft 364 can be shifted to a position closely adjacent a wall 374 of the filament precipitation tower 352 that is substantially aligned with the first side wall 268 of the picking chamber 262 while the lower end of the deflector comprising the shaft 366 is shifted toward laterally medial portions of the picking chamber 262 as shown in solid lines in FIG. 14 or, alternatively, the deflector comprising the shaft 366 can be pivoted to be closely adjacent a wall 376 of the filament precipitation tower 352 that is substantially aligned with the second side wall 270 of the picking chamber 262 while the lower end of the deflector comprising the shaft 364 can be extended toward laterally medial portions of the picking chamber 262 as shown in dashed lines. By pivoting these deflectors into one or the other of the two positions shown, and thereby deflecting falling tufts toward the first or second side wall of the picking chamber 262, the supply roll 298 can be concentrated toward one or the other end of the picker roll 316 to bias the rate at which filamentary material is drawn into one or the other of the two plenums at the output end wall 266 of the picking chamber 262.

Referring to FIG. 15, the deflector pneumatic actuating cylinder 384 that pivots the two deflectors extending from the shafts 364, 366 is connected to the shafts 364, 366 via a link 378 attached to the shaft 364, a link 380 attached to the shaft 366, and a link 382 that connects the distal ends of the links 378 and 380 so that the deflectors are moved in unison, the pneumatic actuating cylinder 384 having a piston rod 386 that connects to the link 380 to effect such movement. Thus, the two deflectors can be simultaneously shifted to the positions shown in solid lines by transmitting compressed air to a first port 388 of the deflector pneumatic actuating cylinder 384 while exhausting a second port 390 thereof and can be simultaneously shifted to the position shown in dashed lines by transmitting compressed air to the second port 390 of the deflector pneumatic actuating cylinder 384 while exhausting the first port 388 thereof. The manner in which compressed air is introduced into one or the other of the ports 388, 390 will be discussed below in conjunction with the discussion of the control system of the apparatus 40, the deflector pneumatic actuating cylinder 384 being illustrated in FIG. 32 for this purpose.

Referring now to FIG. 16, a rectangular hole 392 is formed in the floor 272 of the picking chamber 262 to underlie the two central output compartments 338 and 340 and a tubular structure 394 (FIGS. 12 and 14) is constructed below the hole 392 to provide outlets from the chambers 340, 342. In particular, the structure 394 is divided by a central partition 396, positioned below the partition 332, and holes 398, 400 are formed through walls of the structure 394, at opposite sides thereof (FIG. 14), so that filaments can be drawn from the compartment 338 via the hole 398 and filaments can be drawn from the compartment 340 via the hole 400. Similarly, filaments can be drawn from the compartment 342 via a hole 402 formed through the end wall 266 (FIG. 16) of the picking chamber 262 and filaments can be drawn from the compartment 344 via a hole 404 similarly formed through the end wall 266. The stream forming assembly 70 is connected to the filament separation assembly 64 at the holes 398–404 to draw filaments from the compartments 338–344 and pass the filaments to the scales 347 and 349 as will now be discussed.

Figure 20:
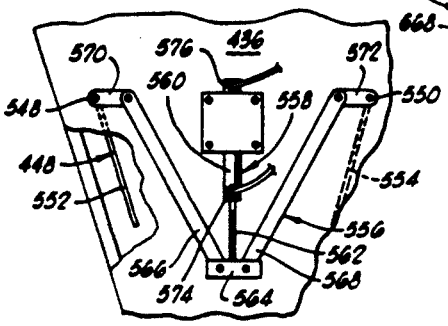
FIG. 20 is a fragmentary view of the scale tower illustrating one of the gates on the scale tower.

The stream forming assembly 70 comprises four stream blowers 406–412 (FIGS. 14 and 16) which, like the drum air blower 54, are conventional centrifugal air blowers and a scale tower 414 that has been illustrated in FIGS. 17–19. As shown therein, the scale tower 414 comprises a rectangular, sheet metal lower section 416 that is supported above the scales 347, 349 by beams 418, 420 which form part of the prop 261 shown in FIG. 3, the section 416 having vertical rear and forward walls, 417 (FIG. 19) and 419 (FIG. 20) respectively and vertical side walls, 421 and 423 respectively. The upper and lower ends of the section 416 are open so that the section 416 forms a tubular structure extending upwardly from the scales 347 and 349. The beams 418, 420 are secured to the supporting frame 236 of the filament separation assembly 64 and extend therefrom to underlay a wooden flange 422 that is secured to the lower section 416 of the scale tower 414 and extends about the upper end of the lower section 416. Legs, one of which is shown in FIG. 3 and designated 424 therein, support portions of the beams 418, 420 near the scale assembly 68 to position the scale tower 414 above and out of engagement with the scales 347 and 349 so that any vibration of the scale tower 414 that might occur will not effect the scales 347 and 349. Two stream gates, indicated at 426 and 428 in FIG. 19 and forming part of the discharge assembly of the apparatus 40, are mounted on the lower end of the section 416 of the scale tower 414, the purpose of such stream gates and their construction to be discussed below.

A plurality of braces 430 are attached to the beam 418, 420 and extend upwardly therefrom to support an intermediate section 432 of the scale tower 414, the intermediate section 432 having a generally tubular structure extending upwardly from the lower section 416 so that filaments introduced into the upper end of the intermediate section 432 can pass sequentially through the intermediate and lower sections of the scale tower 414 to rain down upon the scales 347 and 349. The intermediate section 432 comprises a vertical rear wall 434, a vertical forward wall 436 (FIG. 18) and two sloping side walls 438, 440 (FIG. 19) having lower edges that meet the upper edges of the walls 417, 419, 421 and 423, respectively, of the lower section 416 and extend upwardly therefrom. A partition 442, which is disposed centrally of the side walls 438, 440, extends between the forward and rear walls, 434 and 436 respectively, and from the top of the intermediate section 432 to the bottom of the lower section 416 to divide the space within the interior of the sections 416 and 432 into two tubular chambers, one above each scale 347, 349, so that filaments introduced into the section 432 to one side of the wall 442 will rain down on the first scale 347 while filaments introduced into the other side of the wall 442 will rain down on the second scale 347. Additional partitions, 444 and 446, extend between the rear and forward walls 434, 436 of the intermediate section 432 and from the top of the intermediate section 432 to medial portions thereof to divide upper portions of each of the two regions between the partition 442 and the side walls 438, 440 into two channels by means of which filaments can be deposited on either of the scales 347, 349. Stream gates 448, 450, forming part of the apparatus 40 discharge assembly, are mounted on the intermediate section 432 at the lower ends of the partitions 444 and 446.

Above the intermediate section 432, and partially supported thereby, the scale tower 414 further comprises an upper section 452 which, as shown in FIG. 3, is mounted atop the intermediate section 432 and extends toward the supporting frame 236 of the filament separation assembly 64. Additional support for the upper section 452 of the scale tower 414 is provided by the planks 246 and 248 of the supporting frame 236 as shown for the plank 246 in FIG. 18 and for the plank 284 in FIG. 3.

Returning to FIGS. 17–19, the upper section 452 of the scale tower 414 comprises a floor 454 which terminates at the rear wall 434 of the intermediate section 432 so that filaments which enter portions of the upper section 452 above the intermediate section 432 can fall therefrom through the intermediate section 432 to the scales 347, 349. Side walls 456, 458 extend upwardly from the floor 454 at the lateral sides of the section 452 so that the section 452 has the form of a trough extending from an input end 460 thereof to an output end 462 thereof that overlays the intermediate section 432. The top of the upper section 452 is open, as is the output end 462 thereof, and upper portions of the forward wall 436 of the intermediate section 432 are cut away for a purpose to be discussed below.

The upper section 452 of the scale tower 414 is divided into four channels in the same manner that the intermediate section 432 is so divided; that is, partitions 464–468 are attached to the floor 454 to extend the length of the upper section 452 parallel to the side walls 456 and 458. These partitions are aligned with the partitions 444–446 respectively in the intermediate section 432, as shown in FIG. 19, to carry forward the general construction of the stream forming assembly 70 to include four channels, two for each scale 347, 349, by means of which filaments can be delivered to the scales 347, 349. At the input end 460 of the upper section 452, such section is closed by arcuate covers 470, 472 that close the ends of the outer two channels formed by the partitions 464–468 and a bulkhead 474 that closes the ends of the inner two such channels.

Holes 476 and 478 are formed in the bulkhead 474 to provide openings into the two channels adjacent the partition 464 and the holes 476 and 478 receive the ends of tubes 480 and 482 respectively that lead to the outlets of the stream blowers 406 and 408 respectively. The inlet 484 (FIG. 14), of the stream blower 406 is disposed in the hole 398 in the side of the tubular structure 294 so that the stream blower 406 will draw filaments from the output compartment 338 (FIG. 16) of the picking chamber 262 and deliver such filaments through the tube 480 to the scale tower 414, along the upper section 452 through the trough formed by the partitions 464 and 466, and down the intermediate section 432 and lower section 416 of the scale tower 414, to the left of the partition 442 in FIG. 19, to deposit such filaments on the first scale 347. Similarly, the inlet 486 (FIG. 14) of the stream blower 408 is disposed in the hole 400 in the side of the tubular structure 294 so that the stream blower 408 will draw filaments from the output compartment 340 (FIG. 16) and deliver such filaments to the second scale 349 via the tube 482 and the scale tower 414, the filaments passing immediately to the right of the partitions 442 and 464 as seen in FIG. 19 in traversing the scale tower 414 to the second scale 349.

Similarly, and as shown in FIGS. 17 and 18, holes 488 and 490 are formed through the floor 454 of the upper section 452 of the scale tower 414 near the input end 460 of the section 452 to receive tubes 492 and 494 respectively (FIG. 16) connected to the outlets of the stream blowers 410 and 412 respectively. The inlet 496 of stream blower 410 is disposed in the hole 402 through the output end wall 266 of the picking chamber 262 so that the stream blower 410 will draw filaments from the output compartment 342 of the picking chamber 262 and deliver such filaments to the first scale 347 via the tube 492 and the scale tower 414, these filaments passing along the side wall 456 of the upper section 452 of the scale tower 414 and thence along the side wall 438 of the intermediate section 432 and through the lower section 416 to the first scale 347. Similarly, the inlet 498 of the stream blower 412 is disposed in the hole 404 through the output end wall 266 of the picking chamber 262 so that the stream blower 412 will draw filaments from the output compartment 344 of the picking chamber 262 and deliver such filaments to the second scale 349 via the tube 494 and the scale tower 414, these filaments passing along the side wall 458 of the upper section 452 of the scale tower 414 and thence along the side wall 440 of the intermediate section 432 and through the lower section 416 to the second scale 349.

It will thus be seen that the stream blowers 406–412 draw four streams of filaments from the picking chamber 262, two streams being passed through the scale tower 414 to each of the scales 347 and 349. For purposes of discussion, especially with respect to the control of the apparatus 40, it will be useful to refer to the streams to each scale as first and second streams and to similarly identify components involved in the production and control of such streams. Thus, the stream blowers 406 and 408 are first stream blowers that draw first streams of filaments from two first output compartments (compartments 338 and 340) of the picking chamber 262 and deliver one of these first streams to the first scale 347 and the other of these first streams to the second scale 349. Such delivery is effected via two first stream conduits, comprised of the tubes 476 and 478 and portions of the scale tower 414 immediately to either side of the partitions 464 and 442 in the upper and intermediate sections 452 and 432 respectively of the scale tower 414. Each of these first stream conduits has a discharge opening above one of the scales, such opening being formed by the open lower end of the lower section 416 of the scale tower 414 and the division of the lower section 416 into two isolated regions by the partition 442. The discharge opening of the first stream conduit above the first scale 347 can be closed by a first stream gate (gate 426) and the discharge opening of the first stream conduit above the second scale 349 can similarly be closed by another first stream gate (the gate 428).

Similarly, the blowers 410 and 412 are second stream blowers that draw two second streams of filaments from two second output compartments (compartments 342 and 344) of the picking chamber 262 and deliver one of the second streams to the first scale 347 and the other of the second streams to the second scale 349. Such delivery is effected via two second stream conduits, comprised of the tubes 492 and 494 and portions of the scale tower 414 extending along the side walls 456 and 458 of the upper section 452 and the side walls 438 and 440 of the intermediate section 432. Each of these second stream conduits has a discharge opening above one of the scales, such openings being formed by the spaces between the partitions 444, 446 in the intermediate section 432 and the side walls 432 and 440 of the section 432. Each of these discharge openings can be closed by a second stream gate, the gate 448 constituting the second stream gate above the first scale 347 and the gate 450 constituting the second stream gate above the second scale 349.

The provision of first and second streams of filaments to each of the scales 347, 349 and the derivation of the first streams from first output compartments (compartments 338 and 340) of the picking chamber 262 that are shorter than the second output compartments (compartments 342 and 344) from which the second streams are derived permits charges of filamentary material to be rapidly accumulated on the scales 347, 349 without loss of accuracy in the weight in each charge. In particular, because of the relative lengths of the output compartments from which the first and second streams to each scale are derived, and the equal spacing of the toothed wheels 322 of the picker row 316, the transport rate of filaments in the second stream to each scale is greater than the transport rate of filaments in the first stream to such scale so that rapidity of accumulation of a charge on a scale can be effected by using both streams to the scale to partially accumulate a charge on the scale and accuracy of the weight of the charge can be achieved by completing the accumulation of a charge with only the first stream of filaments to the scale. The contruction and operation of the first and second stream gates above each of the scales 347, 349 to effect such mode of accumulating a charge on a scale will be discussed below.

It will be seen from the above description of the connection between the stream forming assembly 70 and the picking chamber 262 formed by the position of the stream blowers 406–412 on the picking chamber 262 and the positioning of the discharge openings of the stream conduits of the assembly 70 above the scales 347, 349 that all filaments drawn into the first plenum formed by the first output compartment 338 and the second output compartment 342 will be delivered by the stream forming assembly 70 to the first scale 347 while all filaments drawn into the second plenum formed by the first output compartment 340 and the second output compartment 344 will be delivered by the stream forming assembly 70 to the second scale 349. Such relationship between the two plenums and the two scales, together with the biasing of filament flow rates into the two plenums to favor one or the other of the two plenums by the supply roll concentration assembly 350 that has been discussed above, is utilized to synchronize the production of charges from the two scales 347, 349 as will now be discussed.

As has been noted, the apparatus 40 includes a discharge assembly, comprised in part of the stream gates 426, 428, 448 and 450, that causes each charge that is accumulated on one of the scales to be discharged from such scale. As will be discussed below, the discharge assembly is constructed to transmit compressed air to the port 390 of the deflector pneumatic actuating cylinder 384 shown in FIG. 15, while exhausting the port 388, each time the first scale 347 is discharged and to transmit compressed air to the port 388 of the deflector pneumatic actuating cylinder 384 each time the second scale 349 is discharged while exhausting the port 390. (The transmission of compressed air to the port 388 while exhausting the port 390 constitutes a first pneumatic signal transmitted to the deflector pneumatic actuating cylinder 384 and the transmission of compressed air to the port 390 while exhausting port 388 constitutes a second pneumatic signal transmitted to the deflection pneumatic actuating cylinder 384.) The transmittal of compressed air to the port 390 and exhaustion of port 388 moves the rods 368 of the deflection assembly 356 to the positions shown in dashed lines in FIG. 14 to concentrate the supply roll 298 in portions of the picking chamber 262 along the sidewall 270 adjacent which the second plenum (output compartments 340, 344) are disposed so that such positioning of the deflection assembly 356 will enhance the drawing of filaments into the second plenum while slowing the drawing of filaments into the first plenum. Thus, each time the first scale 347 is discharged the deflection assembly 356 adjusts the filament flow rates to the scales to cause the flow rate of filaments to the second plenum and thence to the second scale 349 to be enhanced and the flow rate of filaments to the first plenum and thence to the first scale to be reduced. Similarly, each time the second scale 349 is discharged, such discharge being accompanied by the transmission of compressed air to the port 388 of cylinder 384, the deflection assembly 356 causes the flow rate of filaments to the first plenum and thence to the first scale 347 to be enhanced and the flow rate of filaments to the second plenum and thence to the second scale 349 to be reduced. Thus, filaments are accumulated on each of the scales 347, 349 at two rates, a high rate corresponding to the concentration of the supply roll 298 along portions of the picker roll 316 aligned with the plenum from which the filaments are delivered to a particular scale and a low rate corresponding to the concentration of the supply roll 298 along portions of the picker roll 316 aligned with the other plenum. (The provision of two streams of filaments to each scale will not interfere with this two flow rate delivery of filaments to the scales. As will be discussed below, the two stream gates above a scale are closed while the scale is discharged and, at such times that one or both of the stream gates above a scale in the scale tower 414 is closed, filaments are accumulated on the stream gate to be subsequently deposited on the scale underlying the stream gates. The accumulation of filaments on one or both of the stream gates above a scale permits the flow of filaments to a scale to be temporarily discontinued while the scale is discharged without decreasing the overall transport rate of filaments to the scales. That is, the net effect of accumulating the filaments on the stream gates while a scale is being discharged is the same that would be achieved if each scale were instantaneously discharged while filaments were delivered to the scale at a constant flow rate equal to the sum of the two flow rates in each of the two streams to the scale. Thus, the provision of the two streams of filaments to each scale and the temporary interruption of these streams to cause accurate weighing of a charge and, subsequently, the discharge of an accumulated charge from the scale has no effect on the overall rate at which each charge is accumulated. Rather, the accumulation merely takes place, at the high or low rate determined by the position of the supply roll 298 in the picking chamber 262, on the stream gates above the scales at the start of each time period in which a charge is accumulated.) Since the deflection assembly is positioned to favor one scale each time the other scale is discharged, the accumulation of a charge on each scale following discharge of such scale initially occurs at the low rate and is increased to the high rate when the other scale is discharged. The manner in which these two flow rates of filaments to a scale (or, equivalently, to a stream gate above a scale) synchronizes the discharge of the charges from the two scales can be seen from an example.

Initially, it will be noted that the bilateral symmetry of the picking chamber 262 and the stream forming assembly 70 results in an equivalence between the two scales and the streams of filaments to the two scales. That is, any analysis of the transport of filaments to one scale would apply equally well to the transport of filaments to the other scale. Thus, if the discharge of one scale were centered in the time interval during which a charge is accumulated on the other scale and conditions were ideal, such temporal centering of the discharge of one scale on the accumulation period for the other scale would continue as the apparatus 40 continues to operate. During half the time interval in which a charge is accumulated on the first scale, less than half a charge would accumulate on the first scale. The second scale would then discharge to increase the accumulation rate on the first scale so that the greater portion of a charge would accumulate on the first scale during the second half of the first scale's accumulation time interval. The same mode of accumulation of a charge on the second scale would occur because of the above mentioned equivalence between the two scales. Should a charge accumulate prematurely on one of the scales because of non-ideal conditions in the transport of filaments to the scales such as, for example, an inhomogeneity in the supply roll 298, the flow rate to that scale would prematurely drop to the low rate of accumulation to lengthen the time interval during which the next charge on that scale would accumulate while the flow rate to the other scale would prematurely undergo a transition to the high rate of filament accumulation to shorten the time interval during which a charge is currently being accumulated on such other scale. The premature transition for such other scale to the high rate would result in a tendency of such other scale to catch up to the prematurely discharged scale while the premature transition to the low rate for the scale which is discharged prematurely would bring the prematurely discharged scale back on schedule. Thus, the construction of the picking chamber 262 and the stream forming assembly 70 together with the provision of the supply roll concentration assembly 350 and the movement of the deflection assembly 356 to favor the accumulation of filaments on one scale each time the other scale is discharged tends to cause each charge accumulated on one of the scales to be discharged therefrom at the midpoint of the time interval during which a charge is accumulated on the other scale. This synchronization of the two scales enables the rate of production of charges by the apparatus 40 to be optimized without causing the completion of the accumulation of two charges, one on each scale, to occur in such rapid succession that discharge of the two scales would have to occur within a time period that would cause mingling of the two charges from the two scales if over-accumulation of a charge on one of the scales is to be prevented. As will be discussed below, mingling of two charges, one from each scale, is prevented by disabling the discharge of one scale while the other scale is discharging so that, the above described synchronization of the accumulation of the charges on the scales prevents excessively large charges from being accumulated on a stream gate above a scale. Optimization of the charge production rate can be carried out by selecting the speed with which the picker roll 316 is rotated; for example, by using a variable speed motor for the motor 326.

The construction of the upper section 452 of the scale tower 414 also enters into the accurate fixing of the weights of the charges that are accumulated on the scales in a manner that will now be discussed. As will be appreciated by those skilled in the art, air currents impinging on the scales can disturb the scales and present a severe problem where the scale has the requisite sensitivity to accurately measure the weight of a light object. In an important application of the present invention, the charges weighed by the scales are small quantities of the material commonly known as Easter grass and the charges are packaged for consumer sales in lots weighing but a few ounces. Moreover, and as will be discussed below, the scales 347, 349 are automatically discharged each time a charge accumulates on a scale to a preselected weight so that air currents impinging on the scales 347, 349 could result in some charges produced by the apparatus 40 being overweight and other charges being underweight. The construction of the scale tower 414 as has been described insulates the scales 347, 349 from the effects of air currents produced by the stream blowers 406–412 in transporting filamentary material from the picking chamber 262 to the scales 347, 349. In particular, the filamentary material is introduced into the scale tower 414 at a height above the scales 347, 349 and, moreover, the air streams which carry the filaments are caused to flow generally horizontally and upwardly through upper portions of the scale tower 414 and be discharged from the top and output end 462 of the upper section 452 of the scale tower 414. Such flow is occasioned by directing the streams of filaments leaving the tubes 480, 482, 492 and 494 from the stream blowers 406–412 along the floor 454 of the upper section 452 of the scale tower 414 and leaving the top of the upper section 452 uncovered so that the stream conduits from the stream blowers 406–412 to the scales 347, 349, such stream conduits being formed by the tubes 480, 482, 492 and 494 and the interior of the scale tower 414 as has been discussed, are each provided with a horizontal trough-like portion above the scales from which air may escape from the stream conduits such portions of the conduits being the portions of the conduit formed by the upper section 452 of the scale tower 414. As can be seen in FIGS. 17 and 19, the two first streams of filaments will be flowing in a horizontal direction as these streams enter the upper section 452 of the scale tower 414 from the tubes 480, 482 so that the filaments in such streams will be deposited on the floor 454 of the upper section 452 by the expansion the air streams will undergo when the air that transmits the filaments is permitted to escape from the top of the section 452. Residual horizontal air currents move the filaments along the floor 454 and then escape from the open output end 462 of the section 452. Similarly, the second streams of filaments enter the upper section 452 of the scale tower 414 via the tubes 492 and 494 and are immediately turned to the horizontal direction by the arcuate covers 470, 472 at the input end 460 of the section 452 to enter the open-topped channels at the sides of the upper section 452 formed by the side walls 456, 458 and partitions 466, 468 of the upper section 452. The filaments in these streams are deposited on the floor 454 of the section 452 while the air stream which carry these filaments are dissipated from the open top of the section 452 leaving only residual air currents to move the filaments along the floor 454. Such residual air currents escape from the open output end 462 of the section 452 after moving the filaments to the opening at the top of the intermediate section 432 of the scale tower 414. The escape of the residual air currents from the scale tower 414 is faciliated by cutting away upper portions of the forward wall 436 of the intermediate section 432 of the scale tower 414 as shown in FIG. 18.

As has been noted, the transport rate of filaments in the two first streams which flow along the central two troughs of the upper section 452 of the scale tower 414, to either side of the partition 464, is smaller than the transport rate of the filaments in the two second streams that flow along the outside troughs along the side walls 456 and 458 of the upper section 452 of the scale tower 414 so that the first stream blowers 406, 408 need have only a moderate air delivery capacity while the second stream blowers 410, 412 will have a greater capacity. It has been found that, for suitable transport rates for the production of Easter grass, filaments in the first stream can be prevented from escaping from the apparatus 40 by mounting a screened cover 500 over the open output end 462 of the upper section 452 as shown in FIG. 18. Such cover can conveniently be constructed in the form of an open-ended box having one end abutting the forward bulkhead 436 of the intermediate section 432 of the scale tower 414 and having metal screening material mounted over the other end thereof. Where the transport rate of filaments in a stream is large enough that the air currents transporting the filaments can be strong enough to carry filaments from the apparatus 40, as can be the case for the second streams of filaments to the scales 347, 349, the upper section 452 can be provided with a plurality of combs 502 that can be mounted on the top of the upper section 452 to permit air to escape from the top of the upper section 452 and output end 462 thereof while blocking the passage of filaments from the scale tower 414. The combs 502 can conveniently be constructed by mounting a plurality of rods 504, as shown in FIG. 18, in a wooden runner 506 to extend laterally from the runner 506, the runners 506 then being attached to the top of the upper section 452 of the scale tower 414 as shown in FIGS. 17 and 19.

Figure 21:
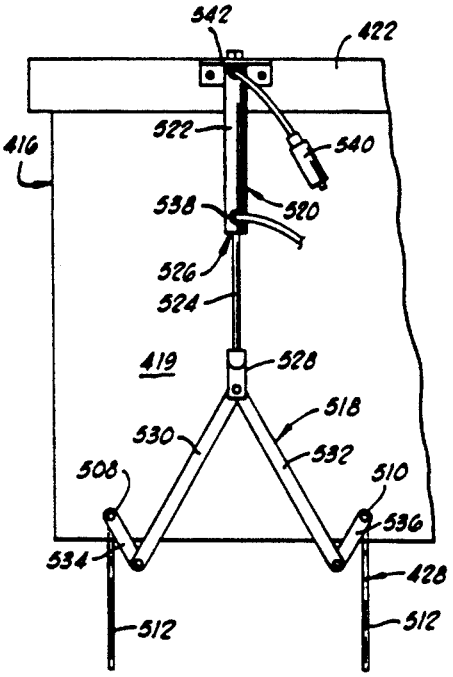
FIG. 21 is a fragmentary view of the scale tower illustrating another of the gates on the scale tower.

The stream gates 426, 428, 448 and 450 have a standardized construction, each stream gate comprising two spaced apart, parallel shafts that are pivotable about their longitudinal axes and a plurality of spaced rods extending laterally from each of the pivoting shafts. Thus, as illustrated in FIGS. 19 and 21, the first stream gate 426 above the first scale 347 is comprised of two pivoting shafts 508 and 510 that are mounted on the lower end of the lower section 416 of the scale tower 414 to extend between the rear and forward walls, 417 and 419 respectively, of the section 416 parallel to the walls 421 and 423 thereof. A plurality of parallel rods 512 (only one rod 512 is shown in the drawings) extend laterally from the shaft 508 and a plurality of parallel rods 514 (only one rod 514 has been shown in the drawings) extend laterally from the shaft 510. The pivoting shafts 510 and 508 extend along the partition 442 and the wall 421 respectively and the lengths of the laterally extending rods 512 and 514 are selected so that the gate 426 can be placed in a closed position shown in FIG. 19 in which the laterally extending rods 512, 514 extend across the discharge opening above the first scale 347 to catch filaments falling through the scale tower 414. Conversely, the stream gate 426 can be placed in an open position shown in FIG. 21 in which the rods 512 and 514 extend downwardly from the shafts 508 and 510 respectively to permit filaments falling through the scale tower 414 to drop through the lower end of the lower section 416 to the first scale 347. The first stream gate 428 above the second scale 349 is identical to the first stream gate 426 above the first scale 347 and is mounted above the second scale 349 in the same manner that the stream gate 426 is mounted above the first scale 347 so that the construction and mounting of the stream gate 428 need not be discussed herein.

The pivoting shafts 508 and 510 of the stream gate 426 are supported above the first scale 347 via holes (not shown) formed through the walls 417 and 419 of the lower section 416 of the scale tower 414 and holes (not shown) formed through a wooden framework 516 (FIG. 19) that extends about the opening of the section 416 at the lower end thereof. A first stream gate pneumatic actuating cylinder 520 is mounted on the forward wall 419 of the lower section 416 to open and close the stream gate 426 and an identical first stream gate pneumatic actuating cylinder is mounted on the wall 419 to similarly open and close the first stream gate 428.

The first stream gate pneumatic actuating cylinder 520 has a barrel 522 suspended from the frame 422 about the upper end of the lower section 416 of the scale tower 414 to extend downwardly along a line equidistant from the pivoting shafts 508, 510 and a piston rod 524 extends downwardly from the lower end 526 of the barrel 522 to connect to the shafts 508, 510 via a mechanical linkage 518. This linkage is comprised of a connector 528 attached to the lower end of the piston rod 524, two intermediate links 530 and 532 pivotally attached to the connector 528, and two terminal links 534 and 536 that are pivotally attached to the links 530 and 532, respectively, and rigidly attached to the pivoting shafts 508 and 510, respectively. As will be clear from FIG. 21, the stream gate 426 can be closed by drawing the piston rod 524 into the barrel 522, thereby lifting the links 530–536 to pivot the shafts 508 and 510 in directions to lift the rods 512 and 514, and can be opened by permitting the piston rod 524 to drop from the barrel 522 to the position as shown in FIG. 21. The barrel 522 contains a piston (not shown) attached to the piston rod 524 so that the stream gate 426 can be closed via compressed air introduced into a port 538 at the lower end of the barrel 522 and can be opened by releasing pressure at the port 538 to permit the stream gate 426 to open of its own accord via the weight of the rods 512 and 514 of which the stream gate 426 is comprised. It is desirable in the operation of the apparatus 40 that the first stream gates 426, 428 open slowly but close rapidly and a flow control valve 540 connected to a port 542 at the top of the barrel 522 is provided for this purpose. The flow control valve 540 is of the type containing an orifice and a check valve in parallel fluid connection and is connected to the port 542 so that the check valve will open to permit air in the upper portions of the barrel 522 to be rapidly exhausted, thereby insuring rapid closing of the stream gate 426, but will close when air flows through the valve 540 to the barrel 522 to cause the stream gate 426 to slowly open. The rapid closing of the stream gate 426 provides a substantially instantaneous cut-off of filaments flowing to the scale 347 so that the weights of charges accumulated on such scale will be accurately determined and the slow opening of the stream gate 426 minimizes mechanical shock to the scale 347 when the stream gate 426 opens and drops filaments accumulated thereon onto the scale 347. The control of the opening and closing of the stream gate 426 will be discussed below in conjunction with a discussion of the electric-pneumatic control system for the apparatus 40 and, in order to facilitate such discussion, the pneumatic actuating cylinder 520 and control valve 540 have been schematically shown in FIG. 32. A first stream gate pneumatic actuating cylinder that opens and closes the first stream gate 428 above the second scale 349 is similarly mounted on the wall 419 in the same manner that the first stream gate pneumatic actuating cylinder 520 is mounted on the wall 419 and is connected to the first stream gate 428 via a linkage identical to the linkage 518. Similarly, a control valve identical to the control valve 540 is connected to the first stream gate pneumatic actuating cylinder that opens and closes gate 428 in the same manner that the valve 540 is connected to the cylinder 520 and for the same reason. The first stream gate pneumatic actuating cylinder and control valve provided for the gate 428 have also been illustrated in FIG. 32 and designated by the numerals 544 and 546 respectively therein. Corresponding to the ports 538 and 542 of the first stream gate pneumatic actuating cylinder 520, the cylinder 544 has ports 545 and 547 respectively.

The second stream gates 448 and 450 are constructed in the same manner that the first stream gates 426 and 428 are constructed, the second stream gate 448 above the first scale 347 comprising two spaced apart, parallel shafts 548 and 550 that are supported on medial portions of the intermediate section 432 of the scale tower 414 via holes (not shown) formed through the rear and forward walls, 434 and 436 respectively, of the section 432 and a plurality of parallel rods 552 and 554 extending from the pivoting shafts 548 and 550 respectively. (Only one each of the rods 552 and 554 have been illustrated in the drawings.) The second stream gate 450 is constructed identically to the second stream gate 448 and is mounted on the intermediate section 432 in a manner identical to the mounting of the second stream gate 448 on the intermediate section 432 so that the construction and mounting of the second stream gate 450 need not be considered further herein. As can be seen in FIG. 19, the pivoting shaft 550 underlies the lower edge of the partition 444 and the pivoting shaft 548 is disposed along the side wall 438 of the intermediate section 432 so that the second stream gate 448 can be pivoted to a closed position shown in FIG. 19 in which the rods 552 and 554 extend between the partition 444 and the wall 438 to close the discharge opening of the second stream conduit that opens above the first scale 347 so that filaments passing through such stream conduit will be caught by the rods 552 and 554. The second stream gate 448 can also be disposed in an open position shown in FIG. 20 in which the rods 552 and 554 extend downwardly from the pivoting shafts 558, 550 to permit filaments moving in the second stream along the wall 438 of the intermediate section 432 of the scale tower 414 to pass through the second stream gate 448 to the first scale 347.

A second stream gate pneumatic actuating cylinder 558 is mounted on the forward wall 436 of the intermediate section 432 of the scale tower 414 to move the second stream gate 448 between the open and closed positions, the second stream gate pneumatic actuating cylinder 558 having a barrel 560 vertically supported on the forward wall 436 of the intermediate section 432 of the scale tower 414 and a piston rod 562 extending from the lower end of the barrel 560. The second stream gate pneumatic actuating cylinder 558 is connected to the second stream gate 448 via a linkage 556 comprising a connector 564 attached to the lower end of the piston rod 562; two intermediate links 566 and 568 pivotally connected to the connector 564; and two terminal links 570 and 572 pivotally connected to the links 566 and 568, respectively, and rigidly connected to the pivoting shafts 548 and 550, respectively. The barrel 560 of the pneumatic actuating cylinder 558 contains a piston (not shown) connected to the piston rod 562 so that, as can be seen from FIG. 20, compressed air can be introduced into a port 574 at the lower end of the barrel 560 while air is exhausted from a port 576 at the upper end of the barrel 560 to move the gate 448 into the closed position thereof and compressed air can be introduced into the port 576 while exhausting air from the port 574 to move the gate 450 to the open position thereof. The control of the second stream gate pneumatic actuating cylinder 558 will be discussed below in conjunction with a discussion of the electric-pneumatic control system for the apparatus 40 and, for the purpose of facilitating such discussion, the pneumatic actuating cylinder 558 has been schematically illustrated in FIG. 33. A second stream gate pneumatic actuating cylinder and a connecting linkage identical to linkage 556 are similarly mounted on the wall 436 to open and close the second stream gate 450 above the second scale 347. The pneumatic actuating cylinder provided to open and close the gate 448 has also been shown in FIG. 33 and designated by the numeral 578 therein. The cylinder 578 has ports 579 and 581 corresponding to the ports 574 and 576 respectively of the cylinder 558.

The scales 347, 349, which are identical, are conventional platform scales so that the scales 347, 349 need be illustrated only schematically herein and need not be described in detail. Rather, it will suffice for purposes of the present disclosure to refer only to those features of the scales 347, 349 that enter into the operation of the present invention. The scales 347, 349 each include a base 580 which supports a platform 582 so that the platform of each scale will move vertically in proportion to the weight of material that such platform supports. Each scale has a pivoting weight indicator arm, the weight indicator arm of the first scale 347 being shown in FIG. 22 and designated by the numeral 584 therein, and a mechanical linkage is provided between the platform of each scale and the weight indicator arm thereof so that vertical movement of the platform of the scale swings the weight indicator arm in a vertical arc as has been indicated by the direction arrow 586 for the weight indicator arm 584 shown in FIG. 22.

In the practice of the present invention, first and second masks, 588 and 590 respectively, are mounted on the weight indicator arm 584 of the first scale 347, the masks 588 and 590 extending in the direction 586 in which the weight indicator arm 584 moves as charge accumulates on the first scale 347. The masks 588, 590 are used to sequentially trigger two identical optical sensor circuits that form part of the control system of the apparatus 40, one of the optical sensor circuits being schematically illustrated in FIG. 30 and designated by the numeral 602 therein. For purposes of discussion, the optical sensor circuit shown in FIG. 30 will be considered to be the optical sensor circuit associated with the first mask 588 shown in FIG. 22. It will be understood that the apparatus 40 includes three additional such circuits; that is, one such circuit associated with the mask 590 on the weight indicator arm 584 and two such circuits associated with masks identical to the masks 588 and 590, that are mounted on the weight indicator arm of the second scale 349.

Figure 22:
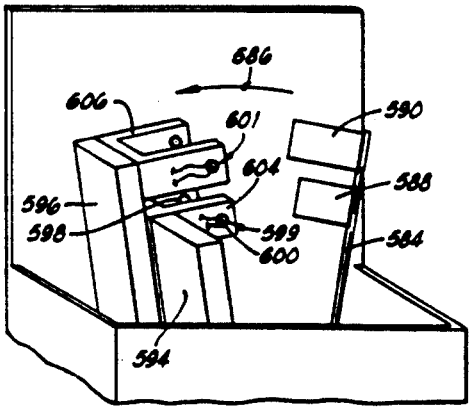
FIG. 22 is a fragmentary isometric view of an optical sensor used to detect the presence of a charge and a fraction of a charge on the scale of the apparatus.

The weight indicator arms of the scales 347, 349 are disposed in shrouds 592 that are mounted on a cabinet 605 (FIG. 19) that support the scales 347, 349 and a pair of sensor mounts are disposed within each of the shrouds 592 provided for the weight indicator arms of the two scales 347, 349. Thus, for the first scale 347, the shroud that is positioned about the weight indicator arm 584 includes a first sensor mount 594 and a second sensor mount 596 that each comprise a U-shaped portion, portion 604 for the mount 594 and portion 606 for the mount 596, that are disposed about the paths along which the masks 588 and 590 respectively move as filaments accumulate on the first scale 347. An optical sensor 599, forming a part of the optical sensor circuit 602, comprises a photocell 598 and a lamp 600 mounted on the U-shaped portion 604 of the sensor mount 594 so that the photocell 598 is to one side of the path that the first mask 588 follows as the weight indicator arm 584 pivots in response to the accumulation of a charge on the first scale 347 and the lamp 600 is to the other side of such path and positioned to direct a beam of light across such path to the photocell 598. Thus, at some point in the movement of the weight indicator arm 584, the mask 588 will enter the portion 604 of mount 594 to move between the photocell 598 and the lamp 600 and trigger the circuit 602 into operation as will be discussed below. Similarly, the mount 596 contains an optical sensor 601 to trigger a circuit identical to the circuit 602 when the second mask 590 enters the U-shaped portion 606 of the second mount 596. It will be noted that the mask 590 is longer than the mask 588 and the optical sensors in the mounts 594 and 596 are aligned along a radius extending from the pivot point of the weight indicator arm 584 so that the light beam between the lamp and photocell of the optical sensor 601 will be interrupted before the light beam between the photocell 598 and lamp 600 will be interrupted. As will be discussed below, the circuits of which the two optical sensors shown in FIG. 22 are a part are used to cause the control system of the apparatus 40 to interrupt the second stream of filaments to the first scale 347 when a preselected portion of a charge having a preselected weight has accumulated on the first scale 347 and to interrupt the first stream of filaments to the first scale 347 and discharge filaments which have accumulated on the first scale 347 from such scale once a complete charge having the preselected weight has accumulated on the first scale 347. Such operation of the control circuit is caused by the sequencing of the interruption of the light beams between the lamps and photocells of the two optical sensors shown in FIG. 22 arising from the greater length of the mask 590 with respect to the mask 588. That is, the optical sensor circuit of which the optical sensor 601 is a part is utilized to interrupt the second stream of filaments to the first scale and the optical sensor 599 is utilized to interrupt the first stream of filaments to the first scale 347 and initiate the discharge of filamentary material from the first scale 347. A similar scheme of operation is provided for the second scale 349 by providing identical first and second masks (not shown) on the weight indicator arm (not shown) of the second scale, providing identical first and second photocell mounts (not shown) and optical sensors (not shown) positioned in a manner identical to that shown in FIG. 22 for the second scale, and by including the optical sensors in optical sensor circuits (not shown), identical to the sensor circuit 602, provided for the second scale 349.

As shown in FIG. 30, the optical sensor circuit 602 includes a time delay relay 608 having characteristics that will be discussed below in a discussion of the optical sensor circuit 602. Similarly, the optical sensor circuit associated with the second mask 590 on the weight indicator arm 584 of the first scale 347 includes an identical time delay relay and identical time delay relays are similarly included in the optical sensor circuits associated with the two masks mounted on the weight indicator arm of the second scale 349. In order to faciliate the discussion of the electric-pneumatic control circuit of the apparatus 40 to be given below, these four time delay relays have been illustrated in FIG. 31 and have been numbered therein as follows: the time delay relay of the optical sensor circuit associated with the first mask 588 on the weight indicator arm of the first scale 347 has been numbered 608 in accordance with the designation of the circuit 602 in FIG. 30 as the optical sensor circuit associated with the mask 588; the time delay relay of the optical sensor circuit associated with the second mask 590 on the weight indicator arm 584 of the first scale 347 has been designated by the numeral 610; the time delay relay of the optical sensor circuit associated with the first mask mounted on the weight indicator arm of the second scale 349 has been designated by the numeral 512; and the time delay relay of the optical sensor circuit associated with the second mask on the weight indicator arm of the second scale 349.

Returning now to FIG. 19, pans 616 and 618 are placed on the scales 347 and 349 respectively to confine filaments falling from the scale tower 414 to selected regions of the scales from which filments can be discharged each time a charge having the preselected weight accumulates on a scale. To this end, each pan 616, 618 has a U-shaped cross section and is open at its ends so that a charge of filaments can be discharged from a scale by directing a stream of air through the pans 616 or 618 thereon from one end of the pan to the other end thereof. To provide such streams of air, the discharge assembly comprises a first manifold 620 supported on the cabinet 605 adjacent the first scale 347 and a second manifold 622 similarly mounted on the cabinet 605 adjacent the second scale 349 so that the manifolds 620, 622 are disposed side-by-side and aligned with the pans 616, 618 as shown in FIG. 19. The manifolds 620, 622 are tree-like structures formed of metal tubing and a plurality of holes (not numerically designated in the drawings) are formed through the tube walls of the manifolds 620, 622, at sides thereof facing the scales 347, 349, so that the connection of one of the manifolds to a source of compressed air will cause a plurality of jets of air to issue from such manifold toward filamentary material on the pan, 616 or 618, with which the manifold is aligned. (The tree-like structures of the manifolds permits the jets to be positioned to sweep the interior surfaces of the pans 616 and 168 to insure that filaments electrostatically clinging to the pans will be blown therefrom.) In order to prevent air issuing from one manifold from disturbing the scale aligned with the other manifold, a partition 624 is suspended from the lower section 416 of the scale tower 414 to be disposed between the scales 347, 349, the pans 616, 618 and the manifolds 620, 622. Additionally, a shroud 625 (FIG. 3) can be mounted about the scales 347, 349 to prevent ambient air currents from disturbing the scales 347, 349. The shroud 625 has not been illustrated in FIG. 19.

Figure 23:
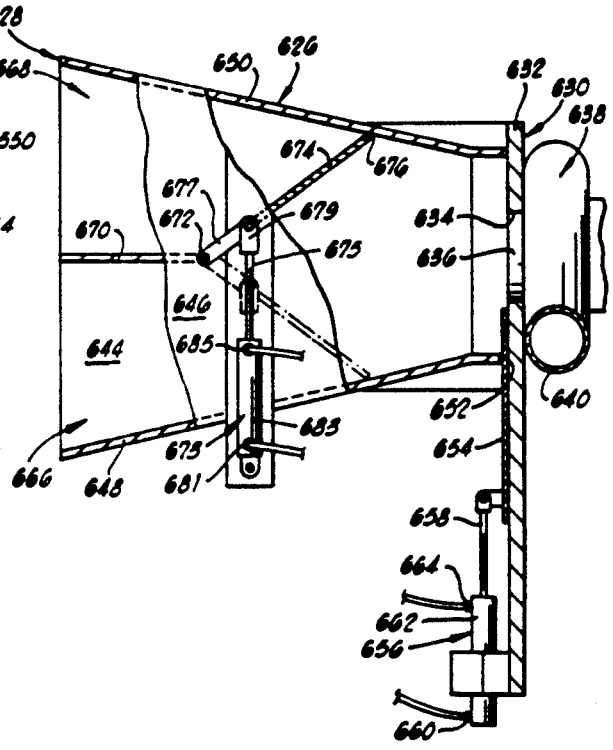
FIG. 23 is a plan view in partial cross section of the discharge chute which receives charges of filamentary material blown from the scales of the apparatus.

At the ends of the pans 616, 618 opposite the manifolds 620, 622, the discharge assembly further comprises a discharge chute 626 that has been illustrated in FIG. 23. The discharge chute 626 has an input end 628 which, as shown in FIG. 3, faces the scale assembly 68 and the input end of the discharge chute is open so that charges of filamentary material blown from the scales will enter the discharge chute 626. Opposite the input end 628 thereof, the chute 626 has an output end 630 across which extends an end wall 632 having an opening 634 so that the discharge chute has a generally open-ended structure. The opening 634 receives the inlet 636 of a magazine transfer blower 638 which, like other blowers used in the apparatus 40, is a conventional centrifugal blower. The outlet of the magazine transfer blower 638 is connected via a tube 640 (FIGS. 1 and 3) to the charge storage magazine 72 so that charges blown into the discharge chute 626 can be transferred by the magazine transfer blower 638 to the magazine 72.

As particularly shown in FIG. 3, the discharge chute 626 is supported by a cabinet 642 so that the discharge chute can be placed adjacent to, but not in contact with, the scale assembly 68. Thus, the scale assembly 68 is mechanically isolated from remaining elements of the apparatus 40 so that vibration of such elements will have no effect on the scales 347, 349 thereby permitting accurate measurement of charges of filamentary materials on the scales 347, 349.

Returning to FIG. 23, the discharge chute 626 is comprised of: a floor 644 that extends along the bottom of the chute 626 from the input end 628 to the output end 630; a cover 646 that similarly extends the length of the chute 626 between the ends 628 and 630 above the floor 644; a first side wall 648 extending between the floor 644 and cover 646 from the input end 628 to the end wall 632; and a second side wall 650 extending between the floor 644 and cover 646 from the input end 628 to the end wall 632. A slot 652 is formed in the end of the side wall 648 adjacent the end wall 632 to receive a discharge damper 654 that is movable along the end wall 632 to alternatively overlay and uncover the opening 634 in the end wall 632 and thereby open and close the inlet 636 of the blower 638. The damper 654 prevents the blower 638 from drawing filaments from either scale except during discharge of a scale and is positioned for this purpose by a discharge damper pneumatic actuating cylinder 656 mounted on a lateral extension of the end wall 632. The discharge damper 654 is fixed to the piston rod 658 of the discharge damper pneumatic actuating cylinder 656 so that the discharge damper 654 can be moved to overlay the opening 634 by introducing compressed air into a port 660 at the end of the barrel 662 of the cylinder 656 remote from the chute 626 while exhausting air from a port 664 at the end of the barrel 662 nearest the chute 626 and can be moved to uncover the opening 634 by transmitting compressed air to the port 664 while exhausting air from the port 660. The manner in which the discharge damper pneumatic actuating cylinder 656 is controlled will be discussed below with a general discussion the electric-pneumatic control system of the apparatus 40 and, to facilitate such discussion, the discharge damper pneumatic actuating cylinder 656 has been schematically shown in FIG. 32.

Portions of the interior of the discharge chute 626 adjacent the input end 628 are divided into two channels 666, 668 by a septum 670 that extends between the floor 644 and cover 646, midway between the walls 648 and 650, a distance into the chute 626 from the input end 628 thereof. A pivotable shaft 672, mounted in holes (not shown) in the floor 644 and cover 646, supports a scale selection damper 674 within the chute 626 so that the damper 674 extends from the interior end of the septum 670 toward the output end 630 of the chute 626 and is pivotable within the chute 626 toward either of the side walls 648 and 650. The damper 674 permits a selected one of the channels 666, 668 to be extended to portions of the chute 626 from which the magazine transfer blower 638 draws the charges of filaments so that air currents occasioned by the drawing of a charge produced by one scale 347, 349 from the chute 626 by the blower 638 will not disturb the other scales 347, 349. Thus, with the scale selection damper 674 in the position shown in solid lines in FIG. 23, a charge of filamentary material can be discharged from the first scale 347, to which the channels 666 opens, and transferred to the charge magazine 72 without disturbing the second scale 349. Conversely, the shaft 672 can be pivoted to move the distal end 676 of the scale selection damper 674 against the side wall 648 to permit a charge of material to be discharged from the second scale 349, to which the channel 668 opens, and transferred to the charge storage magazine 72 without disturbing the first scale 347.

To move the scale selector damper between these two positions, a scale selector damper pneumatic actuating cylinder 673 is mounted on the discharge chute 626, the piston rod 675 of the cylinder 673 being connected to the scale selector damper 674 via a lever arm 677 that is fixed to the shaft 672 and pivotally connected to a connector 679 on the end of the piston rod 675. Thus, compressed air can be transmitted to a first port 681 on the barrel 683 of the cylinder 673 to shield the second scale 349 while the first scale 347 is being discharged and can be transmitted to a second port 685 to shield the first scale while the second scale is being discharged. The scale selector pneumatic actuating cylinder 673 has been schematically illustrated in FIG. 32 for a discussion of the control system of the apparatus 40 to be given below.

Figure 24:
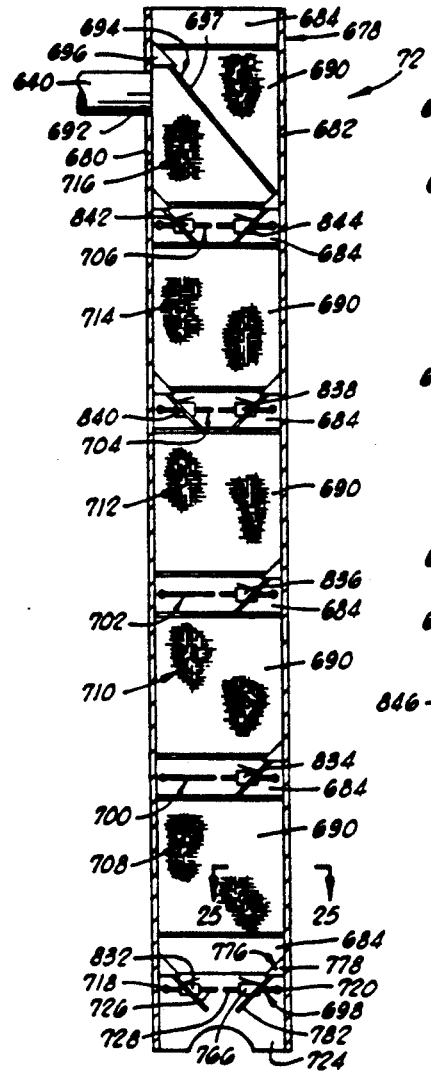
FIG. 24 is a cross section in side elevation of the charge storage magazine of the apparatus.
Figure 26:
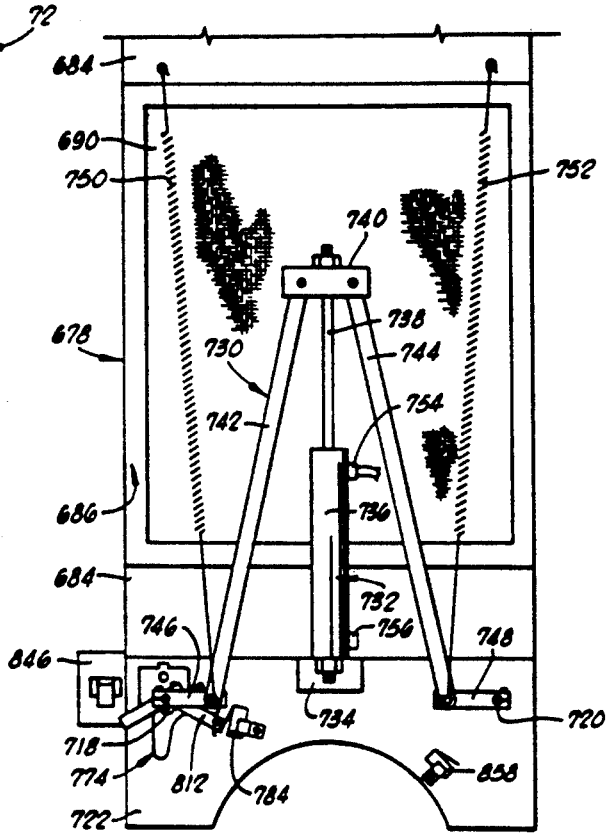
FIG. 26 is a front elevational view of lower portions of the charge storage magazine.
Figure 25:
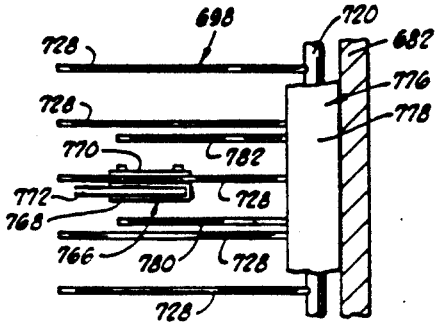
FIG. 25 is a fragmentary cross section of the charge storage magazine taken along line 25—25 of FIG. 24.

Referring now to FIGS. 24–26, the charge storage magazine 72 is comprised of a cabinet 678 having the general form of a vertical tube of rectangular cross-section. In particular, the cabinet 678 is comprised of parallel, vertical end walls 680, 682 which are connected together by a plurality of connecting slats 684 that extend between the end walls 680, 682 on both first and second sides, 686 and 688 respectively (FIG. 1), of the cabinet 678. Screens 690 are mounted between each pair of slats 684 on each side of the cabinet 678 to permit air to escape from the cabinet 678 while retaining filamentary material therein. An opening 692 is formed through the end wall 680, near the upper end thereof, to receive the end of the tube 640 remote from the magazine transfer blower 638 so that the filaments drawn from the discharge chute 626 by the blower 638 will be injected into the upper end of the cabinet 678. A comb 694 is mounted on the interior side of the end wall 680, the comb 694 being comprised of a runner 696 extending between the sides of the cabinet 678 above the opening 692 and a plurality of parallel rods 697 (only one rod 697 has been shown in the drawings) angling downwardly from the runner 696 toward the end wall 682 to intercept filaments issuing from the tube 640 and deflect the filaments downwardly through the cabinet 678 while permitting the air stream that carries the filaments from the blower 638 to be dissipated into the ambient via the top and screened sides of the cabinet 678.

The interior of the cabinet 678 is divided into a plurality of vertically stacked chambers formed by a plurality of magazine gates, constructed in the manner of the stream gates 426, 428, 448 and 450 in the scale tower 414, mounted in a vertical series within the cabinet 678 so that each magazine gate will be disposed at the lower end of one of the chambers. In one preferred embodiment of the magazine 72, the magazine comprises first through fifth magazine gates 698–706 positioned consecutively in a series from the lower end of the magazine 72 to divide the interior of the magazine into first through fifth chambers 708–716 similarly positioned consecutively in a series from the lower end of the magazine 72. The opening 692 in the end wall 680 is positioned above the uppermost gate 706 so that filaments entering the magazine 72 will enter the uppermost chamber 716 and leave the magazine only after passing through each of the chambers 708 through 716 for a purpose to be discussed below.

The first magazine gate 698 comprises: a pair of parallel, pivotable shafts 718 and 720, that are supported in holes (not shown) formed through magazine base plates 722 and 724 mounted on the sides 686, 688 of the cabinet 678 below the lowermost slat 684 on each of the sides of the cabinet 678; a plurality of parallel rods 726 extending laterally from the shaft 718; and a plurality of rods 728 extending laterally from the shaft 720. (Only one rod 726 has been illustrated in the drawings.) The shafts 718 and 720 extend horizontally along the end walls 680 and 682 respectively so that the first magazine gate 698 can be placed in a closed position shown in FIG. 24 in which the lateral rods 726 and 728 are disposed horizontally to block the open lower end of the magazine 72 and the first magazine gate can be placed in an open position (not shown) in which the pivoting shafts 718 and 720 are rotated about their axes substantially 90° from the position shown in FIG. 24 to extend the rods 726 and 728 downwardly to permit filamentary material in the first chamber 708 to be dropped through the open lower end of the magazine 72. When the apparatus 40 is used with an automatic bagger such as the bagger 42 indicated in dashed lines in FIG. 1, the magazine 72 is placed above the intake of the bagger 42 so that charges dropped from the magazine 72 will enter the bagger 42 to be bagged thereby. The magazine 72 can also be placed above a conveyor (not shown) which will transport the charges to a work station where manual bagging can take place. The remaining magazine gates 700–706 are constructed identically to the first magazine gate 698 so that the construction of the magazine gate 700–706 need not be discussed for purposes of the present disclosure other than to note a difference between the manner in which the magazine gates 700–706 and the magazine gate 698 are mounted on the cabinet 678. To mount the magazine gates 700–706 on the cabinet 678, the slats 684 on the first side 686 of the cabinet 678 are horizontally aligned with the slats 684 on the second side 688 of the cabinet 678 so that each of the magazine gates 700–706 can be mounted on the cabinet 678 by supporting the pivoting shafts thereof in holes (not shown) formed through two aligned slats on opposite sides of the cabinet 678. As described above, the first magazine gate 698 is mounted on the base plates 722, 724 below the lowermost slats 684 of the magazine 72.

To enable the magazine gates 698–706 to be selectively placed in their open and closed positions, each of the magazine gates 698–706 are biased to the closed gate position and a magazine gate pneumatic actuating cylinder is provided for each magazine gate to move that magazine gate to the open gate position. Thus, the first magazine gate 698 at the lower end of the cabinet 678 is provided with a magazine gate pneumatic actuating cylinder 732 that is connected to the shafts 718, 720 of the first magazine gate 698 via a linkage 730 that has been particularly shown in FIG. 26.

The magazine gate pneumatic actuating cylinder 732 is mounted on the first side 684 of the cabinet 678 via a bracket 734 that supports the lower end of the barrel 736 of the cylinder 732 on the base plate 722, the barrel 736 extending upwardly from the bracket 734 along the center of the first side 786 of the cabinet 678. The magazine gate pneumatic actuating cylinder 732 is oriented so that the piston rod 738 thereof extends from the upper end of the barrel 736 and the linkage 730 is comprised of: a connector 740 mounted on the piston rod 738; two intermediate links 742 and 744 pivotally connected to the connector 740 and extending downwardly and outwardly therefrom; and two terminal links 746 and 748 that are rigidly connected to the pivoting shafts 718 and 720 respectively of the first gate 698, the terminal links 746 and 748 extending from the shafts 718 and 720 toward the center of the first side 686 of the cabinet 678 in the closed position of the first gate 698 to pivotally connect at their distal ends to the intermediate links 742 and 744 respectively. The terminal links 746 and 748 are substantially parallel to the lateral rods 726 and 728 respectively that extend from the pivoting shafts 718 and 720 respectively so that, for the position of the linkage 730 shown in FIG. 26, the first gate 698 is in its closed position. The first gate 698 is held in such position by springs 750 and 752 that are connected between the slat 684 on the first side 686 of the cabinet 678 at the top of the first magazine chamber 708 and the terminal links 746 and 748 respectively as shown in FIG. 26. (In order to prevent the springs 750 and 752 from pivoting the terminal links 746 and 748 counterclockwise and clockwise respectively about the shafts 718 and 720 respectively from the position shown in FIG. 26, thereby moving the first magazine gate 698 to a position in which the rods 726 and 728 would extend upwardly from the shafts 718 and 720 respectively, a stop that will be discussed below is provided to limit counterclockwise pivotation of link 746. The linkage 730 then limits clockwise pivotation of the link 748.) Opening of the first magazine gate 698 is effected by transmitting compressed air to a port 754 at the upper end of the cylinder barrel 736 to drive the piston (not shown) of the magazine gate pneumatic actuating cylinder 732 downwardly and thereby retract the piston rod 738 to which such piston is attached. The retraction of the piston rod 738 will force the intermediate links 742 and 744 downwardly to pivot the link 746 in the clockwise direction and to pivot the link 748 in the counterclockwise direction. Accordingly, the pivoting shafts 718 and 720 of the first magazine gate 698 to which the terminal links 746 and 748 respectively are attached are pivoted in directions which will extend the rods 728 downwardly from the shaft 718 and the rods 728 downwardly from the shaft 720 as can be seen by comparing FIGS. 24 and 26. Thus, the transmission of compressed air to the port 754 of the magazine gate pneumatic actuating cylinder 732 will move the first magazine gate to the open position thereof in which the rods 726 and 728 are disposed along the end walls 680 and 682 respectively of the cabinet 678. A port 756 at the lower end of the cylinder barrel 736 is open to the ambient to permit air to escape from lower portions of the barrel 736 while the first magazine gate 698 is being opened and to permit air to enter lower portions of the barrel 736 while the first magazine gate 698 is being closed, by connecting the port 754 to the ambient as will be discussed below so that the springs 750 and 752 can draw the first magazine gate 698 closed. It should be noted that the springs 750 and 752 may be air springs which may be more suitable.

Each of the remaining magazine gates 700–706 is provided with a magazine gate pneumatic actuating cylinder that is connected to each magazine gate 700–706 via a linkage (not illustrated in the drawings) that is identical to the linkage 730 and a pair of springs (not illustrated in the drawings) is connected to each such linkage and a magazine cabinet slat 684 in the manner shown for the first magazine gate 698 in FIG. 26. Thus, each magazine gate is biased toward a closed position, in which the rods that extend from the pivoting shafts of the gate are positioned as shown in FIG. 24, by springs that are provided for each of the magazine gates 698 through 706 and each of the gates can be moved to an open position, in which the rods extending from the pivoting shafts of the gates lie along the cabinet end walls 680, 682, by transmitting compressed air to the magazine gate pneumatic actuating cylinders provided for the magazine gates 698–700. The manner in which compressed air is transmitted to the magazine gate pneumatic actuating cylinders will be discussed below in conjunction with a general discussion of the control system for the apparatus 40 and, to facilitate such discussion, the magazine gate pneumatic actuating cylinders provided for the magazine gates have been schematically illustrated in FIG. 34 wherein the schematic representation of the magazine gate pneumatic actuating cylinder 732 has been designated by the numeral 732 and wherein the magazine gate pneumatic actuating cylinders provided for the magazine gates 700–706 have been designated by the numerals 758, 760, 762, 764 respectively. Ports on the cylinders 758, 760, 762 and 764 that receive compressed air to open gates 700, 702, 704 and 706 respectively have been designated by the numerals 759, 761, 763, and 765 respectively in FIG. 34.

Figure 34:
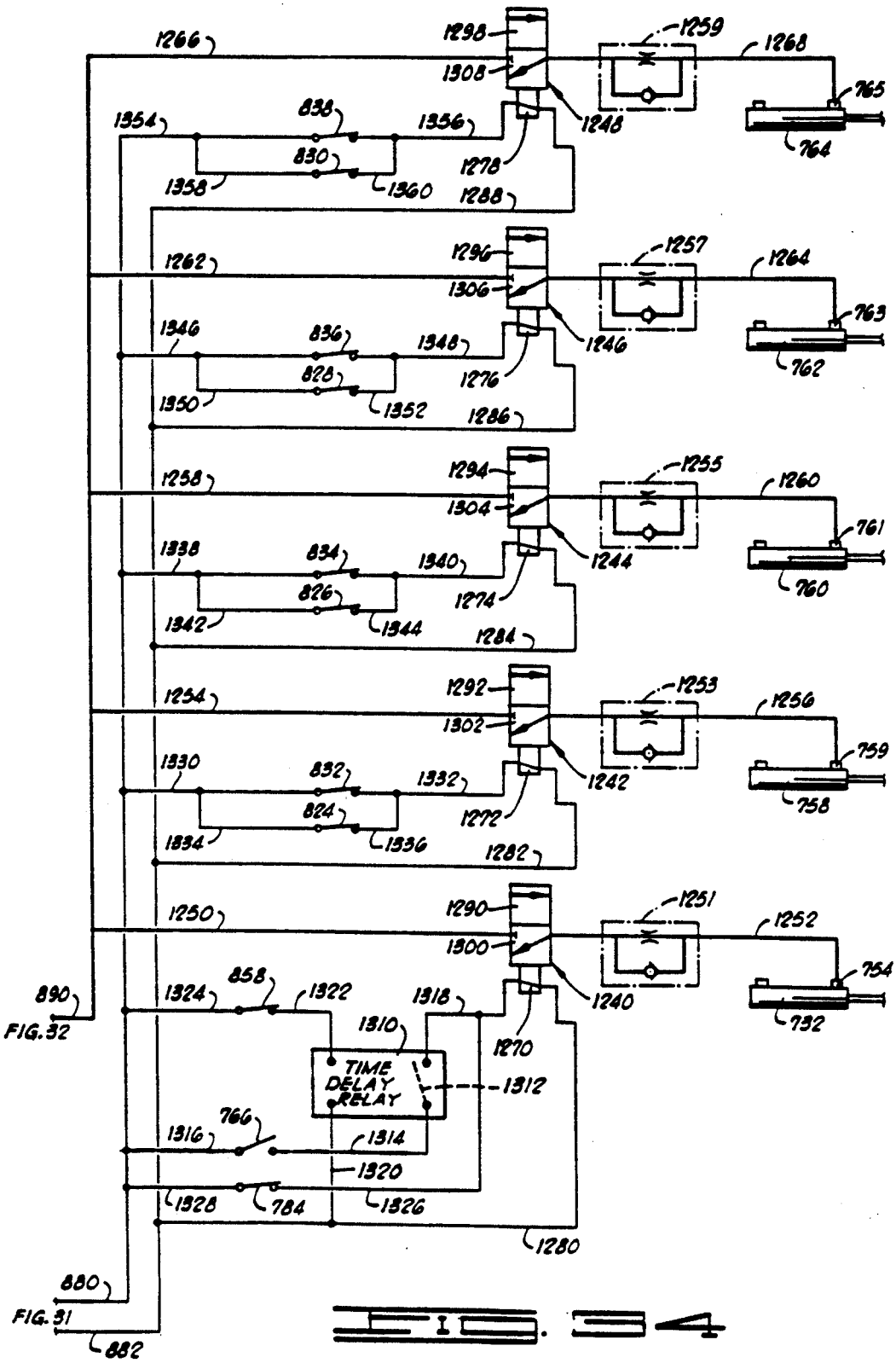

As will be discussed below, the opening and closing of the magazine gates 698–706 is ultimately controlled by switches that are mounted on the magazine gates 698–706 and on the first side 686 of the cabinet 678. The placement of these switches on the magazine 72, as well as the type of switch, normally open or normally closed, used at each location, enters into the control of the magazine gates 698–706 and, accordingly, both the placement of each switch used in the operation of the magazine gates 698–706 and the switch types have been illustrated in the drawings. In particular, the switch types have been schematically indicated in FIG. 34 which is a circuit diagram of a magazine gate control system forming a portion of the electric-pneumatic control system of the apparatus 40 to control the magazine 72. In FIG. 34, switches which are of the normally closed type have been illustrated as closed switches without regard to the states of such switches at any time during the operation of the apparatus 40. Similarly, switches which are of the normally open type have been illustrated as open switches without regard to the states of such switches at any time during the operation of the apparatus 40. The locations of these switches are shown in FIGS. 24–26 and the same numerical designations used for the switches in such Figures have been used to identify the schematic representations of these switches in FIG. 34 to facilitate a description of the control system that will be given below.

Referring first to FIGS. 24 and 25, a normally open gate control switch 766 is mounted on one of the lateral rods 728 extending from the pivoting shaft 720 of the gate 698 in a manner that has been specifically illustrated in FIG. 25. In particular, the switch 766 has a case 768 having a plurality of holes (not shown) formed laterally therethrough and such case is bolted, via the holes, to a plate 770 with the rod 728 on which the switch 766 is to be mounted interposed between the switch case 768 and the plate 770. Thus, the bolting of the plate 770 to the switch 766 secures the switch 766 to the rod 728 and, further, permits the switch 766 to be positioned on the rod 728. The switch 766 has a switch arm 772 that can be depressed to close the switch 766 and, as indicated in FIG. 24, the switch 766 is positioned on the rod 728 so that the switch arm 772 is positioned above the rods 728 comprising a portion of the first magazine gate 698 when the first magazine is closed. Thus, filamentary material falling on the first magazine gate 698 when such gate is closed will depress the switch arm 772 and close the switch 760.

As will be discussed below, the switch 766 is used to initiate discharge of the first chamber 708 of the magazine 72 each time a charge of filamentary material is dropped into the first chamber 708 of the magazine 72 when the first magazine gate 698 is closed. When a charge of filamentary material is dropped into the first chamber 708 with the first magazine gate 698 closed, the switch arm 772 will be depressed by the weight of the charge so that the switch 766 closes. The closure of the switch 766 is used to initiate the discharge of the charge of filamentary material that has been dropped onto the switch 766, by opening the first magazine gate 698 to allow the charge to drop through the open lower end of the magazine 72, in a manner that will be discussed below.

Figure 27:
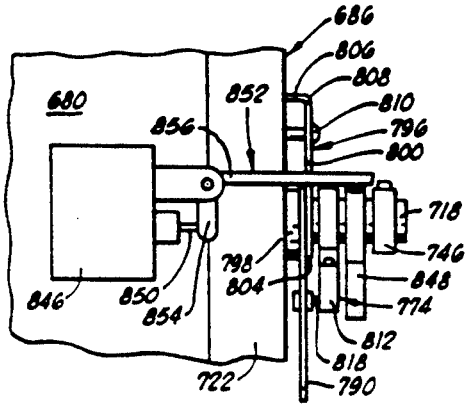
FIG. 27 is a side elevational view of one of the gate discharge completion assemblies.

Since the switch 766 is disposed on the first magazine gate 698 that the switch 766 causes to be opened, it would be possible for the first magazine gate 698 to trap a portion of a charge should the opening and closing of the first magazine gate 698 be effected solely by the switch 776. That is, as the filamentary material causing discharge of the first chamber in such a case left such chamber, it might shift in such a manner that depression of the switch arm 772 of the switch 766 could be discontinued during the discharge of the chamber with the result that control solely by the switch 766 could cause the first magazine gate 698 to close before the complete charge has been discharged from the first chamber 708. If the remnant of the charge were positioned on the first magazine gate 698 so that such remnant did not again depress the switch arm 772, the remnant would be trapped in the first chamber 708. To prevent such trapping, the switch 766 is utilized only to initiate the discharge of filamentary material through the first magazine gate 698 and a gate discharge completion assembly 774, shown in FIGS. 27 and 28, is provided to cause the first magazine gate 698 to open completely once discharge of the chamber 708 has commenced. In addition, the switch 766 is shielded from the filamentary material passing through the first gate 698 when the first magazine gate 698 is fully opened by a shield assembly 776 that is illustrated in FIGS. 24 and 25 so that the final portions of a charge passing through the first magazine gate 698 cannot interfere with the closing of the first magazine gate 698. (In the fully opened position of the gate 698, as well as the gates 700–706, the pivoting shafts 718 and 720 for the gate 698 are turned so that the rods extending laterally from the pivoting shafts are positioned nearly parallel to the end walls 680, 682 of the cabinet. The precise angle between the two portions of the gate 698 and the end walls 680, 682 when the gate 698 is fully opened can be determined by a stop engaged by the gate discharge completion assembly 774 as will become clear below or by positioning the magazine gate pneumatic actuating cylinder 732 so that such angle corresponds to the limit of travel of the piston rod 738 in the barrel 736.)

Referring first to the shield assembly 776, such assembly is comprised of a runner 778 attached to the second end wall 682 of the cabinet 678 to extend substantially between the first side 684 and second side 686 of the cabinet 678 above the pivoting shaft 720 of the first gate 698 and a pair of rods 780, 782 (FIG. 25) that are inserted in holes (not shown) in the runner 778 to extend therefrom on a slant passing through portions of the first magazine gate 698 when the first magazine gate 698 is in the closed position as shown in FIG. 24. In particular, the rods 780, 782 are positioned to extend through the first magazine gate 698 about the rod 728 upon which the switch 766 is mounted as shown in FIG. 25 so that, when the first magazine gate 698 is opened, the switch 766 will be below the two rods 780, 782. Thus, the rods 780, 782 will intercept filaments falling in vertical alignment with the switch 766 when the first magazine gate 698 is open to prevent such filaments from engaging the switch arm 772 of the first switch 766 when the first magazine gate 698 is in the open position. As shown in FIG. 24, additional switches are mounted on the gates 698–704 of the magazine 72 and identical shield assemblies (not numerically designated in the drawings) are provided for each of the switches that are mounted on the gates of the magazine 72 as has been shown in FIG. 24.

As shown in FIG. 28, the gate discharge completion assembly 774 is comprised of a completion switch 784 that is mounted on the base plate 722 of the magazine cabinet 678 via a conventional zig zag bracket 786 that is screwed to the base plate 722 to clamp the switch 784 to the base plate 722 while permitting the position of the switch 784 to be adjusted on the base plate 722. (In order to clearly illustrate the gate discharge completion assembly 774, the terminal link 746 of the linkage 730 has not been shown in FIG. 28.) The switch 784 is of the normally closed type, as indicated in FIG. 34 in which the switch 784 has been drawn schematically, and, as will be discussed below, the control system of the apparatus 40 is constructed to supply compressed air to the magazine gate pneumatic actuating cylinder 732 that is used to open the first magazine gate 698 at all times that the switch 784 is in its normally closed condition. Thus, by causing the switch 784 to be actuated, so that the switch 784 will provide an open circuit, at all times except times at which the first magazine gate 698 is in the process of moving toward the fully open position, the gate discharge completion assembly 774 can cause the first magazine gate 698 to open fully each time opening of such gate is initiated by the switch 766.

To this end, the switch 784 is mounted on the base plate 722 near the pivoting shaft 718 of the first magazine gate 698 and has a switch arm 788 that can be depressed to open the switch 784 directed toward the pivoting shaft 718 so that an object appropriately displaced from the pivoting shaft 718 and pivoting therewith can, for selected positions of such object, engage the switch arm 788 and actuate the switch 784 to open the switch 784. Two elements of the gate discharge completion assembly 774 are provided to so actuate the switch 784.

The first such element is a switch operator 790 having the form of an L-shaped plate that is loosely mounted on the pivoting shaft 718 at the intersection of arms 792, 794 of the switch operator 790 that form the legs of the L. To provide for such mounting, the switch operator 790 has a hole (not shown) formed therethrough at the intersection of the arms 792, 794, the hole through the switch operator 790 having a diameter slightly larger than the pivoting shaft 718 so that the switch operator 790 can be placed on the pivoting shaft 718 with the shaft 718 extending through such hole and the arms 792, 794 of the switch operator 790 extending radially from the pivoting shaft 718. One arm 792 is extended toward the switch 784 and is of a length to engage the switch arm 788 and actuate the switch 784, to open such switch, when the switch operator 790 is in a position shown in dashed lines in FIG. 28. The switch operator 790 can also be placed in the position shown in solid lines in FIG. 28 to permit the switch arm 788 to assume an extended position in which the switch 784 will be in its normally closed condition.

The switch operator 790 is not fixed to the pivoting shaft 718; rather, the switch operator 790 is loosely mounted on the shaft 718 so that the arm 790 can be pivoted about the shaft 718 independently of the pivotation of the shaft 718 or held in place while the shaft 718 pivots. At most times during the operation of the gate discharge completion assembly 774, the switch operator 792 is held in place about the pivoting shaft 718, a drag assembly 796 being provided for this purpose.

The drag assembly 796 is comprised of a bushing 798 (FIG. 27) that is mounted on the shaft 718 between the switch operator 790 and the base plate 722 of the cabinet 678 and a spring clip 800 that is mounted on the base plate 722 to overlay portions of the switch operator 790 disposed about the pivoting shaft 718. The spring clip 800 has a slot 802 cut into one edge 804 thereof so that portions of the spring clip 800 can be placed to bear on portions of the switch operator 790 disposed about the pivoting shaft 718 with the result that the switch operator 790 is frictionally clamped between the spring clip 800 and the bushing 798. To facilitate the mounting of the spring clip 800 on the base plate 722, the base plate 722 is preferably made of wood so that a tang 806 on the edge 808 of the spring clip 800 opposite the edge 804 thereof can be driven into the base plate 722 to fix the spring clip 800 thereon. A hole (not shown) is formed through the spring clip 800 between the tang 806 and the slot 802 so that a screw 810 can be passed through the spring clip 800 and screwed into the base plate 722 to adjust the drag that the drag assembly 796 exerts on the switch operator 790.

The other element of the gate discharge completion assembly 774 that is provided to engage the switch arm 788 of the switch 784 is a switch operator positioning arm 812 that is fixed to the pivoting shaft 718 of the first magazine gate 698 and extends therefrom between the arms 792, 794 of the switch operator 790 so that the arm 812 pivots with the shaft 718 as the gate 698 is opened and closed. The switch operator positioning arm 812 can conveniently be fixed to the pivoting shaft 718 by forming a hole (not shown) through the arm 812 near one end thereof and bolting two portions of the arm disposed to the sides of a cut 814 extending radially from such hole together to clamp the arm 812 to the shaft 718 in a conventional manner.

Near the end of the switch operator positioning arm 812 remote from the pivoting shaft 718, a threaded hole 816 is formed through the arm 812 parallel to the pivoting shaft 718 and a screw 818 is screwed into the hole 16 to extend from the arm 812 substantially to the base plate 722 as shown in FIG. 27. The hole 816 is positioned on the arm 812 and the arm 812 is positioned on the pivoting shaft 718 so that the screw 818 will travel along an arc that intersects the switch arm 788 of the switch 784 as the pivoting shaft 718 pivots between the two positions thereof for which the first magazine gate 698 is opened and closed. As can be seen by comparing the positions of the switch operator positioning arm 812 and the terminal link 746 that pivots the shaft 718 in FIG. 26, the first magazine gate 698 will be closed when the switch operator positioning arm 812 is positioned so that the screw 818 is at the upper end of the arc of travel and the first gate 698 will be open when the switch operator positioning arm 812 is positioned so that the screw 818 is at the lower end of such arc.

The lengths of the arms 792, 794 of the switch operator 790 are selected to be engaged by the screw 818 so that movement of the switch operator positioning arm 812, occasioned by the opening and closing of the first gate 698 to which the switch operator positioning arm 812 is attached, can be used to position the switch operator 790. In particular, when the first gate 698 opens so that the switch operator positioning arm 812 moves in the clockwise direction in FIG. 28 about the pivoting shaft 718 of the first magazine gate 698, the screw 818 can engage the arm 794 of the switch operator 790 and move the switch operator 790 from the position thereof shown in solid lines in FIG. 28 to the position thereof shown in dashed lines in FIG. 28. Conversely, when the first magazine gate closes so that the switch operator positioning arm 812 moves in the counterclockwise direction as seen in FIG. 28, the screw 818 can engage the switch operator 790 and move the switch operator 790 from the position thereof shown in dashed lines in FIG. 28 to the position thereof shown in solid lines in FIG. 28. A stop 822 is provided above the arm 792 of the switch operator 790 and the stop 822 establishes the positions of the two portions of the first magazine gate 698 when the first magazine gate 698 is in the closed position thereof. That is, once the switch operator 790 abuts the stop 822, the switch operator 790 forms a barrier that limits counterclockwise movement of the switch operator positioning arm 812 and, therefore, of the pivoting shaft 718 of the first gate 698. Thus, the stop 822 prevents the first magazine gate 698 from overshooting the closed position as noted above. The open position of the first magazine gate 698 is established by the condition that the completion switch 784 is actuated by the switch operator 790; that is, by the condition that the switch operator positioning arm has moved the switch operator 790 to the position shown in dashed lines in FIG. 28. As will become clear from the discussion of the control system for the apparatus 40 to be given below, an electrical connection made through the switch 784, when the switch 784 is in the non-actuated, closed state, is utilized to cause the first magazine gate 698 to continue swinging toward the open position thereof once opening of the first magazine gate 698 has been initiated. Thus, when the screw 818 engages the arm 794 of the switch operator 790 while the first gate 698 is opening and moves the switch operator 790 to the position shown in dashed lines in FIG. 28, the arm 792 of the switch operator 790 will engage the switch arm 788 of the switch 784 to place the switch 784 in the actuated, open circuit condition of the switch 784 to discontinue the current through the switch 784 that is used to move the first magazine gate 698 toward the open position thereof. When such discontinuance occurs, the springs 750, 752 shown in FIG. 26 rapidly return the first magazine gate 698 to the closed position thereof, such rapid return ending when the screw 818 engages the arm 792 of the switch operator 790 and forces such arm against the stop 822. It will be noted that the switch arm 788 of the switch 784 cannot return to the position shown in FIG. 28 when closure of the first magazine gate 698 occurs even though such closure disengages the arm 792 of the switch operator 790 from the switch arm 788 of the switch 784. When the first magazine gate 698 is in the closed position the screw 818 on the switch operator positioning arm 812 will be in abutment with the lower edge of the arm 792 of the switch operator 790 to engage the switch arm 788 of the switch 784 to hold the switch 784 in the actuated, open condition thereof. It will thus be seen that, during the opening of the first magazine gate 698, the switch operator positioning arm 812 will initially pivot in the clockwise direction as shown in FIG. 28 and as such pivotation begins, the screw 818 will move out of engagement with the switch arm 788 of the switch 784 so that the switch 784 can go to the non-actuated, closed condition thereof. The switch 784 remains in the closed condition, insuring complete opening of the magazine gate 698, until the screw 818 engages the arm 794 of the switch operator 790 to move the switch operator 790 to the position shown in dashed lines in FIG. 28 and such movement of the switch operator 790 will cause the arm 792 thereof to engage the switch arm 788 of the switch 784 and cause the switch 784 to go to the actuated, open condition thereof. As the first magazine gate 698 closes, the arm 792 of the switch operator 790 will be driven off the switch arm 788 of the switch 784 by the screw 818 without permitting the switch 784 to go to the non-actuated, closed condition thereof because of the positioning of the screw 818 to actuate the switch 784 as the screw 818 moves the arm 792 of the switch operator 790 away from the position in which the switch operator 790 actuates the switch 784.

To provide for the opening and closing of the remaining magazine gates 700–706 of the magazine 72, the magazine 72 is provided with a gate control switch and a gate operation completion assembly for each of the magazine gates 700–706. The gate operation completion assemblies provided for the magazine gates 700–706 are identical to the gate operation completion assembly 774 and are mounted on the magazine gates 700–706, and on the slats 684 by means of which the magazine gates 700–706 are mounted on the cabinet 678, in the same manner that the assembly 774 is mounted on the first magazine gate 698, and on the base plate 722 so that it will not be necessary to illustrate and discuss the gate operation completion assemblies associated with the magazine gates 700–706 for purposes of the present disclosure. Rather, it will suffice to schematically illustrate only the completion switches thereof in circuit diagrams for the control system for the apparatus 40 and such schematic illustrations are found in FIG. 34 in which the completion switches for the gate operation completion assemblies associated with the magazine gates 700–706 have been shown as normally closed switches in accordance with the convention adopted above and designated by the numerals 824–830 for the magazine gates 700–706 respectively.

The gate control switches which initiate the opening of the magazine gates 700–706, on the other hand, differ in type and placement from the gate control switch 766 that initiates the opening of the first magazine gate 698. As shown in FIG. 34, in which the gate control switches that initiate the opening of the magazine gates 700–706 have been schematically illustrated and designated by the numerals 832–838 for the magazine gates 700–706 respectively, the gate control switches 832–838 are all normally closed switches that are opened when the switch arms (not numerically designated in the drawings) are depressed. The placement of the switches 832–838 in the magazine 72 has been illustrated in FIG. 34. As shown therein, and in contrast to the placement of the gate control switch 766 on the first magazine gate 698 that such switch causes to be opened, the gate control switches 832–838 are each mounted on the magazine gate below the magazine gate that such switches cause to be opened. Thus, the switch 832 that initiates the opening of the second magazine gate 700 is mounted on the first magazine gate 698 that is located immediately below the second magazine gate 700; the switch 834 that initiates the opening of the third magazine gate 702 is mounted on the second magazine gate 700 that is immediately below the third magazine gate 702; the switch 836 that initiates the opening of the fourth magazine gate 704 is mounted on the third magazine gate 702 that is immediately below the fourth magazine gate 704; and the switch 838 that initiates the opening of the fifth magazine gate 706 is mounted on the fourth magazine gate 704 that is immediately below the fifth magazine gate 708. The purpose for these differences will become clear from the discussion of the control system of the apparatus 40 and the operation of the magazine 72 that will be given below.

The use of normally closed gate control switches 824–830 on the four uppermost magazine gates 700–706, as opposed to the use of the normally open gate control switch 766 on the first magazine gate 698, is related to the operation of the charge storage magazine 72. As will be discussed in more detail below, charges of filamentary material are stacked in the chambers 708–716 if they are received at a rate that is greater than the release rate from the lowermost chamber 708. The charges are then transferred sequentially down the chamber, to a final chamber; that is, the lowermost chamber 708, from which they are released from the magazine 72. Thus, the rate at which the apparatus 40 discharges charges of filamentary material is controlled by the rate at which the gate 698 is opened for consecutive charges introduced into the lowermost chamber 708. The four higher chambers 708–716 provide storage for charges received from the scales 347, 349 while previously received charges are awaiting discharge. To effect this mode of operation, the gate control switch 766 is normally open to cause the gate 698 to be opened in response to the introduction of a charge in the lowermost chamber 708 to close such switch; the gate control switches 824–830, on the other hand, are normally closed to cause the gates 700–706 to be open except when a chamber below a gate contains a charge of filamentary material. One result is that the open position of the uppermost gates 700–706 cannot be determined by the gate discharge completion assemblies connected to such gates in the manner that the open position of the lowermost magazine gate 698 is determined. Instead, a stop (not shown) is placed to the left of the arm 794 at the switch operator 790 of the gate discharge completion assemblies provided for the gates 700–706 to establish the open position for these gates in the same manner that the stops 822 establish the closed positions of the gates 698–706.

As shown in FIG. 24, the magazine 72 is provided with additional switches that are mounted on the two uppermost magazine gates 704 and 706 in the manner that the switch 766 is mounted on the first magazine gate 698 so that charges of filamentary material falling on the switch arms of the additional switches can actuate such switches. These include a normally closed switch 840 mounted on the fourth magazine gate 704 and schematically illustrated in FIG. 30; a normally closed switch 842 mounted on the fifth magazine gate 706 and schematically illustrated in FIG. 33; and a normally open switch 844 mounted on the fifth magazine gate 706 and schematically illustrated in FIG. 33. As will be discussed below, the switches 840–844 interrupt the operation of portions of the apparatus 40 which produce the charges of filamentary material that enter the magazine 72, including the discharge assembly by means of which charges of filamentary material are blown from the scales 347 and 349, as the two uppermost chambers 714 and 716 of the magazine 72 receive charges of filamentary material and thereby prevent several charges from being introduced into the uppermost chamber 716 of the magazine 72.

As has been noted, the apparatus 40 is preferably operated with a bagger that bags each of the charges the apparatus 40 produces as such production occurs. When this is the case, the operation of the bagger can be synchronized with the operation of the apparatus 40 by constructing the bagger to undergo one cycle of operation each time a bagger control signal is provided thereto and causing such signal to be produced each time the first magazine gate 698 of the magazine 72 is closed after discharging a charge of filamentary material from the magazine 72. To provide the apparatus 40 with this capability, a normally open, push-button type switch 846 is mounted on the end wall 680 of the magazine cabinet 678 on a level with the first magazine gate 698, as shown in FIGS. 27 and 28, and a lever arm 848 is mounted on the pivoting shaft 718 of the first magazine gate 698 to momentarily close the switch 846 each time the first magazine gate 698 is closed. As shown in FIG. 27, the switch 846 has a plunger 850 that can be depressed to actuate, and thereby close, the switch 846 and an L-shaped lever 852 is mounted on the switch 846 so that one leg 854 of the lever 852 overlays the plunger 850 and a second leg 856 of the lever 852 extends from the switch 846 beyond the first side 686 of the magazine cabinet 678. The lever arm 848 is positioned on the pivoting shaft 718, so that, when the first magazine gate 698 is closed, the condition for which FIG. 27 has been drawn, the lever arm 48 will extend on a downward slant from the shaft 718 to underlay the leg 656 of the lever 852. As the first magazine gate 698 is opened, the lever arm 848 will pivot with the pivoting shaft 718, as has been indicated for an intermediate position of the first magazine gate 698 in FIG. 28, to lift the lever 852 away from the plunger 850. The length of the lever arm 848 is selected such that the leg 854 of the lever 852 will slide off the lever arm 848 and return to the position thereof shown in FIG. 27 as the first magazine gate 698 moves to the fully open position thereof with the result that the lever arm 848 will be disposed above the leg 856 of the lever 852 as the first magazine gate 698 reaches the fully open position thereof. When the springs 750, 752 subsequently return the first magazine gate 698 to the closed position thereof, the lever arm 858 will be brought down upon the leg 856 of the lever 852 to pivot the lever 852 in the clockwise direction as seen in FIG. 27 so that the leg 854 thereof will momentarily depress the plunger 850 to close the switch 846. (The lever arm 848 is positioned on the pivoting shaft 718 such that the leg 856 of the lever 852 is substantially centered in the arc through which the lever arm 848 travels so that lever arm 848 will slide off the leg 852 before the first magazine gate 698 reaches the closed position.) Thus, each time the first magazine gate 698 is opened to discharge a charge of filamentary material and subsequently closed, the switch 846 will be momentarily closed to trigger the bagger into operation.

To facilitate bagging of charges of filamentary material from the apparatus 40, the control system of the apparatus 40 is provided with a capability of discharging the charges from the magazine at substantially fixed intervals. Such capability is provided by constructing the control system of the apparatus 40 so that a minimum time interval between the discharge of successive charges of filamentary material from the magazine 72 can be set into the control system of the apparatus 40 and by the use of a series of chambers to store charges that are received while the magazine 72 already contains one or more charges. The manner in which the minimum time interval between the discharge of successive charges of filamentary material from the apparatus 40 is achieved will be discussed below in conjunction with a general discussion of the control system of the apparatus 40. At present, it need only be noted that such capability is in part provided by a normally closed timing switch 858 that has been shown in FIG. 26 and schematically illustrated in FIG. 34. As can be seen in FIG. 26, the switch 858 is mounted on the base plate 722 of the magazine cabinet 678 near the pivoting shaft 720 of the first magazine gate 698 so that the switch arm thereof (not numerically designated in the drawings) will be engaged by the terminal link 748 of the linkage 730 as the first magazine gate 698 reaches the open position thereof to momentarily open the switch 858.

Figure 31:
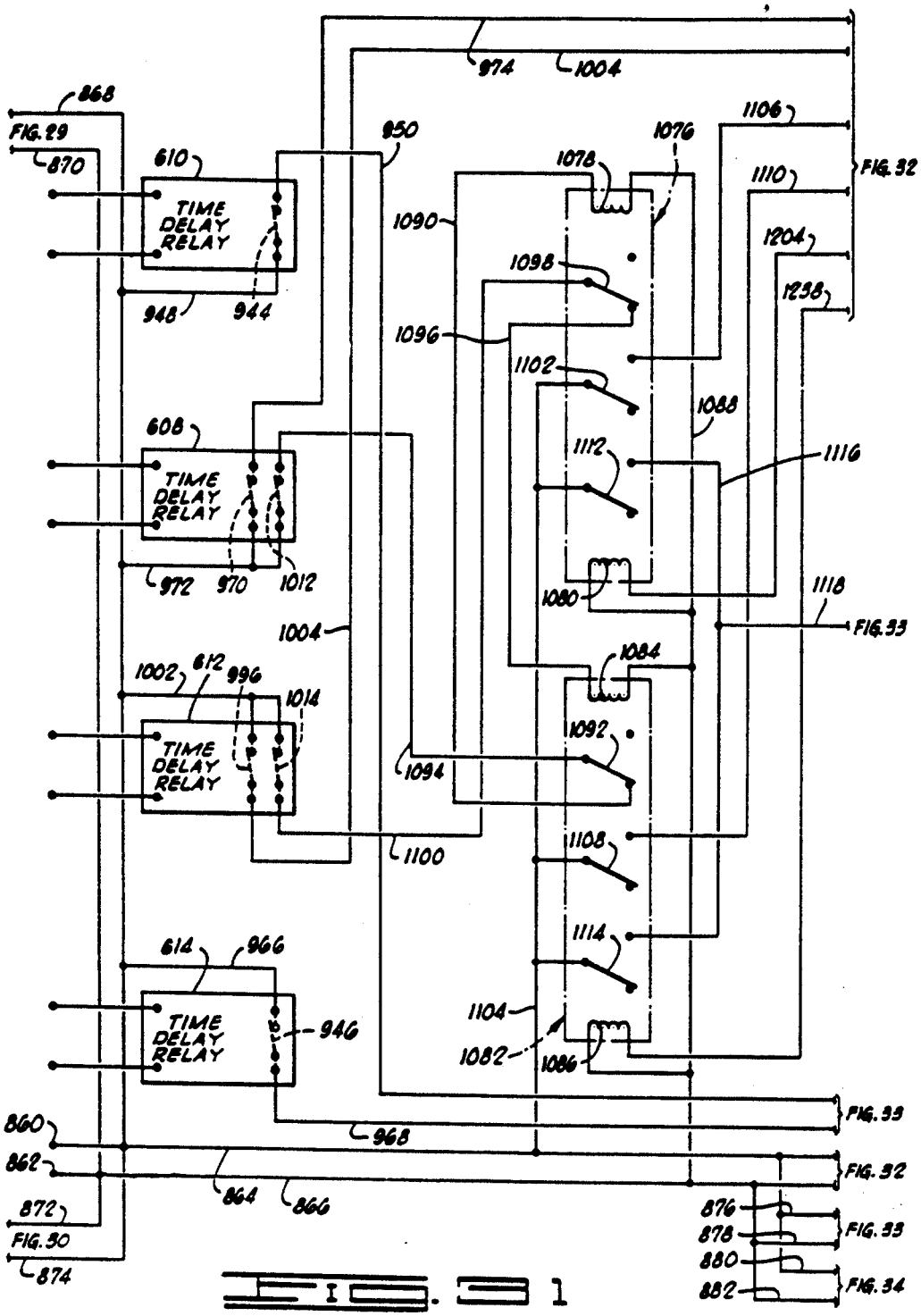

Coming now to the control system of the apparatus 40, reference is first made to FIG. 31. The control system is comprised of a number of components which are constructed to be operated by 110 volt alternating current and, for purposes of illustration, all of these components have been shown in the drawings as being connected to one pair of electrical supply terminals; that is, the terminals 860 and 862 in FIG. 31. These electrical supply terminals can be connected, via a suitable power switch (not shown) to a suitable 110 volt alternating current source which then provides power to circuits of which the control system is comprised on conductors shown in FIGS. 29–34 as follows: power is suppied to circuitry shown in FIG. 31 via conductors 864, 866 which are connected directly to the electrical supply terminals 860 and 862 respectively; power is supplied to circuitry shown in FIG. 29 via conductors 868 and 870 that are connected to the conductors 864 and 866 respectively in FIG. 31 and carried into FIG. 29; power is supplied to circuitry shown in FIG. 30 via conductors 872 and 874 that are connected to the conductors 864 and 866 respectively in FIG. 31 and carried into FIG. 30; power is supplied to circuitry shown in FIG. 32 via the conductors 864 and 866 that are continued from FIG. 31 into FIG. 32; power is supplied to circuitry shown in FIG. 33 via conductors 876 and 878 that are connected to the conductors 864 and 866 respectively in FIG. 31 and carried into FIG. 33; and power is supplied to circuitry shown in FIG. 34 by conductors 880 and 882 that are connected to the conductors 864 and 866 respectively in FIG. 31 and carried into FIG. 34. Additional conductors which have not been illustrated can be connected from the conductors 864 and 866 to the motor (not shown) that rotates the drum 50, to the serially connected switch 182 and motor (not shown) that operates the conveyor 44, to the motor of the blower 194 that transports tufts of filaments from the filament treatment chamber 66 to the supply roll concentration assembly 350, and to the motor of the magazine transfer blower 638 so that, with the exception of the conveyor motor, these motors run continuously during the operation of the apparatus 40. As noted above, the conveyor motor is operated intermittently, by the conveyor disabling assembly 160, to control the depth of filamentary material in the drum.

Figure 32:
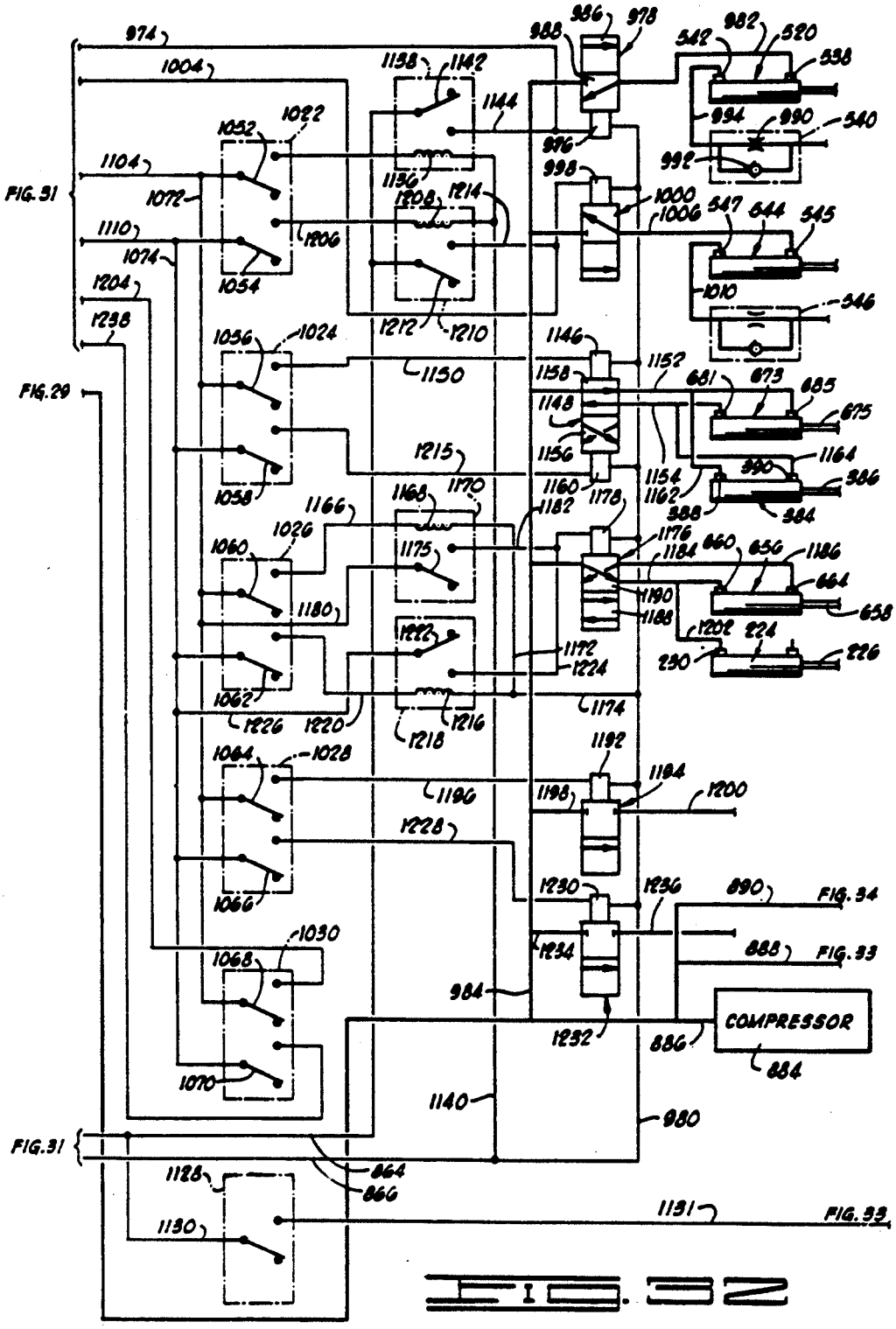

Similarly, the control system of the apparatus 40 includes the pneumatic actuating cylinders which have been described above and a compressor 884 has been illustrated in FIG. 32 as a source of compressed air to operate these pneumatic actuating cylinders. The compressor output is connected to a pneumatic conduit 886 to which pneumatic conduits illustrated in FIG. 32 are shown to be connected and the pneumatic conduit 886 is carried into FIG. 30 to provide a source of compressed air to pneumatic components shown in such Figure. Conduits 888 and 890 are shown connected to the conduit 886 in FIG. 32 and such conduits are carried into the FIGS. 33 and 34 respectively to indicate the supply of pressurized air to pneumatic components illustrated in FIGS. 33 and 34 respectively. (The conduit 210 in FIG. 11 is also connected to the compressor 884 to drive the atomizer 208. This connection has not been shown in FIG. 32.)

An important concept that is implemented in the control system of the apparatus 40 is that maximum production by the apparatus 40 can be achieved by insuring that no major component of the apparatus 40 need wait for filamentary material to be supplied thereto to carry out the operation such component performs on the material. This concept is implemented by providing certain components of the apparatus 40 with a capacity to overload components downstream thereof with respect to the flow of filamentary material through the apparatus 40 and then operating such components intermittently so that each downstream component receives filamentary material at an average rate that maximizes the overall output of the apparatus 40. By utilizing this concept, the output of the apparatus 40 can be adjusted to meet the maximum rate at which charges discharged from the charge storage magazine 72 can be bagged, whether the bagging is carried out by hand or by a bagger used with the apparatus 40. Once such rate has been established, components of the apparatus 40 extending sequentially upstream of the charge storage magazine 72 can be adjusted and controlled so that the charge storage magazine 72 always contains at least one charge of filamentary material at each of a sequence of uniformly spaced discharge times determined by the selected output rate for the apparatus 40.

One part of the implementation of this concept has been previously discussed; that is, the conveyor 44 is operated intermittently under the control of the conveyor disabling assembly 160 shown in FIGS. 5 and 6 so that the drum 50 always contains an appropriate quantity of filamentary material for most efficient operation of the drum 50 in the disintegration of the flakes of filamentary material introduced into the drum 50. A second part of this implementation is provided by the portion of the control system that has been illustrated in FIG. 29.

FIG. 29 illustrates the pneumatic actuating cylinder 102 that is a part of the damper assembly 90 illustrated in FIG. 4 and control circuitry utilized to transmit compressed air to the port 106 of the pneumatic actuating cylinder 102. As noted above, the pneumatic actuating cylinder 102 is connected to the damper 96 so that the introduction of compressed air into the port 106 of the cylinder 102 will cause the damper 96 to be drawn to the position shown in FIG. 4 that permits air to be drawn into the drum air blower 54 and passed through the drum 50 to drive tufts of filamentary material from the drum 50. Thus, tufts of filamentary material are delivered to the filament separation assembly 64 when compressed air is transmitted to the port 106 and such delivery is discontinued when the port 106 is exhausted to permit the spring 100 to draw the damper 96 to its closed position in which the damper 96 overlays the inlet 88 of the drum air blower 54.

As shown in FIG. 29, the control system for the apparatus 40 comprises a drum air blower solenoid valve 892 which receives compressed air on the conduit 886 and transmits the compressed air on a conduit 894 to the port 106 of the pneumatic actuating cylinder 102 when the coil 896 of the valve 892 is energized to interpose a first section 898 of the valve 892 between the conduits 886 and 894. Conversely, when the coil 896 is de-energized, a second section 900 of the valve 892 is interposed between the conduits 886 and 894 to exhaust the conduit 894 as has been schematically indicated by the drawing of the two sections 898 and 900 of the valve 892. A flow control valve 902 can be mounted in the conduit 894 to control the operation of the pneumatic actuating cylinder 102, the flow control valve including an orifice 904 and a check valve 906 connected in a parallel relation. The check valve 906 is positioned to permit compressed air to be rapidly exhausted from the pneumatic actuating cylinder 102, for rapid closing of the inlet 88 of the drum air blower 54, while forcing air being transmitted to the cylinder 102 to pass through the orifice 904 to thereby cause the inlet 88 of the blower 54 to be slowly opened.

The coil 896 of the drum air blower solenoid valve 892 is serially connected to the normally closed switch 312, forming a portion of the supply roll sensor assembly 300, and the normally closed switch 840 mounted on the fourth gate of the charge storage magazine and the series combination of the coil 896 and switches 312 and 840 is connected to the conductors 872 and 874 so that the coil 896 will be energized when both switches 312 and 840 are in their normally closed states and de-energized when either of these switches is actuated. That is, when neither of the switches 872 and 874 are actuated, compressed air will be transmitted to the port 106 of the pneumatic actuating cylinder 102 to withdraw the damper 96 from the inlet 88 of the blower 54 and cause tufts of filamentary material to be discharged from the drum 50. Thus, it can be seen that the supply roll sensor assembly 300 of which the switch 312 is a part can be used to control the size of the supply roll 298 in the picking chamber 262 as follows. As the discharge of tufts from the drum 50 proceeds, such tufts will be delivered to the picking chamber 272 to add to the size of the supply roll 298. As the supply roll grows, the sensor plates 306 and 308 (FIGS. 12 and 14) are forced toward the input end wall 264 of the picking chamber 262 to pivot the rod 302 from which the sensor plates 306 and 308 are suspended and thereby pivot the cam 310. When the cam 310 has been sufficiently pivoted as determined by the preselected maximum size of the supply roll 298, the cam 310 actuates, and thereby opens the switch 312 to de-energize the coil 896 of the valve 894 and thereby cause the second section 900 of the valve 892 to be interposed between the conduit 894 to the port 106 of the pneumatic actuating cylinder 102 and the ambient to exhaust the pneumatic actuating cylinder 102 and permit the spring 100 to draw the damper 96 over the inlet 88 of the drum air blower 54. Thus, when the supply roll 298 reaches the preselected size thereof, the drum air blower 54 will cease to blow air through the drum 50 so that the supply of tufts of filamentary material to the picking chamber 262 is discontinued.

Conversely, when the supply roll 298 decreases in size, the sensor plates 306, 308 move toward the output end wall 266 of the picking chamber 262 to cause the cam 310 to be pivoted to a position in which the switch 312 resumes its normally closed condition. The closure of the switch 312 then energizes the coil 896 of the solenoid valve 892 to again transmit compressed air to the pneumatic actuating cylinder 102 and thereby withdraw the damper 96 from the inlet of the drum air blower 54 to resume the discharge of tufts of filamentary material from the drum 50 and the transport of such tufts to the picking chamber 262 by the blower 194.

The interposition of the control valve 902 in the conduit 894 to the pneumatic actuating cylinder 102, as described above, causes the cutoff of the discharge of filaments from the drum 50, and therefore the transport of tufts of filamentary material to the picking chamber 262, to occur rapidly and causes the resumption of the flow of tufts of filamentary material to the picking chamber 262 to occur slowly. Such cycling of the drum air blower on and off has been found to maintain the size of the supply roll 298 within a range about the preselected size for the supply roll 298 that will provide efficient transport of filaments from the picking chamber 262 to the scales 347, 349 by the operation of the picker roll 316 and the stream forming assembly 70.

The switch 840 is also a normally closed switch and is located, as noted above, on the fourth gate 704 of the charge storage magazine 72. Thus, the switch 840 prevents overloading of the charge storage magazine 72 by causing the transport of tufts of filamentary material to the picking chamber 262 to be discontinued when a charge of filamentary material enters the fourth chamber 714 of the magazine 72 to fall on, and open, the switch 840. The positioning of this switch on the fourth gate 704 rather than on the uppermost fifth gate 796 of the magazine 72 will be discussed below.

It will be noted that the discontinuance of the discharge of tufts of filamentary material from the drum 50 when either switch 312 or 840 is opened will not cause overloading of the drum 50. Rather, the buildup of filamentary material in the drum 50 that will occur when the stream of air discharged from the drum air blower 54 is discontinued will result in the conveyor disabling assembly 160 turning off the conveyor 44 until the damper 96 is withdrawn from the inlet 88 of the drum air blower 54 to resume the discharge of tufts of filamentary material from the drum 50.

Figure 33:
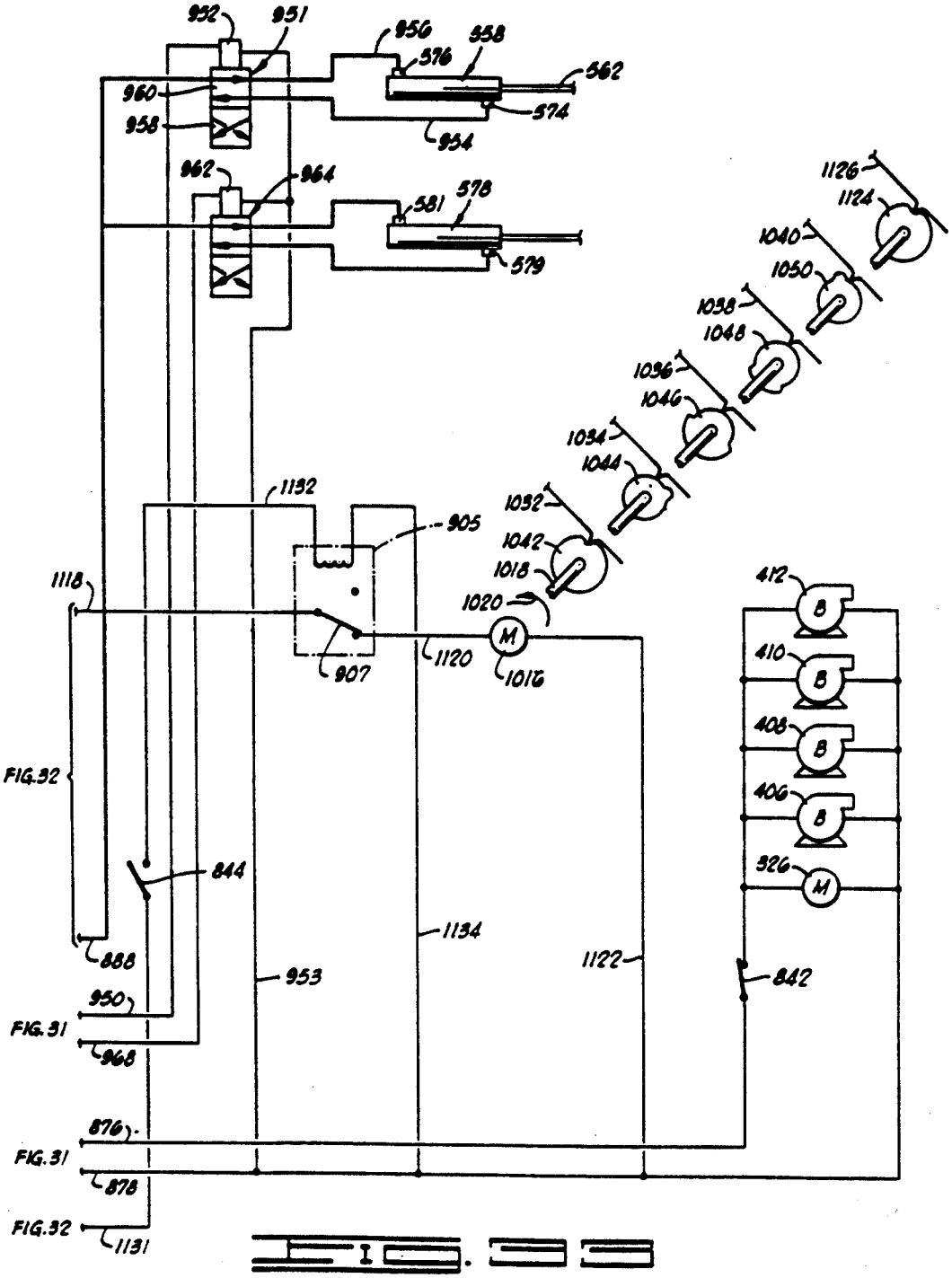

The concept of causing components of the apparatus 40 to provide filamentary material to downstream components at a rate to maintain operation of the downstream components, without overloading the downstream components, is also incorporated into the supply of filaments from the filament separation assembly 64, the stream forming assembly 70, and the scales 347, 349 to the charge storage magazine 72. In particular, and as shown in FIG. 33, the normally closed switch 842 mounted on the fifth gate 706 underlying the uppermost chamber 716 of the charge storage magazine 72 is connected in series with the motor 326 that drives the picker roll 316 and the stream blowers 406–412 that draw filaments from the picking chamber 262 and force such filaments through the stream conduits to the scales 347 and 349. Thus, when a charge of filamentary material is injected into the uppermost chamber 716 of the charge storage magazine 72, such charge will actuate the switch 842 to place such switch in an open circuit condition and thereby stop the motor 326 that turns the picker roll 326 and stop the stream blowers 406–412 which deliver filaments to the scales 347 and 349. Concurrently, such charge will land on the normally open switch 844, shown in FIGS. 24 and 33, to energize the coil of a relay 905 and open normally closed contacts 907 thereof. The opening of the contacts 907 disables the operation of the discharge assembly in a manner that will be discussed below. To provide a basis for such discussion, it will be useful to first consider the operation of those portions of the electric-pneumatic control system of the apparatus 40 that also comprise portions of the discharge assembly for the apparatus 40.

Referring first to FIG. 30, shown therein is the optical sensor circuit 602 which, as noted above, is triggered into operation by the insertion of the first mask 588 on the weight indicator arm 584 of the first scale 347 between the photocell 598 and lamp 600 of the optical sensor 599 so that the circuit 602 is triggered into operation when a charge has accumulated to the preselected charge weight on the first scale 347. The optical sensor circuit 604 comprises a filament transformer 908 having a primary winding 910 connected to the conductors 872, 878 to receive 110 volt alternating current when the apparatus 40 is turned on and a secondary winding 912 that provides 12.6 volt alternating current to the time delay relay 608 via conductors 914–918 and an SCR 920, the conductor 914 connecting one input terminal of the relay 608 to one end of the secondary winding 912, the conductor 916 connecting the other input terminal of the relay 608 to the anode of the SCR 920, and the conductor 918 connecting the cathode of the SCR 920 to the other end of the secondary winding 912. Thus, at such times that the SCR 920 is switched into conduction, the time delay relay 608 receives a half-wave rectified signal that is filtered by a 100 microfarad capacitor 922 connected across the input terminals of the relay 608 via an eleven ohm resistor 924. Thus, by switching the SCR on or off, the time delay relay 608 can be alternatively energized or de-energized. As will be discussed below, the de-energization of the relay 608 is utilized to initiate a sequence of events that discharges the first scale 347. Initiation via the de-energization of the relay 608, and the choice of the type of relay for use as the relay 608, permits disturbances to the platform 582 of the first scale 347 that occur when the first scale 347 is discharged to be caused to have no effect on the operation of the apparatus 40. That is, the time delay relay 608 is utilized to cause the optical sensing circuit 602 to, in effect, ignore repeated insertions of the mask 508 into the optical sensor 599 that occur when a charge is blown from the first scale 347 to result in oscillations of the platform 582 thereof and consequent oscillations of the weight indicator arm 584 upon which the mask 588 is mounted. In particular, although the SCR 920 will be repeatedly triggered into conduction and commutated by such oscillations, such repeated triggering and commutation of the SCR 920 will have no effect on the state of the relay 608 following discharge of the first scale 347. To this end, the time delay relay 608 is selected to be of the type which has an adjustable (via an external resistor that has not been illustrated) delay period upon energization. Thus, once the relay 608 has been de-energized, to initiate discharge of the first scale 347, electrical contacts of the relay 608 which have been opened, or closed, by the de-energization will remain opened, or closed, for a period of time following re-energization that is set to enable the oscillations of the platform 582 of the first scale 347 to be damped before the relay 608 can again initiate sequence of operations which discharge the scale. At the end of the time period, the relay 608 will operate to open normally closed contacts at the relay 608 because the first scale 347 will have been discharged to remove the mask 508 from the optical sensor 599. Thus, the optical sensor circuit 602 will again be prepared to sense the accumulation of a new charge on the first scale 347. Oscillations of the first scale 347 which may have caused the mask 588 to trigger the SCR 920 into conduction several times before the delay period has expired will thus have been prevented from having any effect on the relay 608 or the circuitry of the discharge assembly that is caused to effect the discharge of the first scale 347 because such oscillations take place at a time in which the relay 608 is insensitive to the state of the SCR 920. A suitable time delay relay for use in the circuit 602, as well as the identical optical sensor circuits provided for the mask 590 and the masks (not shown) on the weight indicator arm of the second scale 349 is a model R14-2A-12-X4-El time delay relay manufactured by Potter and Brumfield of Princeton, Ind. and a suitable external resistor that can be used with such relay to select the delay on energization time period such relay provides is a two megohm potentiometer.

The lamp 600 is connected across half the transformer 908 secondary winding 912 by connecting the lamp 600 to a center tap of the winding 912 via a conductor 926 and to one end of the eleven ohm resistor 924 via a conductor 928, the other end of the resistor 924 being connected to the conductor 914 from one end of the secondary winding 912. To trigger the SCR 920 into conduction when the mask 588 enters the optical sensor 599, the photocell 598 is made part of a voltage divider circuit that is connected across the ends of the secondary winding 912 of the transformer 908, via the 11 ohm resistor 924, and to the gate of the SCR 920 via a conductor 930. In particular, the photocell 598 and a serially connected 1600 ohm resistor 932 are connected between the 11 ohm resistor 924 and the gate of the SCR 920 to provide one side of the voltage divider and a wave shaping network 934 is connected between the gate and cathode of the SCR 920 to form the other half of the voltage divider. The wave shaping network 934 comprises a 0.01 microfarad capacitor 936 in parallel with a serially connected 6.8 kilohm resistor 938 and 10 kilohm potentiometer 940 extending between the gate and cathode of the SCR as noted. A thermistor 942 is connected in parallel with the 6.8 kilohm resistor 938 to compensate the optical sensor circuit 602 for changes in temperature to which the apparatus 40 may be subjected in operation. Suitable components for the circuit 602 are: a model VT-241 photocell manufactured by Vactec, Inc. of St. Louis, Mo.; a catalog number LB22Ll thermistor manufactured by Fenwal Electronics of Framingham, Mass.; and a General Electric C106 Fl SCR.

At such times that the photocell 598 is illuminated by the lamp 600, the electrical potential difference at the ends of the secondary winding 912 of the transformer 908 is divided between the resistors 924 and 932 and the photocell 598 on the one hand and the wave shaping network 934 on the other hand. With the above described values for the resistors and capacitors including the circuit 602 and for the above identified components of such circuits, the potential difference across the wave shaping circuit 934 can be adjusted via the potentiometer 940 so that, for every other half cycle of the output of the transformer 908 during which the anode of the SCR 920 is positive with respect to the cathode thereof, the potential difference across the wave shaping network and, therefore across the gate-cathode terminals of the SCR 920, will suffice to trigger the SCR 920 into conduction. Thus, so long as the photocell 598 is illuminated by the lamp 600, current is passed by the SCR 920 to provide the above mentioned half-wave rectified current to the time delay relay 608 so that, with the filtering provided by the capacitor 922, the time delay relay 608 will be continuously energized. When the mask 588 enters the optical sensor 599 to interrupt the illumination of the photocell 598, the resistance of the photocell 598 undergoes a large increase that lowers the potential difference across the wave shaping network 934 to the point that such potential difference cannot trigger the SCR 920 into conduction. Thus, the time delay relay 608 is de-energized by the entry of the mask 588 into the optical sensor 599.

As has been noted, two optical sensor circuits, identical to the circuit 602, are provided for each scale to detect the presence of both a complete charge of filamentary material on the scale and the presence of a preselected portion of such charge and the time delay relays in these four circuits have been illustrated in FIG. 31. Thus, the relay in the optical sensor circuit associated with the first mask that detects a complete charge of filamentary material on the first scale is the relay 608 in FIG. 31; the relay in the optical sensor circuit associated with the second mask that detects a preselected portion of a complete charge of filamentary material on the first scale 347 is the relay 610 shown in FIG. 31; the relay in the optical sensor circuit associated with the first mask that detects a complete charge of filamentary material on the second scale is the relay 612 in FIG. 31; and the relay in the optical sensor circuit associated with the second mask that detects a preselected portion of a complete charge of filamentary material on the second scale 349 is the relay 614 in FIG. 31. Each of these relays 608–614 will be de-energized upon the swinging of a weight indicator arm of the scale with which the relay is associated to enter the optical sensor of the optical sensor circuit with which the relay is also associated. The de-energization of the relays 610 and 614 results in the interruption of the second stream of filaments to the scale with which the relay is associated by the closure of one of the two second stream gates 448 (above the first scale 347 as shown in FIG. 19) and 450 (above the second scale 349) as will now be discussed. It will be noted that, since the relays 610 and 614 are associated with the longer second masks on the weight indicator arms of the scales 347 and 349 that the second stream gates 448, 450 will be closed before complete charges of filamentary material have accumulated on the scales above which the second stream gates 448 and 450 are located.

The relays 610 and 614 are selected to each include at least one normally closed contact and such normally closed contacts have been shown in FIG. 31 and designated by the numerals 944 (for relay 610) and 946 (for relay 614) therein. (The relay identified above by manufacturer's model number as suitable for use in the circuit 602 has four normally closed contacts.) Referring first to the contact 944 of the relay 610, one end of such contact is connected, via conductor 948, to the conductor 868 leading to the electrical supply terminal 860 and the other end of the contact 944 is connected, via a conductor 950, which has been continued into FIG. 33 to the coil 952 of a second stream gate valve 951. A circuit including the coil 952, through the contact 944, is then completed via a conductor 953 to the conductor 878 that, as shown in FIG. 31, connects to the conductor 866 and thence to the electrical supply terminal 862.

The second stream gate valve 951 is a four-way solenoid valve having one input port open to the ambient and a second input port connected to the compressor 884, via conduit 888, and having output ports connected, via conduits 954 and 956, to the ports 574 and 576 of the second stream gate pneumatic actuating cylinder 558 that is connected to the second stream gate 448 above the first scale 347 so that the second stream gate valve 951 can be used to control the second stream of filaments to the first scale 347. The valve 951 has a first section 958 that is interposed between the inlet and outlet ports of the valve 951 when the coil of the valve 951 is energized and the pneumatic actuating cylinder 958 is connected to the valve 951 so that, when the first section 958 is interposed between the inlet and outlet ports of the valve 951, compressed air will be transmitted to the port 574 of the pneumatic actuating cylinder 558 and the port 576 of the cylinder 558 will be exhausted. Thus, as can be seen by comparing FIGS. 31, 19 and 20, energization of the coil 952 of the second stream gate valve 951 will operate the second stream gate pneumatic actuating cylinder 558 to close the second stream gate 448 above the first scale 347. The solenoid valve 951 also has a second section 960, interposed between the inlet and outlet ports of the valve 951 when the coil 952 is de-energized, that transmits compressed air to the port 576 of the pneumatic actuating cylinder 558 while exhausting the port 574 thereof so that, when the coil 952 of the second stream gate valve 951 is de-energized, the second stream gate 448 above the first scale 347 will be open.

The normally closed contact 946 of the time delay relay 614 is similarly connected in series with the coil 962 of another second stream gate valve 964 via conductors 966 and 968 and the conductor 953. The second stream gate valve 964 is identical to the second stream gate valve 951 and is connected to the second stream gate pneumatic actuating cylinder 578 in the same way that the second stream gate valve 951 is connected the second stream gate pneumatic actuating cylinder 558. Since, as noted above, the second stream gate pneumatic actuating cylinder 578 is connected to the second stream gate 550 above the second scale 349 in the same manner that the second stream gate pneumatic actuating cylinder 558 is connected to the second stream gate 448 above the first scale 347, the second stream gate valve 964 controls the second stream of filaments to the second scale 349 in the same manner that the second stream gate valve 951 controls the second stream of filaments to the first scale 347. Thus, when the coil 962 of the pneumatic actuating cylinder 964 is de-energized, the second stream gate pneumatic actuating cylinder 578 will open the second stream gate 550 above the second scale 349 and, when the coil 962 of the valve 964 is energized, the pneumatic actuating cylinder 578 will close the second stream gate 550 above the second scale 349.

Solenoid valves are similarly connected to normally closed contacts of the relays 608 and 612 to close the first stream gates 426 and 428 above the scales 347 and 349 when the charges of filamentary material have accumulated on the scales to the preselected weight each charge produced by the apparatus 40 is to have. Referring first to the time delay relay 608, such relay has a normally closed contact 970 that is connected, via conductor 972 and conductor 868, to the electrical supply terminal 860 and the contact 970 is connected, via conductor 974 shown in FIG. 31 and carried into FIG. 32 to the coil 976 of a first stream gate valve 978. The opposite end of the coil 976 of the valve 978 is connected to the electrical supply terminal 862 via a conductor 980 and the conductor 866 so that the coil 976 is connected serially to the electrical power supply for the apparatus 40 through the normally closed contact 970 of the time delay relay 608.

The first stream gate valve 978 is a three-way solenoid valve having one output port connected via a conduit 982 to the port 538 of the first stream gate pneumatic actuating cylinder 538 that is connected to the first stream gate 426 above the first scale 347 as has been described above. The valve 978 has two input ports, one of which is open to the ambient and the other of which is connected to the compressor 884, via a conduit 984 and the conduit 886, and the valve 978 has a first section 986 that is interposed between the outlet port of the valve 978 and the pressurized input port thereof when the coil 976 is energized. A second section 988 of the valve 978 connects the output port of the valve 978 to the non-pressurized input port of such valve when the coil 976 is de-energized. Thus, when the coil 976 is energized, compressed air is transmitted to the port 538 of the first stream gate pneumatic actuating cylinder 520 to cause the first stream gate pneumatic actuating cylinder 520 to close the first stream gate 426 above the first scale 347 and, when the coil 976 is de-energized, the port 538 is exhausted to open the first stream gate 426 above the first scale 347 in the manner that has been discussed above.

It will be noted that the opening of the first stream gate 426 occurs slowly and the closing of such gate occurs rapidly because of the construction of the flow control valve 540 shown in FIG. 32 and the connection of the flow control valve 540 to the port 542 of the first stream gate pneumatic actuating cylinder 520. As shown in FIG. 32, the flow control valve 540 includes an orifice 990 in parallel with a check valve 992 and the flow control valve is connected, via a conduit 994, to the port 542 of the first stream gate pneumatic actuating cylinder 520 so that the check valve 992 will open when compressed air is transmitted to the first stream gate pneumatic actuating cylinder 520 to close the stream gate 426. That is, the check valve 992 permits rapid exhaust of the port 542 of the cylinder 520. On the other hand, when air is exhausted from the port 538, to permit the first stream gate 426 to open, the check valve 992 closes so that air entering the port 542 of the first stream gate pneumatic actuating cylinder 520 must pass through the orifice 990, thereby slowing the opening of the first stream gate 426 above the first scale 347.

The time delay relay 612, associated with the optical sensor circuit triggered by the first mask (not shown) on the weight indicator arm (not shown) of the second scale 349 similarly has a normally closed contact 996 that is connected in series with the coil 998 of a first stream gate valve 1000 that is identical to the first stream gate valve 976 and is connected to the first stream gate pneumatic actuating cylinder 544, via a conduit 1006, in the same manner that the valve 976 is connected to the first stream gate pneumatic actuating cylinder 520. That is, the contact 996 is connected to the electrical supply terminal 860 via a conductor 1002 and the conductors 868 and 864 and is connected to the coil 998 of the valve 1000 via a conductor 1004 that is shown in FIGS. 31 and 32. The opposite end of the coil 998 is then returned to the apparatus electrical supply terminal 862 via the conductors 980 and 866.

As noted above, the first stream gate pneumatic actuating cylinder 544 is connected to the first stream gate 428 above the second scale 349 in the same manner that the first stream gate pneumatic actuating cylinder 520 is connected to the first stream gate 426 above the first scale 347 so that the first stream gate valve 1000 controls the first stream gate 428 above the second scale 349 in the same manner that the first stream gate valve 978 controls the first stream gate 426 above the first scale 347. Thus, when the coil 998 of valve 1000 is energized, the valve 1000 transmits compressed air from the conduit 984 by means of which the valve 1000 is connected to the compressor 884, to the port 545 of cylinder 544 to close the first stream gate 428. Conversely, when the coil 998 of the valve 1000 is de-energized, the valve 1000 exhausts port 545 of cylinder 544 to permit the first stream gate 428 above the second scale 349 to open.

It will also be seen in FIG. 32 that the flow control valve 546 is identical to the flow control valve 540 and is connected, via conduit 1010, to the first stream gate pneumatic actuating cylinder 544 in the same manner that the flow control valve 540 is connected to the first stream gate pneumatic actuating cylinder 520. Thus, just as the first stream gate pneumatic actuating cylinder 520 rapidly closes and slowly opens the first stream gate 426 above the first scale 347, the first stream gate pneumatic actuating cylinder 544 rapidly closes and slowly opens the first stream gate 428 above the second scale 349.

It will thus be seen that the optical sensors and the optical sensing circuits of which such sensors are a part cause the first and second streams of filaments to each scale to be sequentially interrupted as a charge is accumulated on such scale. At such times that the first scale 347 is empty, the masks 588 and 590 on the weight indicator arm 584 of the first scale 347 are positioned as shown in FIG. 22 so that both relays 608 and 610 are energized as described above for the relay 608 in the circuit 602. Accordingly, the normally closed contacts 944 and 970 in the relays 610 and 608 will be held open to de-energize the coils 952 and 976 of the valves 951 and 978 respectively. With the coil 952 de-energized, the second stream gate valve 951 supplies compressed air to the second stream gate pneumatic actuating cylinder 558 to cause the second stream gate 448 above the first scale 347 to be held open and, with the coil 976 de-energized, the first stream gate valve 978 supplies atmospheric pressure to the first stream gate pneumatic actuating cylinder 520 to permit the first stream gate 426 above the first scale 347 to open under its own weight. Thus, two streams of filaments are drawn from the picking chamber 262 and transmitted by the stream forming assembly 70 to the first scale 349 so that a charge will accumulate on the first scale 347.

As the charge accumulates on the first scale 347, the weight indicator arm 584 thereof moves along the arc 586 until the second mask 590 enters the optical sensor 601 to cause the time delay relay 610 to be de-energized. The de-energization of the time delay relay 610 permits the contact 944 thereof to close and energize the coil 952 of the second stream gate valve 951. The second stream gate valve 951 then transmits compressed air to the second stream gate pneumatic actuating cylinder 558 to cause the second stream gate pneumatic actuating cylinder 558 to close the second stream gate 448 above the first scale 347 and thereby interrupt the second stream of filaments to the first scale 347. The first stream of filaments to the first scale 347; that is, the stream of filaments to the first scale 347 having the smaller filament flow rate, continues until the first mask 588 on the first scale 347 weight indicator arm 584 enters the optical sensor 599 to de-energize the time delay relay 608. Since the first stream of filaments to the first scale 347 has a relatively low filament transport rate, the de-energization of the time delay relay 608 will occur for an accurately determined charge of filamentary material on the first scale 347. The de-energization of the relay 608 permits the contact 970 thereof to close and energize the coil 976 of the first stream gate valve 978. When the coil 976 is energized, compressed air is transmitted by the first stream gate valve 978 to the first stream gate pneumatic actuating cylinder 520 to cause the first stream gate pneumatic actuating cylinder 520 to close the first stream gate 426 above the first scale 347. Thus, the use of the two masks 588 and 590 on the weight indicator arm 584, the optical sensor circuits including the optical sensor 599, and 601 and the time delay relays 608 and 610, the stream gate valves 978 and 951 connected to the relays 608 and 610, and the stream gate pneumatic actuating cylinders 520 and 558 to close the first and second stream gates 426 and 448 above the first scale 347 results in a charge of filamentary material having a well determined weight on the first scale 347. Such charge of filamentary material on the first scale is then discharged in a manner to be discussed below.

Following the discharge of the first scale 347, the masks 588 and 590 return to the positions shown in FIG. 22 so that, at the end of the delay on operate period selected for the relays 608 and 610, the optical sensing circuits of which the relays 608 and 610 are a part will actuate the relays 608 and 610 to again open the contacts 970 and 944 of the relays 608 and 610 respectively. The coils of the stream gate valves 978 and 951 are de-energized by the opening of the contacts 970 and 944 respectively to again cause the stream gate pneumatic actuating cylinders 520 and 558 to open the first and second stream gates, 426 and 428 respectively, above the first scale 347 so that another charge of filamentary material can be accumulated on the first scale 347.

Accurately measured charges are accumulated on the second scale 349 in the same manner that accurately measured charges are accumulated on the first scale 347. That is, at such times that the second scale 349 is empty, the first and second masks (not shown) mounted on the weight indicator arm (not shown) of the second scale will be positioned in the same manner that has been shown in FIG. 22 for the masks 588, 590 on the weight indicator arm 584 of the first scale 347. With the masks on the weight indicator arm of the second scale in such position, the optical sensors provided for the second scale 349 and positioned in optical sensor circuits identically to the positioning shown for the sensor 599 in circuit 602 will cause the optical sensor circuits of which the sensors provided for the second scale 349 are a part to energize the relays 612 and 614. Thus, the normally closed contacts 946 and 996 of the relays 614 and 612 respectively will be held open so that the coils 962 and 998 of the solenoid valves 964 and 1000 respectively will be de-energized with the result that the second stream gate pneumatic actuating cylinder 578 will receive compressed air from the valve 964 to hold the second stream gate 550 above the second scale 349 open and the first stream gate pneumatic actuating cylinder 544 will be connected to the ambient to permit the first stream gate 428 above the second scale 349 to be opened. Thus, the stream forming assembly 70 will provide both first and second streams of filaments to the second scale 349 so that a charge will accumulate on the second scale 349.

When a preselected portion of the final charge weight has accumulated on the second scale 349, the time delay relay 614 is de-energized in the same manner that the time delay relay 610 is de-energized when such portion accumulates on the first scale 347 to close the second stream gate 550 above the second scale 349 in the same manner that de-energization of the time delay relay 610 closes the second stream gate 448 above the first scale 347. The first stream of filaments to the second scale 349; that is, the stream of filaments to the scale 349 having the lower transport rate, then continues to accurately bring the quantity of filamentary material on the second scale 349 to the preselected charge weight that the apparatus 40 is constructed to produce. When such charge weight is reached, the relay 612 is de-energized in the same manner that the relay 608 is de-energized when a charge has accumulated on the first scale 347 and the deenergization of the relay 612 closes the first stream gate 428 above the second scale 349 in the same manner that deenergization of the relay 608 closes the first stream gate 426 above the first scale 347. Such charge is then discharged from the second scale 349 as will be discussed below and the relays 612 and 614 are subsequently re-energized in the same manner that the relays 608 and 610 are re-energized following the discharge of a charge from the first scale 347 to again return the first and second stream gates 428 and 450 respectively above the second scale 349 to the open positions thereof in the same manner that has been described above for the first and second stream gates 426 and 448 above the first scale 347 so that a new charge can accumulate on the second scale 349.

It will be noted that the stream forming assembly 70 does not discontinue drawing the first and second streams of filaments for each of the scales 347 and 349 from the picking chamber 262 while the gates 426, 428, 448 and 450 are closed. Rather, the filaments in such streams are merely caught by the stream gates above the two scales. Thus, when the two stream gates above a scale are opened following the discharge of a charge of filamentary material from that scale, a portion of a charge of filamentary material equal to the quantity that would have accumulated on the scale had the gate been open is immediately deposited on the scale. Thus, no time is lost in the accumulation of charges on the scales 347, 349 by the need to periodically discontinue the streams of filaments to the scales and discharge charges of filaments from the scales. In order that the portion of the charge dropped onto a scale immediately following the opening of the stream gates above that scale will not exceed the preselected portion of a charge at which the second stream gate above the scale is closed, the preselected portion of a charge at which the second stream gate closes can be conveniently chosen to be approximately seven eighths of the preselected weight the charges are to have and the picker roll 316 and stream blowers 406–412 are operated at speeds such that the time required to discharge a scale is small compared to the time required to accumulate a charge on a scale. In one embodiment of the apparatus 40, the discharge time, determined by the speed of rotation of a motor to be discussed below, is selected to be approximately one second while the speeds at which the picker roll 316 and blowers 406–412 are operated are adjusted to cause a charge to be accumulated on a scale approximately once every ten seconds.

The relays 608 and 612 are additionally used to initiate the discharge of charges of filamentary material from the scales 347 and 349, a normally closed contact 1012 of relay 608 being used to initiate the discharge of the first scale 347 and a normally closed contact 1014 of relay 612 being used to initiate discharge of the second scale 349. That is, each time the first mask 588 on the weight indicator arm 584 of the first scale 347 enters the optical sensor 599, the relay 608 is de-energized, as discussed above, to close contact 1012 and the closure of contact 1012 initiates a scale discharge sequence for the first scale 347. Similarly, each time the first mask (not shown) mounted on the weight indicator arm (not shown) of the second scale 349 enters the optical sensor (not shown) provided for the second scale 349 in the same manner that the optical sensor 599 is provided for the first scale 347, the relay 612 is de-energized to close contact 1014 and the closure of contact 1014 initiates the same discharge sequence for the second scale 349.

To discharge the scales, the discharge assembly further comprises a plurality of solenoid valves that can be sequentially operated to position the scale selection damper 674, open the discharge damper 654, and blow air across the scale to be discharged. These valves are controlled by a solenoid valve energizing assembly that includes a motor 1016, schematically represented in FIG. 33, that can conveniently be located in the cabinet 605 that supports the scales 347, 349. A cam shaft 1018 is connected to the shaft of the motor 1016 to be turned through one revolution in the direction indicated by the arrow 1020 each time one of the contacts 1012 or 1014 is closed and the sequencing of the discharge of either scale 347, 349 is carried out by the sequential actuation of a plurality of switches 1022–1030 (schematically indicated in FIG. 32) mounted about the cam shaft 1018 and having switch arms schematically indicated in FIG. 33 by the numerals 1032–1040 for the switches 1022–1030 respectively. The switch arms 1032–1040 engage cams 1042–1050 respectively mounted on the cam shaft 1018 and having shapes indicated in FIG. 33. Each of the switches 1022–1030 has two normally open contacts that can be closed by depressing the switch arm of the switch, one contact being provided to cause a step of the discharge sequence to be carried out for first scale 347 and the other contact being provided to cause the same step of the discharge sequence to be carried out for the second scale 349. Thus, the switch 1022 has a first scale contact 1052 associated with the first scale 347 and a second scale contact 1054 associated with the second scale 349; the switch 1024 has a first scale contact 1056 associated with the first scale 347 and a second scale contact 1058 associated with the second scale 349; the switch 1026 has a first scale contact 1060 associated with the first scale 347 and a second scale contact 1062 associated with the second scale 349; the switch 1028 has a first scale contact 1064 associated with the first scale 347 and a second scale contact 1066 associated with the second scale 349; and the switch 1030 has a first scale contact 1068 associated with the first scale 347 and a second scale contact 1070 associated with the second scale 349. The first scale contacts 1052, 1056, 1060, 1064 and 1068 are all connected to a conductor 1072 while the second scale contacts 1054, 1058, 1062, 1066 and 1070 are all connected to a conductor 1074 so that the scale to be discharged can be selected by supplying electrical energy to one of the conductors 1072 or 1074 in a manner that will now be described.

Referring once again to FIG. 31, the discharge assembly of the apparatus 40 comprises a first latching relay 1076 that can be placed in a set condition by momentarily energizing a set coil 1078 of the relay 1076 and in a reset condition by momentarily energizing a reset coil 1080 thereof. Similarly, the discharge assembly comprises a second latching relay 1082 that can be placed in a set condition by momentarily energizing a set coil 1084 of the relay 1082 and in a reset condition by momentarily energizing a reset coil 1086 thereof. Each of the relays 1076 and 1082 has a plurality of contacts which are alternatively open or closed with respect to connections made to the contacts depending upon whether the relay is set or reset. In FIG. 31, such contacts have been shown for the reset condition of each of the relays 1076 and 1078.

One end of the set coil 1078 of the first latching relay 1076 is connected to the electrical supply terminal 862 via the conductor 866 and a conductor 1088 and the other end of the coil 1078 is connected via a conductor 1090 to a contact 1092 in the second latching relay that provides an electrical connection to the contact 1012 of the relay 608, via conductor 1094, when the second latching relay 1082 is in the reset condition. The contact 1012 connects to the other electrical supply terminal 860 via conductors 972, 868 and 864. Thus, when a complete charge of filamentary material accumulates on the first scale 347 to permit the contact 1012 to return to its normally closed position, an electrical circuit will be completed through the set coil 1078 to place the first latching relay 1076 in the set condition thereof provided that the second latching relay 1082 is in the reset condition thereof. Similarly, one end of the set coil 1084 of the second latching relay 1082 is connected to the electrical supply terminal 862 via the conductors 1088 and 866 and the other end of the set coil 1084 is connected via a conductor 1096 to a contact 1098 in the first latching relay 1076 that provides a connection to the contact 1014 of the relay 612, via a conductor 1100, when the first latching relay 1076 is in the reset condition. The contact 1014 is connected to the other electrical supply terminal 860 via conductors 1002, 868 and 864 so that, when the first latching relay 1076 is reset, the accumulation of a complete charge of filamentary material on the second scale 349 to permit the contact 1014 in relay 612 to return to its normally closed position will energize the set coil 1084 of the second latching relay 1082 to cause the second latching relay 1082 to go to the set condition thereof. As will become clear below, the first scale 347 is discharged by the setting of the first latching relay 1076 and the second scale 349 is discharged by the setting of the second latching relay 1082 so that the supply of electrical energy to the set coil of one relay via a contact of the other latching relay that is closed when such other latching relay is reset and open when the other latching relay is set prevents the two scales 347 and 349 from being simultaneously discharged. Rather, if the first scale 347 is being discharged, the setting of the first latching relay 1076 will open the contact 1098 to prevent the second latching relay 1082 from being set to discharge the second scale 349 until discharge of the first scale 347 has been completed. Upon completion of discharge of the first scale 347, the first latching relay 1076 will be reset, as will be discussed below, and the contact 1098 will close so that the second latching relay 1082 can be set to discharge the second scale 349. The setting of the second latching relay 1082 when the second scale 349 is discharged will similarly open the contact 1092 to prevent the first scale 347 from being discharged until the discharge of the second scale has been completed.

The first latching relay 1076 has a contact 1102 that closes when the first latching relay 1076 is set to connect the conductor 1072, to which the first scale contacts of the switches 1022–1030 are connected, to the electrical supply terminal 860 via the conductor 864 and conductors 1104 and 1106 and the second latching relay 1082 similarly has a contact 1108 that closes when the second latching relay 1082 is set to connect the conductor 1074, to which the second scale contacts of the switches 1022–1030 are connected, to the electrical supply terminal 860 via the conductors 864 and 1104 and a conductor 1110. Thus, the setting of one of the latching relays 1076 will provide a current path from the electrical supply terminal 860 to either the first scale contacts of the switches 1022–1030 or the second scale contacts of such switches. The first latching relay 1076 has a third contact 1112 that closes when the first latching relay 1076 is set and the second latching relay 1082 has a third contact 1114 that closes when the second latching relay 1082 is set to complete, for the setting of either relay, an electrical circuit through the motor 1016 that drives the cam shaft 1018. Thus, the contacts 1112 and 1114 are each connected to the electrical supply terminal 860 via the conductors 864 and 1104 and the contacts 1112 and 1114 are each connected to the motor 1016 via conductors 1116, 1118 and 1120 and the normally closed contact 907 of relay 905 (FIG. 33) while the motor 1016 is connected to the electrical supply terminal 862 via the conductors 866, 878 and a conductor 1122. The connection of the motor 1016 to the electrical supply terminals 860 and 862 through the contact 907 of the relay 905 is provided to prevent a charge of filamentary material from being discharged into the charge storage magazine 72 at such times that the uppermost, fifth chamber 716 thereof contains a charge of material by halting the discharge of a scale when such discharge is into the uppermost chamber 716 of the magazine until the operation of the charge storage magazine 72 can clear such chamber as will be described below. It will be useful to discuss this feature of the apparatus 40 before discussing the remaining components of the discharge assembly shown in FIG. 32 by means of which the two scales 347 and 349 are discharged.

It will be noted that a sixth cam 1124 is mounted on the cam shaft 1018 to engage one switch arm, schematically represented at 1126, of a switch 1128 illustrated schematically in FIG. 32. The switch 1128 is a normally open switch that can be closed by depressing the switch arm 1126 (FIG. 33) thereof and the cam 1124 is shaped, as indicated in FIG. 33, so that the switch arm 1126 will be depressed for all positions of the cam shaft 1018 except for the position shown in FIG. 33. As will become clear below, such position of the cam shaft shown in FIG. 33 is the position the cam shaft assumes at times that neither of the scales 347, 348 is being discharged. The switch 1128 is connected to the electrical supply terminal 860 via the conductor 864 and a conductor 1130 and to the normally open switch 844 on the uppermost gate 706 of the charge storage magazine 72 via a conductor 1131. The switch 844 is connected, via a conductor 1132, to one end of the coil of the relay 905, shown in FIG. 33, through the contact 907 of which electrical energy is supplied to the motor 1016, and the other end of such coil is connected to the other electrical supply terminal 862 via a conductor 1134 and the conductors 878 (FIG. 33) and 866 (FIG. 31) so that the switches 1128 and 844 and the coil of relay 905 are connected in series across the electrical supply terminals 860, 862. Thus, should both the switches 1128 and 844 be closed, the coil of the relay 905 will be energized to open the contact 907 thereof to interrupt the supply of electrical power to the motor 1016 by means of which discharge of the scales is effected. Accordingly, should a scale be discharged into the uppermost chamber 716 of the charge storage magazine 72, such discharge occurring as will be discussed below when the cam shaft 1018 has been displaced from the position shown in FIG. 33, the switch 1128 will be closed at the time of discharge (by the cam 1124) and the switch 844 will close upon entry of the charge into the chamber 716 of the magazine 72 to immediately disable the motor 1016 by means of which the discharge is being effected. Thus, the motor 1016 will stop, to discontinue the sequence of operations that occur when a scale is discharged until the operation of the charge storage magazine 72 has caused the charge in the uppermost chamber 716 thereof to be released from such chamber. With the release of the charge from the chamber 716 of the charge storage magazine 72, the switch 844 opens and the discharge sequence is continued to completion. Since, as described above, neither scale can be discharged while the sequence of discharge operations is being carried out on the other scale, the provision of the switches 844 and 1128 connected to the coil of the relay 905 as shown in the drawings prevents a charge from being discharged from one scale while a charge that has been discharged from the other scale remains in the uppermost chamber 716 of the charge storage magazine 72.

Coming now to the discharge of the scales 347 and 349, it will be useful to consider the discharge of the first scale 347 first. The initiation of the discharge of the first scale 347 occurs when the first mask 588 on the weight indicator arm 584 of the first scale 347 enters the optical sensor 599 (FIG. 22) to cause the time delay relay 608 to be de-energized as has been discussed above. Assuming, for purposes of discussion, that the second latching relay 1082 is in the reset condition thereof; that is, the second scale 349 is not in the process of being discharged, the de-energization of the relay 608 closes the contact 1012 thereof to establish an electrical current through the set coil 1078 of the first latching relay 1076 in a manner that has been discussed above. Accordingly, the contact 1102 of the first latching relay 1076 provides electrical power to the conductor 1072 from the apparatus supply terminal 860 as has been discussed above and, concurrently, the contact 1112 of the first latching relay 1076 closes to complete a circuit through the motor 1016 (FIG. 33) as has been discussed above. Thus, the motor 1016 commences the turning of the cam shaft 1018 in the direction 1020 so that, in view of the shape of the cam 1042, the first scale contact 1052 of the switch 1022 shown in FIG. 32 immediately closes.

When the contact 1052 closes, electrical power supplied to the conductor 1072 from the terminal 860 is transmitted to the coil 1136 of a relay 1138. The coil 1136 is connected to the electrical supply terminal 862 via the conductor 866 and a conductor 1140 so the relay 1138 is actuated when the cam shaft 1018 begins to turn to close a normally open contact 1142 of the relay 1138. The contact 1142 of the relay 1138 provides a second electrical path to the coil 976 of the first stream gate valve 978 that closes the first stream gate 426 above the first scale 347, as has been discussed above, via a conductor 1144 that is connected to the same end of the coil 976 of the solenoid 978 that is connected to the conductor 974. In view of the shape of the cam 1042 shown in FIG. 33, this alternate electrical circuit provided to the coil 976 of the solenoid valve 978 insures that the first stream gate 426 above the first gate 347 will remain closed until the cam 1042 returns to the position shown in FIG. 33 at which time the discharge sequence for the first scale 347 will have been completed. That is, the first stream gate 426 is prevented from opening during the discharge of the first scale 347.

After the cam shaft 1018 has turned through a small angle from the position shown in FIG. 33, the cam 1044 engages the switch arm 1034 of the switch 1024 to momentarily close the first scale contact 1056 of the switch 1024 to connect one end of a first coil 1146 of a scale selector valve 1148 to the conductor 1072 via a conductor 1150 so that such end of the coil 1146 is connected to the electrical supply terminal 860 via the connection of the conductor 1072 to such terminal that has been described above. The other end of the coil 1146 is connected to the conductor 980 that, in turn, is connected to the other electrical supply terminal 862 via the conductor 866. Accordingly, the first coil 1146 of the scale selector valve 1148 will be energized shortly subsequent to the initiation of rotation of the cam shaft 1018. The scale selector valve 1048 is a latching solenoid valve having one input port that is open to the ambient and one input port that is connected to the conduit 984 that leads, as shown in FIG. 32, to the compressor 884 via the conduit 886. The valve 1148 has two output ports which are connected to the scale selector damper pneumatic actuating cylinder 673 via conduits 1152 and 1154. The scale selector valve 1148 has first and second valve sections 1156 and 1158 respectively that can be alternatively interposed between the input ports of the valve 1148 and the output ports thereof by alternative energization of the first coil 1146 and a second coil 1160 of the valve 1148. In particular, the valve 1148 is constructed such that the energization of the first coil 1146 interposes the first section 1158 thereof between the input and output ports of the valve 1148 and such that the energization of the second coil 1160 thereof interposes the second section 1158 between the input ports of the scale selector valve 1148 and the output ports thereof, the section interposed between the input and output ports of the scale selector valve 1148 remaining so interposed between energizations of the first and second coils 1146 and 1160 respectively thereof. Accordingly, when the first coil 1146 of the scale selector valve 1148 is energized, the first section 1156 of the scale selector valve 1148 is interposed between the input and output ports thereof to transmit compressed air to the port 681 of the scale selector damper pneumatic actuating cylinder 673 and to exhaust the port 685 thereof so that the piston rod 675 of the scale selector damper pneumatic actuating cylinder 673 is extended to the position shown in FIG. 23. Thus, the scale selector damper 674 is moved to the position shown in solid lines in FIG. 23 to shield the second scale 349 from air currents produced in the discharge of the first scale 347 while opening the channel 666 adjacent the first scale 347 to the inlet 636 of the magazine transfer blower 638. Thus, when the charge on the first scale 347 is blown into the discharge chute 626, as will be discussed below, such charge will be positioned in the discharge chute 626 to be drawn into the magazine transfer blower 638 and transported to the charge storage magazine 72.

As can also be seen in FIG. 32, the deflector pneumatic actuating cylinder 384 that positions the deflection assembly 356 is also connected to the scale selector valve 1148 so that, when the first section 1156 of the scale selector valve 1148 is interposed between the input and output ports of the valve 1148, compressed air will be transmitted to the port 390 of the deflector pneumatic actuating cylinder 384 via a conduit 1164 while the port 388 thereof will be exhausted via a conduit 1162. As can be seen in FIGS. 14 and 15, the transmittal of compressed air to the port 390 of the deflector pneumatic actuating cylinder 384 while exhausting port 388 thereof will draw the piston rod 386 of the deflector pneumatic actuating cylinder 384 into the barrel of such pneumatic actuating cylinder to pivot the deflector assembly 356 to the position shown in dashed lines in FIG. 14 and thereby deflect filaments falling through the precipitation tower 352 toward the second side wall 270 of the picking chamber 262 to concentrate the supply roll 294 at the end of the picker roll 316 that is adjacent the second side wall 270 of the picking chamber 262 adjacent which the second plenum formed by the output compartments 340 and 344 is disposed. Since, as has been discussed above, filaments transported to the second scale 349 are drawn from the second plenum, the discharge of the first scale 347 will be accompanied with a biasing of the stream forming assembly to favor the accumulation of filaments on the second scale 349.

Returning now to FIG. 33, the next step in the discharge sequence occurs with the engagement of the switch arm 1036 of the switch 1026 by the cam 1046 to close the first scale contact 1060 of the switch 1026 and hold such contact closed for approximately half a revolution of the cam shaft 1018. The contact 1060 is connected, via conductor 1166, to one end of the coil 1168 of a relay 1170, the other end of the coil 1168 being connected, via conductors 1172 and 1174, to the conductor 980 that extends to the electrical supply terminal 862 via the conductor 866. Since the conductor 1072 is extended to the electrical supply terminal 860 when the first latching relay 1076 is set as discussed above, the coil 1168 will be energized to close normally open contact 1175 of the relay 1170.

The discharge assembly comprises a discharge damper valve 1176 having a coil 1178 connected between the conductors 1072 and 980 via the relay contact 1175 and conductors 1180 and 1182 so that, since the conductors 1072 and 980 extend to the apparatus electrical supply terminals 860, 862 as described above, closure of the contact 1060 by the cam 1046 energizes the coil 1178 of the discharge damper valve 1176.

The discharge damper valve 1176 is a four-way solenoid valve having two input ports, one of which is connected to the conduit 984 leading to the compressor 884 and the other of which, an exhaust port, is open to the ambient, and two output ports that are connected to the ports 660 and 664 of the discharge damper pneumatic actuating cylinder 656 via conduits 1184 and 1186 respectively. The valve 1176 has a first section 1188 that is interposed between input and output ports of the valve 1176 when the coil 1178 thereof is energized and a second section 1190 that is interposed between the input and output ports of the valve 1176 when the coil 1178 is de-energized. The ports 660 and 664 of the discharge damper pneumatic actuating cylinder 656 are connected to the output ports of the valve 1176 so that compressed air will be transmitted to port 664, while port 660 is exhausted, when the first section 1188 of the valve 1176 is interposed between the valve 1176 inlet and outlet ports and so that compressed air will be transmitted to the port 660, while the port 664 is exhausted, when the second section 1190 is interposed between the valve 1176 input and output ports. Thus, when the first scale contact 1060 of the switch 1026 is closed by the cam 1046, to energize the coil 1178 of valve 1176, compressed air will be transmitted to the port 664 of the discharge damper pneumatic actuating cylinder 656 to retract the piston rod 658 thereof and, as can be seen in FIG. 23, draw the discharge damper 654 from the discharge chute 626 to open the inlet 634 of the magazine transfer blower 638 into the discharge chute 626.

With continued rotation of the cam shaft 1018, the cam 1048 mounted thereon engages the switch arm 1038 (FIG. 33) of switch 1028 (FIG. 32) to close the first scale contact 1064 of the switch 1028, such contact connecting the coil 1192 of a first manifold valve 1194 between the conductors 1072 and 980 which extend to the apparatus electrical supply terminal 860 and 862 respectively. For this purpose, one end of the contact 1064 is connected to the conductor 1072, as noted above, one end of the coil 1192 is connected to the conductor 980, and the other ends of the contact 1064 and coil 1172 are connected together via a conductor 1196. The first manifold valve 1194 is a normally closed solenoid valve having an input port connected via conduit 1198 to the conduit 984 extending to the compressor 884 and an output port connected via a conduit 1200 to the first manifold 620 at the end of the pan 616 opposite the discharge chute 626. Thus, when the contact 1064 is closed by the cam 1048, the coil 1192 is energized to open the first manifold valve 1194 and cause streams of air to issue from the first manifold 620 and blow the charge of filamentary material on the first scale 347 into the discharge chute 626. The magazine transfer blower 638 then transfers the charge of filamentary material to the charge storage magazine 72.

Returning to FIG. 33, it will be seen that the shapes of the cams 1048 and 1046 are such that continued rotation of the cam shaft 1018 will cause sequential opening of the first scale contacts 1064 and 1060 of the switches 1028 and 1026, via successive disengagement of the switch arms 1038 and 1036 of switches 1028 and 1026 respectively. When, as can be seen in FIG. 32, the first scale contact 1064 opens, the coil 1192 of the first manifold valve 1194 will be de-energized so that the valve 1194 returns to the normally closed condition thereof to discontinue the stream of air across the pan 616 on the first scale 347. When the contact 1060 subsequently opens, the coil 1068 of relay 1170 is de-energized to open the contact 1175 of relay 1170 and thereby de-energize the coil 1178 of the discharge damper valve 1176. When the coil 1178 is de-energized, the second section 1190 of the valve 1176 is interposed between the input and output ports of the valve 1176 to transmit compressed air to the port 660 of the discharge damper pneumatic actuating cylinder 656, while exhausting the port 664 of the cylinder 656, thereby extending the piston rod 658 and, as can be seen in FIG. 23, moving the discharge damper 654 to a closed position thereof wherein the discharge damper 654 overlays the inlet 636 of the magazine transfer blower 638.

As has been noted above, the present invention contemplates the injection of a quantity of anti-static compound into a filament treatment chamber 66 each time a charge of filamentary material is produced by the apparatus 40. The manner in which this capability is achieved has been illustrated in FIGS. 32 and 11. As shown in FIG. 32, the port 230 of the pneumatic actuating cylinder 224 that operates the pump 212 shown in FIG. 11 is connected, via a conduit 1202, to the port 660 of the discharge damper pneumatic actuating cylinder 656. Thus, when compressed air is transmitted to the port 660 of the discharge damper pneumatic actuating cylinder 656 to close the discharge damper, compressed air is also transmitted to the port 230 to extend the piston rod 226 of the pneumatic actuating cylinder 224 and cause a quantity of anti-static compound in the cylinder 222 of the pump 212 to be forced through the check valve 220 to the anti-static compound reservoir 206. As discussed above, such quantity of anti-static compound is then injected as a mist into the filament treatment chamber 66. When the discharge damper 654 is moved to the open position thereof, by transmitting compressed air to the port 664 of the discharge damper pneumatic actuating cylinder 656 while exhausting the port 660 of the cylinder 656, the port 230 of the pneumatic actuating cylinder 224 is also exhausted to permit the spring 228 to retract the piston rod 226 and operate the pump 212 to draw a quantity of anti-static compound into the pump 212 via the check valve 218.

Returning now to FIG. 33, the cam shaft 1018 continues to turn following the discharge of a charge of filamentary material from the first scale 347 until the cam 1050 engages the switch arm 1040 of the switch 1030. The cam 1050 is shaped to momentarily close the first scale contact 1068 (FIG. 32) of the switch 1030 to connect the conductor 1072, that extends to the electrical supply terminal 860, to one end of the reset coil 1080 of the first latching relay 1076 via a conductor 1204 that is shown in FIG. 32 and extends therefrom to FIG. 31. The other end of the coil 1080 is connected to the conductor 1088 that extends to the electrical supply terminal 862 so that the momentary closure of the contact 1068 causes the first latching relay 1076 to be reset. When the first latching relay 1076 is reset, the contact 1112 thereof opens to discontinue the supply of electrical power to the motor 1016 via the conductor 1116 connected to the contact 1112 so that the cam shaft 1018 will stop in the position shown in FIG. 33. Simultaneously, the cam 1042 disengages the switch arm 1032 to open the contact 1052 of the switch 1022 and contact 1102 of the first latching relay 1076 opens so that the supply of electrical power to the coil 1136 of relay 1138 is discontinued both because of the opening of contact 1052 and the disconnection of the conductor 1072 from the terminal 860. Thus, contact 1142 of relay 1138 opens to interrupt one conducting path to the coil 976 of relay 978. The other conducting path to the coil 976, provided by conductor 974 leading to the normally closed contact 970 of the time delay relay 608, will be interrupted when the time delay relay 608 opens the contact 970 at the end of the delay on operate period set into the relay 608. Thus, at the end of the selected delay period, the coil 976 de-energizes to exhaust port 538 of the pneumatic actuating cylinder 520 and permit the first stream gate 426 above the first scale 347 to open. Similarly, when the first scale 347 is discharged, the time delay relay 614 will be enabled to be re-energized by the withdrawal of the second mask 590 from the optical sensor 601 so that, after the selected delay period upon operation set into the relay 614, the normally closed contact 946 thereof is opened to de-energize the coil 952 of relay 951. When the coil 952 is de-energized, the second section 960 of the valve 951 is interposed between the input and output ports of the valve 951 to provide compressed air to the port 576 of the pneumatic actuating cylinder 558, while exhausting port 574 of cylinder 558, so that the piston rod 562 of cylinder 558 is extended to open the second stream gate 448 above the first scale 347.

Discharge of the second scale 349 is carried out in an identical manner when the time delay relay 612 is de-energized by the entry of the first mask (not shown) on the weight indicator arm (not shown) of the second scale 349 into the optical sensor (not shown) that is included in the optical sensor circuit (not shown) of which the relay 612 is a part. Upon such de-energization, or upon resetting of the first latching relay 1076 if de-energization of the relay 612 occurs during discharge of the first scale 347, the contact 1014 of the time delay relay 612 and the contact 1098 of the first latching relay 1076 complete a circuit through the set coil 1084 of the second latching relay 1082, as has been discussed above, so that the second latching relay sets. When the second latching relay sets, the contact 1114 thereof closes to connect the motor 1016 to the electrical supply terminal 860 so that the motor 1016 will again be energized and will again commence the rotation of the cam shaft 1018. Simultaneously, the contact 1108 makes the above described connection between the electrical supply terminal 860 and the conductor 1074, shown in FIG. 32, to which the second scale contacts 1054, 1058, 1062, 1066 and 1070 of the switches 1022, 1024, 1026, 1028 and 1130 respectively are connected so that sequential closing of the second scale contacts gives rise to the same sequence of operations with respect to the second scale 349 that are described above with respect to the first scale 349. Thus, the second scale contact 1054 is connected via a conductor 1206 to one end of the coil 1208 of a relay 1210 and the other end of the coil 1208 is connected to the conductor 1140 extending, as described above, to the electrical supply terminal 862 so that the relay 1210 is energized when the cam 1042 is turned a short distance to engage the switch arm 1032 of the switch 1022. A normally open contact 1212 of the relay 1210 is connected to the conductor 864 leading to the electrical supply terminal 860 and to the coil 998 of the first stream gate valve 1000 via a conductor 1214 so that closure of the contact 1212 energizes the coil 998 of the first stream gate 1000 via the above described connection of the coil 998 to the electrical supply terminal 862. As described above, the energization of the first stream gate valve 1000 transmits compressed air to the port 545 of the first stream gate pneumatic actuating cylinder 544 so that the energization of the first stream gate valve 1000 via the second scale contact 1054 and relay 1210, and the shape of the cam 1042, ensures that the first stream gate 428 above the second scale 349 will remain closed while the second scale 349 is discharged in the same manner that the first stream gate 426 above the first scale 347 is caused to remain closed during the discharge of the first scale 347.

The second scale contact 1058 of the switch 1028 is connected via a conductor 1215 to the second coil 1160 of the scale selector valve 1148 so that the connection of the contact 1058 to the conductor 1074 leading to the electrical supply terminal 860 and the connection of the coil 1160 to the conductor 980 leading to the electrical supply terminal 862 will result in the second coil 1160 being momentarily energized by the cam 1044 in the same manner that the first coil 1146 of the valve 1148 is momentarily energized when the first scale 347 is discharged. When the second coil 1160 of the scale selector valve 1148 is energized, the second section 1158 of the scale selector valve 1148 is interposed between the input and output ports of the scale selector valve 1148 to transmit compressed air to the port 685 of the scale selector pneumatic actuating cylinder 683 while exhausting the port 681 thereof so that the scale selector damper 674 is moved to the position shown in dashed lines in FIG. 23 to open the channel 668, adjacent the second scale 349, of the discharge chute 626 to the inlet 636 of the magazine transfer blower 638. Thus, the scale selector damper 674 will shield the first scale 347 from air currents produced while the second scale 349 is being discharged.

The interposition of the second section 1158 of the scale selector valve 1148 between the input and output ports of such valve also transmits compressed air to the port 388 of the deflector pneumatic actuating cylinder 384 while exhausting the port 390 of the deflector pneumatic actuating cylinder 384 so that the deflection assembly 356 will be moved to the position shown in solid lines in FIG. 14 to deflect tufts of filaments falling through the scale precipitation tower toward the first side wall 268 of the picking chamber 262. Such movement of the deflector assembly 356 concentrates the supply roll 298 adjacent the end of the picking roll 316 that is also adjacent to the first plenum, comprised of the output compartments 338 and 342, from which filaments transmitted to the first scale 349 are drawn. Thus, each time the second scale is discharged, the flow of filaments to the first scale 349 is enhanced while the flow of filaments to the second scale 347 is reduced as has been described above.

The second scale contact 1062 is connected to one end of the coil 1216 of a relay 1218 via a conductor 1220 and the other end of the coil 1216 is connected to the conductor 980 so that the relay 1218 will be energized via the connection of the conductor 1074 to the electrical supply terminal 860 and the connection of the conductor 980 to the electrical supply terminal 862 when the cam 1046 engages the switch arm 1036 of the switch 1026 in the same manner that the relay 1170 is energized by the first scale contact 1060 when the cam 1046 engages the switch arm 1036. A normally open contact 1222 of the relay 1218 is serially connected, via a conductor 1224 to the coil 1178 of the discharge damper valve 1176 and the contact 1222 is connected to the conductor 1074 via a conductor 1226 so that engagement of the switch arm 1036 of the switch 1026 by the cam 1046 will cause the coil 1178 of the discharge damper valve 1176 to be energized in the same manner that the coil 1178 of the discharge damper valve 1176 is energized when the first scale 347 is discharged. Thus, the discharge damper pneumatic actuating cylinder 656 will open the discharge damper 654 in the same manner that the discharge damper 654 is opened by the discharge damper pneumatic actuating cylinder 656 when the first scale 347 is discharged. Similarly, the pneumatic actuating cylinder 224 will be operated during the discharge of the second scale to inject a selected quantity of anti-static compound into the anti-static compound reservoir 206 during discharge of the second scale in the same manner that a quantity of anti-static compound is injected into the anti-static compound reservoir 206 when the first scale 347 is discharged.

The second scale contact 1066 is connected via the conductor 1228 to the coil 1230 of a second manifold valve 1232 which is identical to the first manifold valve 1194 and connects the second manifold 622 to the conduit 984 leading to the compressor 884 in the same manner that the first manifold valve 1194 connects the first manifold 620 to the compressor 884 when the first scale 349 is discharged. That is, the second manifold valve 1232 is connected to the conduit 984 via a conduit 1234 and to the second manifold 622 via a conduit 1236 so that, when the cam 1048 engages the switch arm 1038 of the switch 1028, compressed air is transmitted via the second manifold valve 1232 to the second manifold 622 from which a stream of air issues to discharge the second scale 349.

With continued rotation of the cam 1018 the second scale contact 1066 is opened by the cam 1048 in the same manner that the first scale contact 1064 was opened by the cam 1048 and the second scale contact 1062 is opened by the cam 1046 in the same manner that the first scale contact 1060 was opened by the cam 1046 so that, after a charge is blown from the second scale 349, the streams of air issuing from the second manifold 622 is discontinued and the discharge damper 654 is closed.

The second scale contact 1070 is connected via a conductor 1238 to the reset coil 1086 of the second latching relay 1082 so that, when the cam 1018 returns to the position shown in FIG. 33 to momentarily close the second scale contact 1070, the reset coil 1086 of the second latching relay 1082 is momentarily energized to reset the second latching relay 1082 in the same manner that momentary energization of the reset coil 1080 of the first latching relay 1076 by momentary closure of the first scale contact 1068 reset the first latching relay 1076.

The portion of the electric-pneumatic control system that controls the magazine gates of the charge storage magazine 72 has been illustrated in FIG. 34 in which the magazine gate pneumatic actuating cylinders 732, 758, 760, 762 and 764 which operate the magazine gates 698, 700, 702, 704 and 706 respectively have also been illustrated. As has been discussed, the magazine gate pneumatic actuating cylinders 732, 758, 760, 762 and 764 have ports 754, 759, 761, 763, and 765 respectively which can be pressurized to open the gates 698, 700, 702, 704 and 706 respectively or exhausted to permit springs connected to the magazine gates to pull the magazine gates closed. To supply compressed air to the magazine gate pneumatic actuating cylinders, the electric-pneumatic control system is comprised of first through fifth magazine gate valves 1240–1248 that are associated with the first through fifth magazine gates 698 through 706 respectively. In particular, each of the magazine gate valves is a solenoid valve having one input port connectable to a source of compressed air, an output port connectable to a component that is to be operated using the valve, and an exhaust port part open to the ambient so that the valve can be connected between the compressed air source and the component to either transmit compressed air to such component or to exhaust such component. Thus, the input port of the valve 1240 is connected to the conduit 890 leading to the compressor 884 via a conduit 1250 and the outlet port of the valve 1240 is connected to the port 754 of the first magazine gate pneumatic actuating cylinder 732 via a conduit 1252; the input port of the second magazine gate 1242 is connected to the conduit 890 via a conduit 1254 and the output port of the valve 1242 is connected to the magazine gate pneumatic actuating cylinder 758 via a conduit 1256; the input port of the magazine gate valve 1244 is connected to the conduit 890 via a conduit 1258 and the output port of the valve 1244 is connected to the magazine gate pneumatic actuating cylinder 760 via a conduit 1260; the input port of the third magazine gate valve 1246 is connected to the conduit 890 via a conduit 1262 and to the magazine gate pneumatic actuating cylinder 762 via a conduit 1264; and the input port of the magazine valve 1248 is connected to the conduit 890 via a conduit 1266 and the output port of the valve 1248 is connected to the magazine gate pneumatic actuating cylinder 764 via a conduit 1268. Control valves 1251, 1253, 1255, 1257 and 1259 are disposed in the conduits 1252, 1256, 1260, 1264 and 1268 respectively to cause the magazine gates 698 through 706 to slowly open but rapidly close by channeling the flow of compressed air to the magazine gate pneumatic actuating cylinders through orifices (not numerically designated in the drawings) included in the control valves 1251, 1253, 1255, 1257 and 1259 while permitting air to be bled from the magazine gate pneumatic actuating cylinders via check valves (not numerically designated in the drawings) also included in the control valves 1270–1278.

The magazine gate valves 1240–1248 have coils 1270–1278 respectively and the coils 1270–1278 are each connected to the electrical supply terminal 862 via the conductors 882 and 866 and conductors 1280–1288 so that the coils 1270–1278 can be energized via connection of such coils to the conductor 880 that leads to the electrical supply terminal 860 as described above. The valves 1240–1242 have first sections 1290–1298 respectively that are interposed between the input and output ports of the valves 1240–1248 respectively when the coils 1270–1278 respectively are energized and the valves 1240–1248 have second sections 1300–1308 respectively that connect the output ports of the valves 1240–1248 to the exhaust ports of the valves when the coils 1270–1278 are de-energized. Thus, any one of the gates 698–706 can be opened by energizing the coil of the magazine gate valve that transmits compressed air to the magazine gate pneumatic actuating cylinder connected to that gate and any gate can be closed by de-energizing such coil.

Two conducting paths are provided from the electrical supply terminal 860 to each of the coils 1270–1278 of the magazine valves 1240–1248 respectively as shown in FIG. 34. These paths are provided to the coils 1272–1278 of the second through fourth magazine gate valves 1242–1248, that control the second through fifth magazine gates 702–706 respectively in a manner that differs from the provision of such conducting paths to the first magazine gate valve 1240 that controls the first magazine gate 698 so that it will be useful to first consider the control of the first magazine gate 698 and then consider the control of the remaining gates 702–706 together.

As shown in FIG. 34, the electric-pneumatic control system of the apparatus 40 comprises a time delay relay 1310 which is the same type of relay that is used in the optical sensor circuits that are used to close the stream gates and sequence the discharge of the scales 347 and 349. In addition to a plurality of normally closed contacts, such relay has a plurality of normally open contacts, one of which has been illustrated in FIG. 34 and designated by the numeral 1312 therein. The contact 1312 is serially connected to the normally open switch 766 which is mounted on the first gate 698 via a conductor 1314 and the serially connected switch 766 and contact 1312 are connected between the conductor 880, leading to the electrical supply terminal 860 and the coil 1270 of the first magazine valve 1240 via conductors 1316 and 1318 respectively. Thus, the coil 1270 can be energized to cause the valve 1240 to supply compressed air to the pneumatic actuating cylinder 732, thereby initiating the opening of the first gate 698, by momentarily closing both the switch 766 and the contact 1312. As has been noted above, the switch 766 will be closed at any time that a charge of filamentary material is deposited on the first gate 698 of the magazine 72. Since the contact 1312 is a normally open contact, such contact will be closed when the time delay relay has been energized providing that a delay period on the operation of the time delay relay following energization of the relay 1310 has lapsed. Such delay period on the operation of the relay 1310 is variable via an external resistor (not shown) in the same manner that the delay on operate time period can be set for the time delay relays 608–614 to which the time delay relay 1310 is identical. To energize the time delay relay 1310, the input terminals thereof are connected to the conductor 882, via a conductor 1320, that leads to the electrical supply terminal 862 and to the normally closed switch 858, via a conductor 1322, that, in turn, is connected via a conductor 1324 to the conductor 880 that extends to the electrical supply terminal 860. As noted above, the switch 858 is a normally closed switch mounted on the base plate 722 (FIG. 26) of the magazine 72 to be momentarily opened by the terminal link 748 that connects to the pivoting shaft 720 of the first gate 698 each time the first gate 698 becomes completely opened. Thus, at most times the switch 858 will be in its normally closed condition to energize the time delay relay 1310 and hold the contact 1312 thereof closed. Accordingly, should a charge of filamentary material be deposited on the first gate 698 after the time delay relay 1310 has been energized for a period equal to or exceeding the delay on operate period set into the relay 1310, the contact 1312 will be closed and the charge of filamentary material will close the switch 766 to energize the coil 1270 of the first magazine gate 1240 to cause compressed air to be transmitted to the port 754 of the first magazine gate pneumatic actuating cylinder 732 and initiate opening of the first gate 698.

The second conducting path from the conductor 880 (leading to the electrical supply terminal 860) to the coil 1270 of the first magazine gate valve 1240 is provided by the normally closed completion switch 784 of the gate opening completion assembly 774 and conductors 1326 and 1328. Thus, once opening of the first gate 698 has been initiated by closure of the control switch 766 located on the first magazine gate 698, the first magazine gate 698 is caused to swing fully open by the gate opening completion assembly 774 via the construction of such assembly to maintain the switch 784 in its normally closed condition during the opening of the first magazine gate 698 that has been discussed above. At the time that the first magazine gate 698 reaches the fully open position thereof, the control switch 766 will have passed below the rods 780 and 782 of the shield assembly 776 so that the control switch 766 will have reverted to its normally open condition, to disrupt one of the conducting paths to the coil 1270 of the magazine gate valve 1240, when the first gate fully opens. Thus, when the completion switch 784 is also opened at the completion of the opening of the first gate 698, as described above, the coil 1270 will be de-energized to cause the port 754 of the magazine gate pneumatic actuating cylinder 732 to be exhausted via the second section 1300 of the valve 1240. Accordingly, once the first magazine gate 698 is fully opened, the first magazine gate 698 will be rapidly drawn closed by the springs 750 and 752 shown in FIG. 26. At the same time that the completion switch 784 is opened to cause the first magazine gate 698 to swing shut, the terminal link 748 (FIG. 26) engages the switch arm of the switch 858 to cause the time delay relay 1310 to be momentarily de-energized. Thus, immediately following the closure of the first magazine gate 698, the contact 1312 of the time delay relay 1310 will be open so that, until the time delay on the operation of the time delay relay 1310 has elapsed, the conducting path to the coil 1270 of the first magazine gate valve 1240 cannot be completed through the control switch 766 on the first magazine gate 698. At the same time, the normally closed completion switch 784 of the gate opening completion assembly 744 will be held open by engagement of the switch arm thereof by the screw 818 on the switch operator positioning arm 812 as has been discussed above. Thus, immediately following the closure of the first magazine gate 698, and until the time delay period for the time delay relay 1310 has elapsed following the momentary opening of the switch 858, the first magazine gate 698 cannot be opened by a charge of filamentary material falling on the normally open control switch 766. By this means, the magazine 72 is prevented from discharging consecutively produced charges of filamentary material at a rate greater than a preselected rate determined by the time delay period set into the time delay relay 1310 required for the contact 1312 of the time delay relay 1310 to be closed following energization of the time delay relay 1310. Thus, by operating remaining portions of the apparatus 40 at a rate that will produce charges at intervals that, on the average, are slightly shorter than the time delay period set into the relay 1310 so that the chambers 710–716 can be used to store charges and transfer charges to the chamber 708 each time the chamber 708 is discharged, the magazine 72 is caused to receive charges of filamentary material at irregular intervals and discharge these charges at regular intervals equal to the time delay period established for the time delay relay 1310.

Two conducting paths are similarly provided between the electrical supply terminal 860 and the coil of each of the other magazine gate valves 1242–1248. One conducting path to each of the coils includes one of the magazine gate control switches 832–838 and the other of the conducting paths includes one of the completion switches 824–830 as has been shown in FIG. 34. Thus, the coil 1272 is connected to the conductor 880 that extends to the terminal 860 (as shown in FIG. 31) via the magazine gate control switch 832, the switch 832 being connected to the conductor 888 via a conductor 1330 and to the coil 1272 via a conductor 1332, and the magazine control switch 824 is connected to the conductor 860 via the completion switch 824 which is connected in parallel with the switch 832 via conductors 1334 and 1336. The coil 1274 is connected to the conductor 880 via the gate control switch 834, the switch 834 being connected to the conductor 880 via a conductor 1338 and to the coil 1274 via a conductor 1340, and the coil 1274 is connected to the conductor 880 via the completion switch 826 that is connected in parallel with the switch 834 via conductors 1342 and 1344. The coil 1276 is connected to the conductor 880 via the gate control switch 836, the switch 836 being connected to the conductor 880 via a conductor 1346 and to the coil 1276 via a conductor 1348, and the coil 1276 is connected to the conductor 880 via the completion switch 828 which is connected in parallel to the switch 836 via conductors 1350 and 1352. The coil 1278 is connected to the conductor 880 via the gate control switch 838, the switch 830 being connected to the conductor 880 via a conductor 1354 and to the coil 1278 via a conductor 1356, and the coil 1278 is connected to the conductor 880 via the completion switch 830 which is connected in parallel with the switch 838 via conductors 1358 and 1360.

The particular switches disposed in the conducting paths to the coils 1272–1278 enters into the scheme of operation of the charge storage magazine 72. Each of the completion switches 824–830 is both mechanically and electrically associated with a particular gate, the mechanical association stemming from the inclusion of the completion switches 824–830 in gate discharge completion assemblies (not shown) that are mechanically coupled to the second through fifth gates 700–706 respectively in the same manner that the gate discharge completion assembly 774 is coupled to the first magazine gate 698 and the electrical association stemming from the electrical connections of the switches 824–830 with the valves 1242–1248 respectively that control the opening of the second through fifth gates 700–706 respectively by providing compressed air to the magazine gate pneumatic actuating cylinders 732–764 respectively that are mechanically connected to the second through fifth gates 700–706 respectively. The association of each of the completion switches 824–830 with a particular magazine gate 700–706, both mechanically and electrically, provides a feed back loop between each of the magazine gates 700–706 and the magazine gate valves 1242–1248 that control the opening of the magazine gates 700–706 respectively. That is, should the coil of one of the magazine gate valves 1242–1248 become momentarily energized to commence the opening of one of the magazine gates, the commencement of the opening of such magazine gate will permit the completion switch mechanically associated with such magazine gate to assume its normally closed position, in the same manner that the completion switch 784 assumes its normally closed position upon commencement of opening of the first magazine gate 698, so that such completion switch will supply electrical power to the magazine gate valve that controls the magazine gate being opened to cause the opening of such gate to continue until such gate is fully opened. For example, should the magazine gate valve 1246 become energized to supply compressed air to the pneumatic actuating cylinder 762 to cause the fourth magazine gate 704 will cause the completion switch 828 to assume its normally closed position to maintain the supply of electrical power to coil 1276 of the magazine gate valve 1246 until the fourth magazine gate 704 has been completely opened.

The gate control switches 832–838, on the other hand, are mechanically associated with one magazine gate and electrically associated with the next higher magazine gates Thus, the gate control switches 832–838 are mechanically associated with the first through fourth magazine gates 698–704 respectively via the mounting of the switches 824–830 on the magazine gates 698–704 respectively as shown in FIG. 24 but the gate control switches 832–838 are electrically associated with the magazine gates 700–706 respectively via the connection of the switches 832–838 to the magazine gate valves 1242–1248 respectively that control the opening of the magazine gates 700–706 respectively. For example, the gate control valve 834 is mounted on, and thereby mechanically associated with, the second magazine gate 700 as shown in FIG. 24 but is electrically associated with the third magazine gate 702 via the electrical connection between the switch 834 and the coil 1274 of the magazine gate valve 1244 that controls the third magazine gate 702 via the supply of compressed air to the magazine gate pneumatic actuating cylinder 760, that is connected to the third magazine gate 702, by the magazine gate valve 1244. The mechanical association of each of the gate control switches 832–838 with one magazine gate and the electrical association of each of the gate control switches 832–838 with the next higher gate is utilized to cause the charge storage magazine 72 to sequentially stack charges of filamentary material in the chambers 708–716 of the charge storage magazine 72 when charges are received by the charge storage magazine 72 at a rate that exceeds the rate at which charges can be discharged from the charge storage magazine 72 and, subsequently, to discharge the stored charges in the order in which the charges are received by the charge storage magazine 72 by causing the charges to move sequentially down the chambers 708–716 to the final one of such chambers; that is, the first chamber 708 from which each charge can be discharged from the charge storage magazine 72.

Initially, consider that the charge storage magazine is empty of charges of filamentary material. In such case, the first magazine gate 698 will assume its closed position. If the magazine gate 698 is initially closed, the switch arm 788 of the completion switch 784 (FIG. 28) will be depressed by the screw 889 on the switch operator positioning arm 812 (FIGS. 27 and 28) as discussed above so that the switch 784 will be open to open one of the two conducting paths to the magazine gate valve coil 1270. Similarly, in the absence of a charge of filamentary material in the first magazine chamber 708, the gate control switch 766 mounted on the first gate 698 will assume its normally open position to open the second of the conducting paths to the coil 1270 of the valve 1240. Thus, the coil 1270 will be de-energized so that the valve 1240 blocks the transmission of compressed air to the magazine gate pneumatic actuating cylinder 732 permitting the springs 750 and 752 to maintain the first gate 698 in the closed position. If, on the other hand, the first gate 698 is initially open, the switch operator 790 will be in the position shown in dashed lines in FIG. 28 to depress the switch arm 788 of the completion switch 784, thereby interrupting one conducting path to the coil 1270 of the valve 1240 and the switch 858 will be actuated, and thereby opened, by the link 748 connected to the pivoting shaft 720 of the first gate 698 to de-energize the time delay relay 1310. The de-energization of the relay 1310 permits the contact 1312 thereof to assume its normally open position so that the second conducting path to the coil 1270 of the magazine gate valve 1240 will also be interrupted with the result that the coil 1270 will again be de-energized and the magazine gate valve 1240 will not transmit compressed air to the magazine gate pneumatic actuating cylinder 732. Thus, if the first magazine gate 698 is initially opened at such time that no filamentary material is disposed in the charge storage magazine 72, the springs 750, 752 will close such gate. If, initially, the magazine gate 698 is partially opened, the completion switch 784 will be closed so that the coil 1270 will be energized to cause the magazine gate valve 1240 to transmit compressed air to the magazine gate pneumatic actuating cylinder 732 and thereby move the first gate 698 to the fully opened position thereof. When the gate 648 fully opens, switches 784 and 858 will be opened, by the switch operator 790 and the terminal link 748 respectively, and the opening of the switch 858 will de-energize the time delay relay 1310 to permit the contact 1312 thereof to assume its normally open state so that, again, the conducting paths to the coil 1270 will both be open as soon as the first gate 698 moves to the fully open position thereof. Thus, the first gate 698 will be closed by the spring 750, 752 as soon as it moves to the fully open position thereof. Accordingly, so long as no filamentary material is in the charge storage magazine 72, so that no charge of filamentary material can be supported by the first magazine gate 698, the first magazine gate 698 will assume the closed position thereof.

The second through fifth magazine gates 698–706, on the other hand, will assume the open positions thereof at such times that the charge storage magazine 72 contains no charges of filamentary material. In that case, the switches 832–838 that are disposed on the first through fourth magazine gates 698–704 will assume their normally closed positions because of the lack of material in the magazine 72 that could operate the switches 832–838 so that the switches 832–838 will energize the coils 1272–1278 respectively of the magazine gate valves 1242–1248 respectively. Thus, compressed air will be transmitted to the magazine gate pneumatic actuating cylinders 758–764 that are connected to the second through fifth magazine gates 700–706 to open such gates. It will be noted that the movement of the second through fourth magazine gates 700–706 to the open positions thereof will result in the opening of the completion switches 824–830 associated with the gates 700–706 respectively in the same manner that movement of the first gate 698 to the open position thereof opens the completion switch 784 as described above but, in the absence of material in the magazine 72, the switches 832–838 will remain closed. Thus, to cause any of the second through fourth magazine gates 700–706 respectively to be closed it is necessary to open the gate control switch 832–838 that is electrically associated with such gate as described above.

Should a charge of filamentary material enter the charge storage magazine 72 at a time that the charge storage magazine 72 is empty, such charge of filamentary material will pass through the open second through fourth magazine gates, 700–706 respectively, to land on the closed first magazine gate 698. When the charge of filamentary material lands on the first magazine gate 698, the charge will depress the switch arms of switches 766 and 832 which are mounted on the first magazine gate 698 to close the switch 766 and open the switch 832. If the time that has elapsed since a previous discharge of a charge of filamentary material from the charge storage magazine 72; that is, since the switch 858 was opened by the terminal link 748 attached to the pivoting shaft 720 of the first gate 698, is greater than the delay on operate time that has been set into the time delay relay 1310, the time delay relay 1310 will have been energized for a time period that is long enough to cause the normally open contact 1312 thereof to have closed so that the closure of the normally open switch 766 mounted on the first gate 698 will complete a conducting path to the coil 1270 of the magazine gate valve 1240 to cause the magazine gate valve 1240 to operate so as to transmit compressed air to the magazine gate pneumatic actuating cylinder 732. Thus, when the charge of filamentary material lands on the first magazine gate 698, such gate begins to open to discharge such charge of filamentary material from the charge storage magazine 72. The opening of the normally closed gate control switch 832, which is also mounted on the first magazine gate 698, will open the one conducting path to the coil 1272 of the magazine gate valve 1242 that exists when the second magazine gate 700 is open so that the coil 1272 is de-energized. The de-energization of the coil 1272 of the magazine gate valve 1242 causes the magazine gate pneumatic actuating cylinder 758 to be exhausted via the second section 1302 of the magazine gate valve 1272 so that the springs (not shown) used to bias the second magazine gate 700 toward the closed position thereof will immediately move the second magazine gate 700 to such closed position. Thus, with one charge of filamentary material in the charge storage magazine 72, such charge will be located on the first magazine gate 698, and the gate immediately thereabove; that is, the second magazine gate 700 will be closed to receive the next charge. When the next charge enters the charge storage magazine, such charge will thus land on the gate control switch 834 that is mounted on the second gate 700 to cause the third gate 702 to be closed in the same manner that a charge of filamentary material falling on the gate control switch 832 mounted on the first magazine gate 698 causes the second magazine gate 700 to close. As subsequent charges enter the charge storage magazine 72, the mechanical association of the gate control switches 832–838 with gates below the gates with which the switches 832–838 are electrically associated will cause the magazine gates 700–706 to close each time chambers below such gates receive a charge of filamentary material so that the chambers 708–706 of the charge storage magazine 72 will tend to fill up one after the other beginning with the lowermost chamber 708 of the charge storage magazine 72.

At the same time that charges of filamentary material are being injected into the uppermost chamber 716 of the charge storage magazine 72 to fill the charge storage magazine 72, charges will be being discharged from the lowermost chamber 708 of the charge storage magazine and transferred from chamber to chamber down the charge storage magazine 72. In particular, when the lowermost magazine gate 698 opens in response to the closure of the gate control switch 766, the charge of filamentary material thereon will be dropped off the gate control switch 832 that is mounted on the first magazine gate 698 and electrically connected to the coil 1272 of the magazine gate valve 1242 that controls the magazine gate pneumatic actuating cylinder 758 that is connected to the second magazine gate 700. Thus, the discharge of a charge of filamentary material from the lowermost magazine chamber 708 initiates the opening of the second magazine gate 700 near the completion of the opening of the first magazine gate 698. The rods 780 and 782 of the shield assembly 778 are canted downwardly as shown in FIG. 24 and the switch 832 is positioned on the rod 728 of the first magazine gate 698 such that the charge of filamentary material in the first magazine chamber 708 will hold the normally closed switch 832 open until the first magazine gate 698 is nearly open with the result that the first magazine gate will reach the fully open position thereof and be rapidly closed before the second magazine gate 700 is opened sufficiently to permit a charge of filamentary material on the second magazine gate 700 to leave the second magazine chamber 710. Thus, after the charge of filamentary material in the first magazine chamber 708 has been discharged, the second magazine gate 700 will open sufficiently to permit any charge of filamentary material in the second magazine chamber 710 to fall on the now closed first magazine gate 698. When the charge from the second magazine chamber 710 lands on the first magazine gate 698, such charge will again open the gate control switch 832 so that, as soon as the second magazine gate 700 opens to also open the gate completion switch 824 associated therewith, the second gate 700 will again immediately swing to the closed position thereof. The discharge of the second magazine chamber 710 will cause the gate control switch 834 to assume its normally closed position so that, as the second magazine chamber 710 is discharged, the third magazine gate 702 will begin to open. Thus, if a charge of filamentary material is disposed in the third magazine chamber 712, such charge will be discharged onto the closed second magazine gate 700. Such operation will continue sequentially for the magazine gates 702–706 so that the discharge of a charge of filamentary material from the magazine 72 results in charges that are currently contained in the magazine 72 being transferred one after the other to the next lower gate. Further, the gate above the last charge of filamentary material to be transferred from one magazine chamber to the next lower magazine chamber will be closed, to receive any additional charge of filamentary material that is injected into the charge storage magazine 72 following the sequential transfer of charges down the magazine chambers of the charge storage magazine 72. This will occur because the last charge of filamentary material to be transferred from one chamber to the next lower chamber will be disposed on the gate control switch that is connected to the coil of the magazine gate valve that controls the magazine gate from which such last charge has been transferred with the result that such gate control switch will be open to close the magazine gate thereabove. Higher gates will be open because of the lack of filamentary charges in higher chambers that might open the normally closed gate control switches on such higher gates in the manner that has been described above for the case in which the magazine 72 is empty.

OPERATION OF THE PREFERRED EMBODIMENT

The above described construction and operation of each of the major components of the apparatus 40 results in a coaction between such components that causes the apparatus 40, operating as a whole, to disintegrate bales of filamentary material placed on the conveyor 44 and discharge the filamentary material as a series of charges that have the same weight and are discharged at uniform intervals. A convenient way of describing the operation of the apparatus 40 to achieve these results is to consider the sequence of events that will occur when the apparatus 40 is turned on for the first time and a bale of filamentary material is placed on the conveyor 44.

The apparatus 40 is placed into operation by filling the reservoir from which the conduit 214 draws antistatic compound, connecting the electrical supply terminals 860, 862 to a suitable source of 110 volt alternating current, and turning on the compressor 884. (For reasons that will become clear below, it is sometimes useful to delay turning on the compressor 884 for a short period following the connection of the electrical supply terminals 860, 862 to a source of electricity.) When electrical power is supplied to the apparatus 40, the motor (not shown) that rotates the drum 50 immediately begins operating so that the drum 50 begins to rotate. At the same time, since the drum will be empty of filamentary material, the endless belt 74 of the conveyor 44 will begin to move so that bales can be introduced into the drum 50 by placing the bales on the conveyor 44. The dependence of the operation of the conveyor 44 on the drum 50 being empty stems from the connection of the motor (not shown) that drives the conveyor 44 to the terminals 860, 862 through the switch 182 of the conveyor disabling assembly 160 that has been described above.

At the time that power is applied to the apparatus 40, all of the magazine gate valves 1240–1248 in the magazine 72 will be de-energized so that, without regard to whether the compressor 884 is on, all gates of the magazine 72 will be closed by the springs used to urge the magazine gates to their closed positions. Similarly, since no charges of filamentary material will be in the magazine 72 to depress the switch arms of any of the switches mounted on the magazine gates, all such switches will be in their normally open or normally closed positions. Thus, as described above, the coils 1772–1778 of the magazine gate valves 1242–1248 will become energized with the supply of electrical power to the apparatus 40 and, when the compressor 884 is turned on, the valves 1242–1248 will transmit compressed air to the magazine gate pneumatic actuating cylinders 758–764 so that the upper four magazine gates 700–706 will be opened as soon as electrical power has been applied to the apparatus 40 and the compressor 884 has been turned on. As further discussed above, the lowermost magazine gate 698 will remain closed until filamentary material has been introduced into the magazine 72.

As power is supplied to the apparatus 40, all blowers thereof will immediately begin to operate, the operation of the blower 194 at the lower end of the treatment chamber 66, the drum air blower 54, and the transfer blower 638 being caused by the direct connection of the motors of these blowers to the electrical supply terminals 860, 862. The immediate operation of the stream blowers 406–412, on the other hand, stems from the state of the charge storage magazine 72 when the apparatus 40 is placed into operation. As noted above, all of the switches on the magazine gates will be in their normally closed, or normally open, conditions so long as there is no filamentary material in the magazine 72 with the result that the switch 842 on the fifth magazine gate 706 will be closed at the time that the apparatus 40 is placed into operation. As can be seen from the connection of the conductors 876, 878 to the conductors 864 and 866 that terminate in the terminals 860, 862 in FIG. 31 and the connection of the stream blowers 406–412 to the conductors 876 and 878 through the switch 842 in FIG. 33, the blowers 406–412 will be turned on at all times that the switch 842 is in the normally closed state thereof. Thus, the stream blowers 406–412 begin to operate when electrical power is applied to the apparatus 40. At the same time that the stream blowers 406–412 are turned on, the motor 326 of the filament separation assembly 64 is also turned on by electrical power transmitted by the switch 842 so that, as soon as electricity is supplied to the apparatus 40, the picker roll 316 and the paddle wheel 288 will begin to rotate.

Before electricity is supplied to the apparatus 40 and the compressor 840 is turned on, the damper 96 of the damper assembly 90 shown in FIG. 4 will be positioned over the inlet 88 of the drum air blower 54 by the spring 100 of the damper assembly 90 when electrical power is supplied to the apparatus 40, the first coil of the valve 892 (FIG. 29) that opens the damper 96 will be energized so that, as soon as the compressor 884 is turned on, compressed air will be transmitted via the valve 892 to the port 106 of the pneumatic actuating cylinder 102 to commence the opening of the damper 96. The energization of the coil 896 of the valve 892 stems from the lack of filamentary material in the magazine 72 so that the switch 840 on the fourth magazine gate 704 will be in the normally closed state thereof and from the lack of filamentary material in the picking chamber 262 when the apparatus 40 is first placed into operation. In the absence of filamentary material in the picking chamber 262 that could engage the sensor plates 306, 308 and pivot the cam 310 on the rod 302, from which the sensor plates 306, 308 are suspended, the switch 312 will assume its normally closed position to complete the electrical circuit through the coil 896 of the valve 892.

Before electricity is supplied to the apparatus 40, the time delay relays 608–614 of the optical sensor circuits will be in a de-energized state so that the normally closed contacts thereof will be closed. Since the time delay relays 608–614 are connected into the optical sensor circuits to cause a delay in the opening of these contacts for a short period following the energization of these relays, such contacts will remain closed for a short period following the connection of apparatus 40 to a source of electricity. Thus, the relays 608 and 612 will cause the discharge assembly of the apparatus 40 to operate without regard to the presence of quantity of filamentary material on the scales 347, 349 when the apparatus 40 is first supplied with electricity. It is for this reason that it is convenient to connect the apparatus 40 to an electrical supply prior to turning on the compressor 884. If the apparatus 40 has been previously operated and only partial charges are located on the scales, one of these partial charges will be discharged from such scale if the compressor 884 is on when electricity is supplied to the apparatus 40 because of the initial discharge sequence that occurs when the apparatus 40 is first supplied with electricity. If the compressor is off, the discharge assembly will carry out only the electrical operations involved in the discharge of a scale so that any partial charge on a scale at the time the electricity is supplied to the apparatus 40 will remain thereon. After electricity has been supplied to the apparatus 40 for a short period equal to the time delay selected for the relays 608 and 612, the discharge assembly will be placed under the control of the optical sensor circuits as has been described so that partial charges on the scales 347, 349 can not be discharged therefrom.

Thus, if the compressor 884 is turned on after electricity is supplied to the apparatus 40, there will be no need to ever discard the first few charges produced by the apparatus 40, a situation that can arise if partial charges are on the scales when the apparatus 40 is placed into operation. Of course, when the apparatus 40 is initially placed into operation, no filamentary material will be disposed on the scales 347, 349 so that the order of turning on the compressor and supplying electricity to the apparatus 40 will be immaterial.

When electricity is first supplied to the apparatus 40, the contact 1012 of the time delay relay 608 will supply electricity to the set coil 1078 of the first latching relay 1076 and, concurrently, the contact 1014 will supply electricity to the set coil 1084 of the second latching relay 1082 so that both of the latching relays 1076 and 1082 will tend to make a transition to their set conditions. One of the latching relays 1076, 1082 will set first, to discontinue the transition to the set condition for the other relay, and the setting of one of the relays 1076 and 1082 will cause the motor 1016 to operate to turn the cam shaft 1018 to the position shown in FIG. 33 at which time the latching relay that has been set will be reset. Thus, shortly after electricity is supplied to the apparatus 40, the switch arm 1036 of the switch 1026 will be disengaged by the cam 1046 with the result that the coil 1178 of the discharge damper valve 1176 will be de-energized no later than a short time following the application of electrical power to the apparatus 40 and will remain de-energized until the cam shaft 1018 is caused to undergo a revolution by the accumulation of a charge on one of the scales 347, 349. Thus, the discharge damper 654 will be closed shortly after electricity has been supplied to the apparatus 40 and the compressor 884 is turned on to supply pressurized air to the port 660 of the discharge damper pneumatic actuating cylinder 656 via the second section 1170 of the discharge damper valve 1176.

Similarly, the stream gates 426, 428, 448, and 450 will open within a short time of the application of electrical power to the apparatus 40 and the supply of compressed air thereto. When the time delay relays 610 and 614 operate following energization to open the contacts 944 and 946, thereby de-energizing coils 952 and 962 of the valves 951 and 964 respectively, compressed air will be transmitted to the stream gate pneumatic actuating cylinders 558 and 578 to cause the piston rods of the cylinders 558 and 578 to extend to open the second stream gates 448 and 450. When the time delay relays 608 and 612 operate following energization to open the contacts 970 and 976, and following any operation of the discharge system caused by the initial closed condition of the contacts 1012 and 1014 of the relays 608 and 612, the coils 976 and 998 of the first stream gate valves 978 and 1000 will be de-energized to bleed the first stream gate pneumatic actuating cylinders, thereby permitting the first stream gates 426 and 428 to open of their own accord.

When the compressor 884 is turned on, the scale selector valve 1148 will have one of the two sections 1156, 1158 thereof interposed between the inlet and outlet ports thereof so that compressed air will be supplied to the scale selector pneumatic actuating cylinder 673 to move the scale selector damper 674 to either the position shown in solid lines or the position shown in dashed lines in FIG. 23. Correspondingly, the deflector assembly 356 will be moved to one of the positions shown in solid and dashed lines in FIG. 14 by the scale selector valve 1148 so that the transport of filaments to one of the scales 347, 349 by the stream forming assembly 70 will be favored over the transport of filaments to the other scale as has been discussed above. The apparatus 40 will now be in a condition to begin disintegrating bales of filamentary material that are placed on the conveyor 40 and to produce a stream of accurately weighed charges of filamentary material that will be discharged from the lower end of the charge storage magazine 72.

After the apparatus 40 has been placed into operation as described above, a bale of filamentary material 46 is placed on the endless belt 74 of the conveyor 44 and such bales are delivered into the input port 52 of the drum 50. As discussed above, the drum 50 will be rotating so that, as flakes of filamentary material fall from the bales and into the drum, the drum 50 will decompose the flakes into tufts which will fall across the interior of the drum 50. Initially, the damper 96 mounted on the drum air blower 54 will be in a position shown in FIG. 4 so that the drum air blower 54 will provide a stream of air through the drum 50 to blow the tufts into the filament treatment chamber 66. These tufts will gravitate to the hopper 192 and be drawn therefrom by the blower 194 and delivered via the conduit 198 to the filament distribution assembly 354 at the top of the filament precipitation tower 352.

Upon entering the filament distribution assembly 354, the tufts will strike the comb 362 and be deflected downwardly into the filament precipitation tower 352 through which the tufts will fall to strike the deflection assembly 356. Upon striking the deflection assembly 356, tufts will be deflected toward one or the other of the side walls 268, 270 of the picking chamber 262, such side wall 268 or 270 toward which the tufts are deflected depending upon whether the deflection assembly 356 is in the position shown in solid or dashed lines in FIG. 14. As the filaments enter the picking chamber 262, the tufts will be directed by the shelves 284 and 286 toward the comb 276 and will be pulled tightly against the comb 276 via the air flow 348 produced as discussed above. Thus, the teeth 324 of the picker roll 316 will engage filaments of the tufts to strip filaments from the tufts and, concurrently, move the tufts upwardly along the comb 276. The filaments that are stripped from the tufts will be delivered into the output portion 282 of the picking chamber 262 to be delivered to the scales 347, 349. Remaining portions of the tuft will be engaged by the paddles 292 on the paddle wheel 288 and deflected downwardly to begin the formation of the filament supply roll 298 within the input portion 280 of the picking chamber 262. The filament supply roll 298 will continue to grow until the supply roll 298 is large enough to engage the sensor plates 306, 308 and pivot the rod 302, and cam 310 mounted on the rod 302, sufficiently to open the switch 312. When the switch 312 is opened, the coil 896 of the valve 882 is de-energized to interrupt the flow of compressed air the port 106 of the pneumatic actuating cylinder 102 with the result that the damper 96 moves to a position overlaying the inlet 88 of the drum air blower 54. Thereafter, the drum discharge disabling assembly 300, which comprises the sensor plates 306, 308, the rod 302, and the cam 310, will control the drum air blower 54 to maintain the filament supply roll 298 at a preselected size.

The filaments that are drawn initially from the tufts entering the picking chamber 262, and thereafter from the supply roll 298 by the picker roll 316, will be stripped from the teeth 324 of the picker roll 316 by the air streaming along the path 346 as the filaments enter the output compartments 338-344 with two such compartments receiving filaments at a higher rate than the remaining two compartments. Such difference in the rates at which the compartments 338 and 342, that comprise the first plenum, and the compartments 340 and 344, that comprise the second plenum, receive filaments occurs because of the deflection of tufts toward one or the other of the side walls 268, 270 of the picking chamber 272 by the deflection assembly 356 as has been discussed above so that, initially, more tufts are disposed toward one end of the picker roll 316 than the other end thereof and, later, the supply roll 298 is concentrated toward one end of the picker roll 316. Thus, filaments will be drawn into the two blowers 406 and 410 having inlets opening into the first plenum comprised of the output compartments 338 and 342 at a rate that differs from the rate at which filaments are drawn into the stream blowers 408, 412 opening into the second plenum comprised of the output compartments 340, 344. Moreover, filaments will be drawn into the stream blowers 410, 412 at a greater rate than filaments are drawn into the stream blowers 406 and 408 because of the relative sizes of the output compartments 338–344. As a result, two streams of filaments will be formed to each scale, a first stream having a relatively low filament transport rate and a second stream having a higher filament transport rate and, in addition, the two streams of filaments to one scale will have a higher combined filament transport rate than the combined filament transport rate of the two streams to the other scale. Thus, for example, if the deflection assembly 356 is in the position shown in solid lines in FIG. 14, the combined filament flow rate in the two streams of filaments to the first scale will exceed the combined filament flow rate in the streams to the second scale. Conversely, if the deflection assembly 356 is initially in the position shown in dashed lines in FIG. 14, the combined filament flow rate in the two streams to the second scale 349 will exceed the combined filament flow rate of the two streams of filaments to the first scale 347. For both scales 347 and 349, the second stream of filaments to such scale will have a larger filament flow rate than the first stream of filaments thereto.

As the two streams of filaments to each of the scales enters the scale tower 414, such streams are deflected to move horizontally along the floor 454 of the upper section 452 of the scale tower 414 while the air that transports the streams is discharged from the top of the scale tower 414, as described above, with the result that the filaments in such streams begin to rain downwardly on the scales 347 and 349 through the open stream gates 426, 428, 448 and 450. Thus, filaments begin to accumulate on the scales 347 and 349 and, moreover, since the combined flow rate of the two streams of filaments to one scale exceeds the combined filament flow rate to the other scale, filamentary material will begin to accumulate on one scale, 347 or 349, at a greater rate than filamentary material begins to accumulate on the other scale. Thus, if the deflection assembly 356 is in the position shown in solid lines in FIG. 14, filaments will begin to accumulate on the first scale at a greater rate than filaments will accumulate on the second scale while, if the deflection assembly 356 is in the position shown in dashed lines in FIG. 14, filaments will begin to accumulate on the second scale at a greater rate than the accumulation of filaments on the first scale 347.

At some time following the initiation of the accumulation of filaments on the scales 347 and 349, a preselected portion of a charge of filamentary material sufficient to move the second mask on the weight indicator arm of a scale into one of the two optical sensors provided for each scale will have accumulated on that scale which is receiving filaments at the greater rate. Thus, if the first scale 347 is receiving filaments at a greater rate than the scale 349, the second mask 590 will move into the optical sensor 601 to cause the optical sensor circuit of which the sensor 601 is a part to de-energize the time delay relay 610. Similarly, if the second scale 349 is receiving filaments at the greater rate, the accumulation of the preselected portion of a charge weight on the second scale 349 will de-energize the time delay relay 614. At this point, the second stream gate, 448 or 450, above the scale that is accumulating filaments at the greater rate will be closed in the manner that has been discussed above. Such scale then accumulates filaments at the lower rate that is provided by the first stream of filaments to such scale.

Shortly following the closure of the second stream gate 448 or 450 above one of the scales 347 or 349, the charge on that scale will accumulate via the first stream of filaments flowing thereto to complete a charge so that, if such scale is the first scale 347, the relay 608 will be de-energized, as discussed above, and, if such scale is the second scale 349, the time delay relay 612 will be de-energized. With the de-energization of one of the relays 608 or 612, one of the latching relays 1076 or 1082 will set to commence the rotation of the cam shaft 1018 to sequentially close the contacts of the switches 1022 and 1030 so that a discharge sequence, as described above, is carried out to discharge the scale upon which the charge has accumulated.

While one of the scales 347, 349 is being discharged, the other scale continues to accumulate filaments, initially at the lower rate occasioned by the initial position of the deflection assembly 356 and then at the higher rate resulting from the positioning of the deflection assembly 356 that occurs during scale discharge, so that the second stream gate above the other scale will also eventually close as a result of the accumulation of the preselected portion of a charge on such other scale and, thereafter, the first stream gate above such other scale will also close following the accumulation of a complete charge on such other scale. If the accumulation of a complete charge on the scale that is initially being provided with filaments at the slower rate occurs during the discharge of the scale which receives filaments at the greater initial rate, the accumulation of the complete charge on lagging scale will not result in the discharge of such scale because of the lockout feature provided the two latching relays discussed above in which the set coil of each latching relay is connected to a contact in one of the time delay relays 608, 612 via a normally closed contact in the other latching relay. Thus, the scale initially receiving filaments at the lower rate will be discharged only if the discharge sequence has been completed for the scale which initially receives filaments at the higher rate. Otherwise, the stream gates above the scale which initially receives filaments at the lower rate will close to prevent an excessive charge of filamentary material from being accumulated on that scale but the completed charge on that scale will not be immediately discharged therefrom. It will be useful to consider the circumstance that the scale which initially receives filaments at the lower rate completes the accumulation of a charge while the scale that has initially received filaments at the higher rate is being discharged. For this purpose, it will be assumed that the deflector assembly 356 is initially in the position shown in solid lines in FIG. 14 so that the first scale to be discharged is the first scale 347.

During the discharge of the first scale 347, the first coil 1146 of the scale selector valve 1148 will be energized to interpose the first section 1156 of such valve between the inlet and outlet ports thereof. One result of such interposition is to transmit compressed air to the port 390 of the deflector pneumatic actuating cylinder 384 while exhausting the port 388 of the pneumatic actuating cylinder 384 so that the deflection assembly 356 is shifted to the position shown in dashed lines in FIG. 14. Thereafter filaments will be provided to the second scale 349 at the higher of the two rates determined by the deflection assembly 356 while filaments will be supplied to the first scale 347 at the lower of these two rates. When the first scale completes discharging, the previous accumulation of a complete charge on the second scale will result, as discussed above, in the discharge of the second scale very quickly following the discharge of the first scale 347. During discharge of the second scale, the coil 1160 of the scale selector valve 1148 will be energized to provide pressurized air to the port 388 of the deflector pneumatic actuating cylinder 384 to return the deflection assembly 356 to the position shown in solid lines in FIG. 14 so that the first scale again receives filaments at a greater rate than filaments are received by the second scale 349. The quick return of the deflection assembly 356 to the position shown in solid lines in FIG. 14 to again enhance the streaming of filaments to the first scale 347 after the scale 347 has been discharged tends to synchronize the two scales. That is, the second scale which had initially accumulated a charge very shortly after the accumulation of a charge on the first scale is caused to receive filaments at the lower rate very quickly following the discharge of such scale while the first scale will again receive filaments at the higher rate very quickly after the discharge of the second scale. Thus, the lag time between the discharge of the second scale behind the discharge of the first scale will be increased by the rapid return of the deflection assembly 356 to a position that enhances the flow of filaments to the first scale while reducing the flow of filament to the second scale. Thus, the time difference between the next discharge of the first scale and the next discharge of the second scale will be increased with respect to the time difference between the initial discharge of the first scale and the initial discharge of the second scale. With repeated discharges of the two scales, the result will be that each scale discharges at substantially the center of the time period in which the other scale accumulates a charge.

It will be noted that such centering of the discharge of one scale on the accumulation time period for the other scale will not necessarily result in the charges being blown from the two scales exiting such scales at a constant rate. Rather, the rate at which charges are accumulated on the two scales also depends upon the coupling between the picker roll 316 and the filament supply roll 298. Thus, the supply roll concentration assembly 350 will cause the discharge of each scale at the center of an accumulation time period for the other scale but the lengths of the accumulation time periods for the scales may vary as time progresses.

Each of the charges discharged from a scale will be blown into portions of the discharge chute adjacent the inlet 636 of the magazine transfer blower 638 as has been discussed above and, concurrently with the blowing of a charge from a scale, the discharge damper 654 opens, as has been discussed above, so that the magazine transfer blower 638 will transfer the charge to the uppermost chamber 716 of the charge storage magazine 72.

When the first charge of filamentary material to be produced by the apparatus 40 enters the charge storage magazine 72, the four uppermost magazine gates 700–706 will be open while the first, lowest, magazine gate 698 will be closed as has been discussed above. Thus, the first charge of filamentary material will pass through the four uppermost magazine chambers 710–716 to be deposited upon the first gate 698 within the first magazine chamber 708. When the charge of filamentary material lands on the first gate 698, the weight of such charge resting on the switch arm of the normally closed gate control switch 832 will actuate, and thereby open, such switch so that the second gate 700 will be moved to the closed position thereof as has been discussed above. At the same time, the weight of the charge resting on the switch arm 772 of the normally open gate control switch 766 will close such switch to energize the coil 1270 of the magazine gate valve 1240 and initiate the opening of the first magazine gate 698. Once the first magazine gate 698 begins to open, the completion switch 784 of the gate discharge completion assembly 774 closes, as discussed above, to complete the discharge of the charge of filamentary material in the first magazine chamber 708 from the lower end of the magazine 72. Thereafter, the second magazine gate 700 will reopen, because of removal of the weight of the discharged charge from the switch arm of the switch 832 on the first gate 698 as discussed above, so that additional charges of filamentary material introduced into the charge storage magazine 72 will reach the first magazine chamber 708 and be discharged from the charge storage magazine 72.

These additional charges of filamentary material may be held in one or more of the uppermost magazine chambers 710–716 prior to entry into the first magazine chamber 708 and discharge from the charge storage magazine 72 because of the construction of the control system for the apparatus 40 to close each gate of the magazine 72 when a chamber below such gate contains filamentary material and open such gate when the chamber therebelow becomes discharged and because of the temporal spacing of the discharged of charges from the magazine 72 provided by the time delay relay 1310 as discussed above. Since the time delay relay limits the rate at which charges can leave the charge storage magazine 72, it becomes possible for a charge to enter the magazine 72 at a time that the charge cannot be discharged therefrom. When this occurs, the second magazine gate 700 closes to receive the next charge. By operating the filament separation assembly 64 at a rate to produce charges more quickly than the charges are discharged from the charge storage magazine 72, additional magazine gates can be caused to become closed by charges in the chambers below such gates so that the chambers of the magazine will tend to become filled as time passes. Preferably, the motor 326 that drives the picker roll 316 and the damper 96 on the drum air blower are adjusted so that the average rate of delivery of filamentary charges to the charge storage magazine 72 slightly exceeds the rate at which charges can be discharged from the magazine 72 so that the magazine will fill and thereafter discharge charges of filamentary material at a constant rate. Thus, after the apparatus 40 has operated for a time, charges will be disposed in each of the four lowest magazine chambers 708–714. When this situation occurs, the uppermost charge in the charge storage magazine 72 will depress the switch arm of the normally closed switch 840 to open the switch 840 and, as can be seen in FIG. 29 de-energize the coil 896 of the valve 892 that provides compressed air to the pneumatic actuating cylinder that is used to control the damper 96 mounted on the drum air blower 54. Thus, when a charge of filamentary material reaches the fourth magazine chamber 714, the flow of tufts from the drum 50 to the picking chamber 262 will be discontinued so that the delivery of filaments to the scales 347, 349 will be at the expense of the size of the supply roll 298. As the supply roll 298 shrinks, the rate of supply of filaments to the scales 347, 348 will be slowed to permit the magazine 72 to catch up to remaining portions of the apparatus 40 without bringing the operation of the stream forming assembly to accumulate charges on the scales 347, 349 to a halt.

Should an additional charge be introduced into the charge storage magazine 72 despite such slowing of the accumulation of such charges via the opening of the switch 840, an additional charge will land on the switches 842 and 844 to discontinue operation of the stream blowers 406–412 and the motor 326 and discontinue the operation of the discharge assembly in the manner that has been discussed above. Since a return to operation of the blowers 406–412 and the completion of a scale discharge after the motor 1016 of the discharge assembly has been stopped can slow the overall operation of the apparatus 40, it is preferable that stoppage of the motor 1016 and the stream blowers 406–412 not occur. It is for this reason that the switch 840 is placed on the fourth magazine gate 704 rather than on the fifth magazine gate 706. By slowing the accumulation of charges of filamentary material on the scales 347, 349 before the magazine 72 has been filled to capacity, and by mounting switches that discontinue the streams of filaments to the scales 347, 349 on the uppermost gate 706 of the magazine 72, stoppages of the apparatus 42 can be held to a minimum without injecting a charge of filamentary material into the charge storage magazine 72 when the magazine 72 is filled to capacity and without accumulating an excessive charge on the stream gates above the scales 347, 349.

Once the apparatus 40 has been placed into operation, the rate of production of charges by the apparatus can be quickly and easily adjusted to achieve an optimum. The first adjustment is to the time delay relay 1310 which controls the rate of discharge of charges of filamentary material from the magazine 72. The external resistor (not shown) used to set the delay on operate time period is adjusted to provide the maximum discharge rate from the magazine that will permit bagging of the charges whether by machine or by hand. Thereafter, the speed of the motor 326 that drives the picker roll 316 is adjusted to cause filaments to be delivered to the scales 347, 349 at a rate that charges are produced, during continuous operation of the apparatus 40, in a time slightly less than the discharge rate from the magazine 72 so that the magazine will fill and control the operation of the drum air blower 54, the filament separation assembly 64, and the stream blowers 406–412. Finally, the screw adjustment 114 on the damper assembly 90 is adjusted to provide an adequate flow of air through the drum 50 consistent with the rate at which the picker roll 316 is rotated.

During the operation of the apparatus 40, the operator of the apparatus occasionally places a bale of filamentary material on the conveyor 44 to maintain a steady production of the charges and oversees the operation of the apparatus 40 to make adjustments thereto to maintain efficient operation of the apparatus 40. Such adjustments include occasional repositioning of the conveyor disabling assembly 160 to insure a sufficient supply of filamentary material to the drum 50 without clogging the drum 50 and occasional adjustment of the position of the rod 234 to adjust the rate of injection of the anti-static compound into the filament treatment chamber 66 to meet current conditions of humidity.

The apparatus 40 can be turned off at any time and subsequently placed back into operation by discontinuing, and subsequently renewing, the supply of electricity and compressed air to the apparatus 40. With one exception, all components of the apparatus 40 will resume operation at the point that the operation of the components cease when the apparatus 40 is taken out of service. The exception is in the time delay relays 608–614 and the time delay relay 1310. As discussed above, the switching of contacts in each of these relays occurs shortly after the relay is energized. In the case of the relay 1310, this delay will have no substantive effect on the operation of the apparatus 40; at most, the delay merely delays the discharge of the first charge from the magazine 72 for a few seconds when service is resumed. The delay on operate period for the relays 608–614 on the other hand can cause an underweight charge to be discharged from one of the scales 347, 349 as has been discussed above. Such occurrence can be prevented, as also discussed above, by the simple expedient of supplying electrical power to the apparatus 40 for a few seconds before the compressor 884 is turned on.

The time delay relay 1310 can also be replaced by a latching relay similar to the latching relays 1076 and 1082 to prevent discharge of the magazine while a bagger is operating. In this case, the switch 766 would be connected to the coil 1270 via a contact in the latching relay and the latching relay would be controlled by the bagger to close such contact only when the bagger is receptive to a charge of filamentary material.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A method of producing reduced-static, weighed charges of loosely aggregated Easter grass from compacted bales of Easter grass, the steps of the method comprising:

providing a plurality of bales of Easter grass, each bale being composed of compacted Easter grass filaments;

transferring the bales of Easter grass into a rotatable drum;

rotating the drum to disintegrate each bale of Easter grass into substantially separated Easter grass filaments;

producing an air flow through the drum, the air flow forcing the Easter grass filaments out of the drum and into a treatment chamber;

injecting an anti-static compound into the treatment chamber to coat the Easter grass filaments with the anti-static compound; and weighing out the Easter grass filaments into charges of loosely aggregated Easter grass filaments.

2. The method of claim 1 further comprising the step of:

transferring each charge of loosely aggregated Easter grass filaments to a storage compartment to be held for packaging.

3. The method of claim 1 wherein the step of weighing out the Easter grass filaments further comprises:

creating an air flow from the treatment chamber to a scale assembly wherein the air flow produces a continuous stream of Easter grass filaments to the scale assembly;

accumulating Easter grass from the continuous stream of Easter grass filaments on the scale assembly until a predetermined weight of Easter grass is accumulated; and discharging Easter grass having the predetermined weight from the scale assembly as a charge of loosely aggregated Easter grass.

4. The method of claim 1 wherein the step of injecting an anti-static compound further comprises:

spraying the anti-static compound in the form of a mist into the treatment chamber.

5. A method of producing reduced-static, weighed charges of loosely aggregated Easter grass from compacted bales of Easter grass, the steps of the method comprising:

providing a plurality of bales of Easter grass, each bale being composed of compacted Easter grass filaments;

transferring the bales of Easter grass into a rotatable drum;

rotating the drum to disintegrate each bale of Easter grass into tufts of Easter grass filaments;

producing an air flow through the drum, the air flow forcing the tufts of Easter grass filaments out of the drum and into a treatment chamber;

injecting an anti-static compound into the treatment chamber to coat the tufts of Easter grass filaments with the anti-static compound;

transferring the tufts of Easter grass filaments into a picking chamber having rotatable paddle wheel, a comb and a rotatable picker roll;

rotating the paddle wheel to tumble the tufts of Easter grass onto the comb;

rotating the picker roll to pick Easter grass filaments off the comb and to divide the tufts of Easter grass filaments into substantially separated Easter grass filaments; and weighing out the Easter grass filaments into charges of loosely aggregated Easter grass filaments.

6. The method of claim 5 further comprising the step of:

transferring each charge of loosely aggregated Easter grass filaments to a storage compartment to be held for packaging.

7. The method of claim 5 wherein the step of weighing out the Easter grass filaments further comprises:

creating an air flow from the treatment chamber to a scale assembly wherein the air flow produces a continuous stream of Easter grass filaments to the scale assembly;

accumulating Easter grass from the continuous stream of Easter grass filaments on the scale assembly until a predetermined weight of Easter grass is accumulated; and discharging Easter grass having the predetermined weight from the scale assembly as a charge of loosely aggregated Easter grass.

8. The method of claim 5 wherein the step of injecting an anti-static compound further comprises:

spraying the anti-static compound in the form of a mist into the treatment chamber.

* * * * *

UNITED STATES PATENT AND TRADEMARK OFFICE

CERTIFICATE OF CORRECTION

PATENT NO. : 5,238,707

DATED : August 24, 1993

INVENTOR(S) : Donald E. Weder

It is certified that error appears in the above-identified patent and that said Letters Patent is hereby corrected as shown below:

Column 1, Line 5; please delete the word "copending".

Column 1, Line 12; please delete the number "416,892" and substitute therefore --916,892--.

Column 29, Line 13; please delete the number "168" and substitute therefore --618--.

Column 34, Line 48; after the word "magazine", please insert the word --gate--.

Column 36, Line 33; please delete "to so" and substitute therefore --so to--.

Column 52, Line 29; please delete the number "428" and substitute therefore --448--.

Column 68, Line 50; after the word gate, please insert the following: --704 to begin opening, the opening of the fourth magazine gate--.

UNITED STATES PATENT AND TRADEMARK OFFICE

CERTIFICATE OF CORRECTION

PATENT NO. : 5,238,707

DATED : August 24, 1993

INVENTOR(S) : Donald E. Weder

It is certified that error appears in the above-indentified patent and that said Letters Patent is hereby corrected as shown below:

Column 68, Line 52; after the words power to, please insert the word --the--,

Signed and Sealed this

Fifth Day of July, 1994

Bruce Lehman

*Attest:*

BRUCE LEHMAN

*Attesting Officer*

*Commissioner of Patents and Trademarks*